US007568355B2

(12) United States Patent
Yabu

(10) Patent No.: US 7,568,355 B2
(45) Date of Patent: Aug. 4, 2009

(54) HUMIDITY CONTROL APPARATUS

(75) Inventor: Tomohiro Yabu, Osaka (JP)

(73) Assignee: Daikin Industries, Ltd., Osaka-shi (JP)

( * ) Notice: Subject to any disclaimer, the term of this patent is extended or adjusted under 35 U.S.C. 154(b) by 507 days.

(21) Appl. No.: 10/568,313

(22) PCT Filed: Aug. 17, 2004

(86) PCT No.: PCT/JP2004/011773

§ 371 (c)(1),
(2), (4) Date: Feb. 16, 2006

(87) PCT Pub. No.: WO2005/017417

PCT Pub. Date: Feb. 24, 2005

(65) Prior Publication Data

US 2006/0207429 A1 Sep. 21, 2006

(30) Foreign Application Priority Data

Aug. 18, 2003 (JP) ..... 2003-294140

(51) Int. Cl.
*F25D 17/06* (2006.01)

(52) U.S. Cl. ..... 62/94; 62/271; 62/476; 62/480; 96/126; 96/146; 96/154

(58) Field of Classification Search ..... 96/126, 96/146, 154; 62/94, 476, 480, 481
See application file for complete search history.

(56) References Cited

U.S. PATENT DOCUMENTS 5,003,961 A * 4/1991 Besik ..... 126/110 R
7,096,684 B2 * 8/2006 Yabu et al. ..... 62/271
2003/0019359 A1 * 1/2003 Shah et al. ..... 95/123

FOREIGN PATENT DOCUMENTS

JP 8-94124 A 4/1996
JP 9-229506 A 9/1997

(Continued)

OTHER PUBLICATIONS

Machine Translation of JP 2001-263729,A; Sep. 2001.*

(Continued)

*Primary Examiner*—Frank M Lawrence
*Assistant Examiner*—Christopher P Jones
(74) *Attorney, Agent, or Firm*—Birch, Stewart, Kolasch & Birch, LLP

(57) ABSTRACT

Disclosed is a humidity control device which is provided with an adsorptive element (81, 82) having a humidity control passageway (85) capable of adsorption of moisture from a first air stream and of release of moisture to a second air stream, and which provides an air stream, the humidity of which is conditioned in the adsorptive element (81, 82), to an indoor space. In the humidity control device, the adsorptive element (81, 82) is provided with an auxiliary passageway (86) through which a heating fluid flows when the adsorptive element (81, 82) is regenerated by releasing moisture to a second air stream from the humidity control passageway (85). As a result, during regeneration of the adsorptive element (81, 82) by releasing moisture to a second air stream, the amount of release moisture is increased, thereby enhancing the device performance.

18 Claims, 29 Drawing Sheets

FOREIGN PATENT DOCUMENTS

| | | | |
|---|---|---|---|
| JP | 10-9633 | A | 1/1998 |
| JP | 2001-201106 | A | 7/2001 |
| JP | 2001-263729 | A | 9/2001 |
| JP | 2002-115869 | A | 4/2002 |
| JP | 2003-139349 | A | 5/2003 |
| JP | 2003-139430 | A | 5/2003 |
| JP | 2003-161465 | A | 6/2003 |
| JP | 2003-202138 | A | 7/2003 |
| JP | 2003-227629 | A | 8/2003 |

OTHER PUBLICATIONS

Machine Translation of JP 08094124,A; Apr. 1996.*

* cited by examiner (A)

(B)

FIRST AIR

SECOND AIR

PRINCIPLE ADSORPTION/DESORPTION PROCESS

ACTUAL ADSORPTION/DESORPTION PROCESS

COOLING/ADSORPTION/DESORPTION PROCESS

ADSORPTION/HEATING/REGENERATION/DESORPTION PROCESS

COOLING/ADSORPTION/HEATING/REGENERATION/DESORPTION PROCESS

HUMIDITY CONTROL APPARATUS

TECHNICAL FIELD

This invention relates in general to a humidity control device for conditioning the humidity of air by means of adsorptive elements, and it is related in particular to a humidity control device which employs an adsorptive element capable of adsorbing moisture from a first air stream and of releasing moisture to a second air stream.

BACKGROUND ART

Humidity control devices for conditioning the humidity of air by means of adsorbent-containing adsorptive elements are known in the conventional technology (see for example JP, 1998-9633, A). This patent gazette discloses a humidity control device which is provided with two adsorptive elements and which performs a batch operation as described below. The humidity control device further includes a refrigerant circuit which conducts a refrigeration cycle.

Each adsorptive element adsorbs moisture in a first air stream so that the first air stream is dehumidified, and is regenerated by releasing moisture to a second air stream. And, the humidity control device is configured to carry out a batch running operation, in other words the operation of the humidity control device is alternately switched between a first operation and a second operation. In the first operation, a first air stream is dehumidified in the first adsorptive element while on the other hand the second adsorptive element is regenerated by a second air stream. In the second operation, the first adsorptive element is regenerated by a second air stream while on the other hand a first air stream is dehumidified in the second adsorptive element. As a result of such arrangement, the humidity control device continuously supplies either a stream of dehumidified air (i.e., a first air stream) or a stream of humidified air (a second air stream) into an indoor space.

For example, during the dehumidification operating mode, a first air stream is dehumidified in one adsorptive element. Thereafter, the first air stream is cooled in an evaporator of the refrigerant circuit. The first air stream is then supplied into the room. At this time, a second air stream is heated in a condenser of the refrigerant circuit. The second air stream is then supplied to the other adsorptive element. This causes the adsorptive element in receipt of the high-temperature second air stream to desorb moisture therefrom and, as a result, the adsorptive element is regenerated.

If a first air stream is dehumidified and is then supplied into the room, this provides dehumidification. At this time, a second air stream is humidified, so that if, instead of supplying a first air stream into the room, such a second air stream is supplied into the room, this provides humidification.

PROBLEMS THAT THE INVENTION INTENDS TO SOLVE

However, during the adsorptive-element regeneration, with the desorption of high-temperature moisture the adsorptive element dissipates heat and becomes cooled. In other words, when trying to increase the amount of release moisture (the amount of regeneration) during the regeneration of an adsorptive element, whereas the adsorptive element has to be heated to high temperature, it is adversely cooled, and the amount of regeneration becomes insufficient. This causes the amount of adsorption to decrease the next time the adsorptive element adsorbs moisture in a first air stream. This causes the device performance to deteriorate.

With these problems in mind, the present invention was made. Accordingly, an object of the present invention is to provide an improved humidity control device having adsorptive elements whereby the device performance is enhanced by increasing the amount of release moisture during the adsorptive-element regeneration.

DISCLOSURE OF THE INVENTION

In the present invention, it is arranged such that, when releasing moisture to a second air stream from an adsorptive element (81, 82), the adsorptive element (81, 82) is heated by a heating fluid.

More specifically, a first invention is directed to a humidity control device which comprises an adsorptive element (81, 82) having a humidity control passageway (85) capable of adsorbing moisture from a first air stream and of releasing moisture to a second air stream, and which supplies to an indoor space an air stream after the air stream being controlled in its humidity by the adsorptive element (81, 82). And, the humidity control device of the first invention is characterized in that the adsorptive element (81, 82) is provided with an auxiliary passageway (86) through which a heating fluid flows when the adsorptive element (81, 82) is regenerated by releasing moisture from the humidity control passageway (85).

In the first invention, when the adsorptive element (81, 82) is regenerated by releasing moisture, adsorbed from a first air stream, to a second air stream in the humidity control passageway (85), a heating fluid is passed through the auxiliary passageway (86). The adsorptive element (81, 82) is heated by the flow of the heating fluid. Accordingly, it becomes possible to maintain the adsorptive element (81, 82) at high temperature even when, with the releasing of moisture therefrom, the adsorptive element (81, 82) dissipates heat. This makes it possible to increase the amount of release moisture (the amount of regeneration) more than is conventionally achieved. Consequently, it is possible to increase also the amount of adsorption the next time the adsorptive element (81, 82) adsorbs moisture in a first air stream.

A second invention provides a humidity control device according to the humidity control device of the first invention. The humidity control device of the second invention is characterized in that, during regeneration of the adsorptive element (81, 82), all of a second air stream prior to its passage through the humidity control passageway (85) flows, as a heating fluid, into the auxiliary passageway (86).

In the second invention, during regeneration of the adsorptive element (81, 82), all of a second air stream prior to its passage through the humidity control passageway (85) flows, as a heating fluid, into the auxiliary passageway (86).

The second air stream is a high-temperature air stream which is used for regeneration of the adsorptive element (81, 82). And, the second air stream flows through the auxiliary passageway (86) and heats the adsorptive element (81, 82). Thereafter, the second air stream flows through the humidity control passageway (85), thereby preventing the adsorptive element (81, 82) from undergoing a temperature fall during regeneration. Hereby, it becomes possible to assure that a sufficient level of the amount of regeneration is maintained, thereby preventing the amount of adsorption from decreasing.

A third invention provides a humidity control device according to the humidity control device of the first invention.

The humidity control device of the third invention is characterized in that, during regeneration of the adsorptive element (81, 82), a part of a second air stream prior to its passage through the humidity control passageway (85) flows, as a heating fluid, into the auxiliary passageway (86), joins the rest of the second air stream, and passes through the humidity control passageway (85).

In the third invention, during regeneration of the adsorptive element (81, 82), a part of a second air stream prior to its passage through the humidity control passageway (85) enters, as a heating fluid, the auxiliary passageway (86). The second air stream is a high-temperature air stream which is used for regeneration of the adsorptive element (81, 82). The part of the second air stream flows through the auxiliary passageway (86) while heating the adsorptive element (81, 82). Thereafter, the part of the second air stream joins the rest of the second air stream. Then, the merged second air stream flows through the humidity control passageway (85), thereby preventing the adsorptive element (81, 82) from undergoing a temperature fall during regeneration. Hereby, it becomes possible to assure that a sufficient level of the amount of regeneration is maintained and, in addition, the amount of adsorption is prevented from decreasing.

A fourth invention provides a humidity control device according to the humidity control device of the second invention or according to the humidity control device of the third invention. The humidity control device of the fourth invention is characterized in that it includes a regeneration heater (72) which heats a second air stream prior to its entrance into the humidity control passageway (85) and the auxiliary passageway (86).

In the fourth invention, during regeneration of the adsorptive element (81, 82), a second air stream prior to the second air stream flowing into the humidity control passageway (85) and the auxiliary passageway (86) is heated by the regeneration heater (72). This accordingly makes it possible to sufficiently heat the adsorptive element (81, 82) in the auxiliary passageway (86) and in the humidity control passageway (85), thereby ensuring that the adsorptive element (81, 82) is prevented from undergoing a temperature fall. Hereby, it is possible to assure that a sufficient level of the amount of regeneration is maintained and, in addition, the amount of adsorption is prevented from decreasing.

A fifth invention provides a humidity control device according to the humidity control device of the fourth invention. The humidity control device of the fifth invention is characterized that it includes a refrigerant circuit (70) through which a refrigerant is circulated to perform a refrigeration cycle, and that the regeneration heater (72) is formed by a heating-heat exchanger of the refrigerant circuit (70).

In the fifth invention, the refrigerant dissipates heat in the regeneration heater (72) which is a heating-heat exchanger of the refrigerant circuit (70), as a result of which a second air stream and a heating fluid are heated. And, the adsorptive element (81, 82) is heated by the heating fluid while being regenerated by the second air stream, and it becomes possible to assure that a sufficient level of the amount of regeneration is maintained and, in addition, the amount of adsorption is prevented from decreasing.

A sixth invention provides a humidity control device according to the humidity control device of the second invention or according to the humidity control device of the third invention. The humidity control device of the sixth invention is characterized in that it includes a regeneration heater (72) which heats a second air stream prior to its entrance into the humidity control passageway (85) and the auxiliary passageway (86), and an auxiliary heater (78, 79) which heats a second air stream after its passage through the auxiliary passageway (86) before the second air stream flows into the humidity control passageway (85).

In the sixth invention, during regeneration of the adsorptive element (81, 82), a second air stream prior to the second air stream flowing into the humidity control passageway (85) and the auxiliary passageway (86) is heated by the regeneration heater (72). In addition, a second air stream after its passage through the auxiliary passageway (86) is heated again in the auxiliary heater (78, 79) before the second air stream flows into the humidity control passageway (85). This accordingly makes it possible to sufficiently heat the adsorptive element (81, 82) in the auxiliary passageway (86) and in the humidity control passageway (85), thereby ensuring that the adsorptive element (81, 82) is prevented from undergoing a temperature fall. This makes it possible to assure that a sufficient level of the amount of regeneration is maintained and, in addition, the amount of adsorption is prevented from decreasing.

A seventh invention provides a humidity control device according to the humidity control device of the sixth invention. The humidity control device of the seventh invention is characterized in that it includes a refrigerant circuit (70) through which a refrigerant is circulated to perform a refrigeration cycle, and that the regeneration heater (72) and the auxiliary heater (78, 79) are formed by heating-heat exchangers of the refrigerant circuit (70).

In the seventh invention, the refrigerant dissipates heat in the regeneration heater (72) which is a heating-heat exchanger of the refrigerant circuit (70) and in the auxiliary heater (78, 79) which is a heating-heat exchanger of the refrigerant circuit (70), as a result of which a second air stream and a heating fluid are heated. And, the adsorptive element (81, 82) is heated by the heating fluid while being regenerated by the second air stream, and it becomes possible to assure that a sufficient level of the amount of regeneration is maintained and, in addition, the amount of adsorption is prevented from decreasing.

An eighth invention provides a humidity control device according to the humidity control device of the second invention or according to the humidity control device of the third invention. The humidity control device of the eighth invention is characterized in that it includes a first adsorptive element (81) and a second adsorptive element (82), and is configured so as to perform a batch running operation which alternately switches between (a) a first operation in which moisture in a first air stream is adsorbed in the first adsorptive element (81) while moisture is released to a second air stream in the second adsorptive element (82) and (b) a second operation in which moisture in a first air stream is adsorbed in the second adsorptive element (82) while moisture is released to a second air stream in the first adsorptive element (81), and that the humidity control device is configured so as to be capable of performing (i) a cooling/adsorption operating mode in which a cooling fluid flows through the auxiliary passageway (86) of the first adsorptive element (81) or the second adsorptive element (82) whichever adsorbs moisture in a first air stream and (ii) a heating/regeneration operating mode in which a heating fluid flows through the auxiliary passageway (86) of the first adsorptive element (81) or the second adsorptive element (82) whichever releases moisture to a second air stream.

In the eighth invention, it becomes possible to perform either a dehumidification operation by supplying a first air stream into the room or a humidification operation by supplying a second air stream into the room while alternately switching the operation of the humidity control device between a first operation in which moisture in a first air stream is adsorbed in the first adsorptive element (81) while moisture is released to a second air stream in the second adsorptive element (82), and a second operation in which moisture in a first air stream is adsorbed in the second adsorptive element (82) while moisture is released to a second air stream in the first adsorptive element (81).

Here, with reference to a psychrometric chart of FIG. 28, the process of heating the adsorptive element (81, 82) under regeneration is specifically described by taking, as an example, a dehumidification mode of operation in the summertime. The psychrometric chart of FIG. 28 just conceptually represents the change in the state of air, in other words the psychrometric chart does not accurately represent actual amounts of dehumidification, actual amounts of humidification, or variations in temperature.

In the first place, a first air stream (outside air) at Point "A" as a target for dehumidification decreases in absolute humidity and increases in temperature when it passes through one of the adsorptive elements (81, 82). As a result, the first air stream changes position to Point "B". And, the air at Point "B" is cooled if needed (not shown) and is then supplied into the room. On the other hand, a second air stream (room air) at Point "C" for regeneration of the other of the adsorptive elements (81, 82) absorbs heat of adsorption of the one of the adsorptive elements (81, 82) and, as a result, is heated up to Point "D". The second air stream is further heated up to Point "E" by the regeneration heater (72). When passing through the other of the adsorptive elements (81, 82), the second air stream regenerates the other of the adsorptive elements (81, 82), during which time the second air stream increases in absolute humidity and decreases in temperature. As a result, the second air stream changes position to Point "F". The second air stream is then discharged to outside the room.

Here, during the dehumidification operating mode, the regenerative-side adsorptive element (81, 82) does not change state to such a state that the relative humidity of room air goes beyond the relative humidity line (equal relative humidity line), Φ1, of the outside air. That is to say, the room air is only able to cause Point "F" to change position to, at a maximum, the relative humidity line 101 1 where Point "A" of the outside air passes, and Point "F1" on the relative humidity line 101 1 of the outside air serves as a limiting point of regeneration. Therefore, the amount of regeneration in that case is ΔX. On the other hand, since the temperature at Point "F" rises on the relative humidity line 101 1 if regeneration is carried out simultaneously with heating, ΔX increases up to ΔX'. That is, the amount of regeneration increases.

As described above, if a heating fluid is passed through the auxiliary passageway (86) of the adsorptive element (81, 82) under regeneration, this prevents the regenerative-side adsorptive element (81, 82) from undergoing a temperature fall, thereby ensuring that a sufficient level of the amount of regeneration is maintained.

On the other hand, the process of cooling the adsorptive element (81, 82) under adsorption is described with reference to a psychrometric chart of FIG. 29, by taking, as an example, a humidification operating mode in the wintertime. In this case, a first air stream (for example, room air) at Point "A" changes position to Point "B" when passing through one of the adsorptive elements (81, 82) and is then discharged to outside the room. A second air stream (outside air) at Point "C" as a target for humidification is heated up to Point "E" by the one of the adsorptive elements (81, 82) and by the regeneration heater (72). When passing through the other of the adsorptive elements (81, 82), the second air stream regenerates the other of the adsorptive elements (81, 82), during which the second air stream is humidified, and changes position to Point "F". The second air stream is then supplied into the room.

Here, if the state point is at Point "F" in a principle adsorption/desorption process, then the state point is at Point "F1" in an actual adsorption/desorption process, and the amount of humidification decreases. On the other hand, if the amount of adsorption is increased by performing a cooling/adsorption operating mode, the air state in that case is at Point "F2", and the amount of humidification increases. In addition, the air state is at Point "F3" if a heating/regeneration operating mode is performed, and the air state is at Point "F4" if a heating/regeneration operating mode is carried out simultaneously with an adsorption/cooling operating mode. In both cases, the amount of humidification increases.

To sum up, if a cooling fluid is passed through the auxiliary passageway (86) of the adsorptive element (81, 82) under adsorption, this makes it possible for the cooling fluid to absorb heat of adsorption generated as a result of moisture adsorption. In the case where no cooling fluid is made to flow, the heat of adsorption causes the temperature of the adsorptive element (81, 82) to rise and, as a result, the adsorptive capability deteriorates. On the other hand, if a cooling fluid is made to flow, this prevents the adsorptive capability from deteriorating, thereby increasing the amount of humidification.

A ninth invention provides a humidity control device according to the humidity control device of the eighth invention. The humidity control device of the ninth invention is characterized in that it is configured so as to simultaneously perform (i) a cooling/adsorption operating mode in which a cooling fluid flows through the auxiliary passageway (86) of the first adsorptive element (81) or the second adsorptive element (82) whichever adsorbs moisture in a first air stream and (ii) a heating/regeneration operating mode in which a heating fluid flows through the auxiliary passageway (86) of the first adsorptive element (81) or the second adsorptive element (82) whichever releases moisture to a second air stream.

In the ninth invention, when performing a batch running operation in the humidity control device provided with the first adsorptive element (81) and the second adsorptive element (82), a cooling/adsorption operating mode is conducted in one of the adsorptive elements (81, 82) while simultaneously a heating/regeneration operating mode is conducted in the other of the adsorptive elements (81, 82). This makes it possible to improve both the adsorptive capability and the regenerative capability, thereby accomplishing improvement in total device performance.

A tenth invention provides a humidity control device according to the humidity control device of the eighth invention. The humidity control device of the tenth invention is characterized in that it is configured so as to be capable of selectively switching between (i) a cooling/adsorption operating mode in which a cooling fluid flows through the auxiliary passageway (86) of the first adsorptive element (81) or the second adsorptive element (82) whichever adsorbs moisture in a first air stream and (ii) a heating/regeneration operating mode in which a heating fluid flows through the auxiliary passageway (86) of the first adsorptive element (81) or the second adsorptive element (82) whichever releases moisture to a second air stream.

In the tenth invention, when performing a batch running operation in the humidity control device provided with the first adsorptive element (81) and the second adsorptive element (82), the humidity control device selectively switches between a cooling/adsorption operating mode in one of the adsorptive elements (81, 82) and a heating/regeneration operating mode in the other of the adsorptive elements (81, 82). Hereby, either the adsorptive capability or the regenerative capability is enhanced, thereby accomplishing improvement in device performance.

An eleventh invention provides a humidity control device according to the humidity control device of the eighth invention. The humidity control device of the eleventh invention is characterized in that it includes a regeneration heater (72) which heats a second air stream prior to its entrance into the humidity control passageway (85) and the auxiliary passageway (86) of one of the adsorptive elements (81, 82), and a cooler (79, 78) which cools a cooling fluid prior to its entrance into the humidity control passageway (85) of the other of the adsorptive elements (81, 82).

In the eleventh invention, a second air stream prior to the second air stream flowing into the humidity control passageway (85) and the auxiliary passageway (86) of a regenerative-side one of the adsorptive elements (81, 82) is heated by the regeneration heater (72). This makes it possible to sufficiently heat the regenerative-side adsorptive element in the auxiliary passageway (86) and in the humidity control passageway (85), thereby ensuring that the regenerative-side adsorptive element is prevented from undergoing a temperature fall during regeneration. This accordingly assures that a sufficient level of the amount of regeneration is maintained and, in addition, the amount of adsorption is prevented from decreasing. On the other hand, a cooling fluid prior to the cooling fluid flowing into the humidity control passageway (85) of an adsorptive-side one of the adsorptive elements (81, 82) is cooled by the cooler. This ensures that the rise in temperature of the adsorptive-side adsorptive element due to adsorption is also avoided.

A twelfth invention provides a humidity control device according to the humidity control device of the eleventh invention. The humidity control device of the twelfth invention is characterized in that it includes a refrigerant circuit (70) through which a refrigerant is circulated to perform a refrigeration cycle, and that the regeneration heater (72) is formed by a heating-heat exchanger of the refrigerant circuit (70) and the cooler (79, 78) is formed by a cooling-heat exchanger of the refrigerant circuit (70).

In the twelfth invention, the refrigerant dissipates heat in the regeneration heater (72) which is a heating-heat exchanger of the refrigerant circuit (70), as a result of which a heating fluid and a second air stream are heated. And, a regenerative-side one of the adsorptive elements (81, 82) is heated by the heating fluid while simultaneously being regenerated by the second air stream, thereby not only assuring that a sufficient level of the amount of regeneration is maintained but also preventing the amount of adsorption from decreasing. In addition, refrigerant absorbs heat in the cooler (79, 78) which is a cooling-heat exchanger of the refrigerant circuit (70) and, as a result, a cooling fluid is cooled. And, an adsorptive-side one of the adsorptive elements (81, 82) is cooled by the cooling fluid, and dehumidifies a first air stream, thereby making it possible to assure that a sufficient level of the amount of adsorption is maintained.

A thirteenth invention provides a humidity control device according to the humidity control device of the eighth invention. The humidity control device of the thirteenth invention is characterized in that it includes: a regeneration heater (72) which heats a second air stream prior to its entrance flowing into the humidity control passageway (85) and the auxiliary passageway (86) of one of the adsorptive elements (81, 82); an auxiliary heater (78, 79) which heats a second air stream after its passage through the auxiliary passageway (86) before the second air stream flows into the humidity control passageway (85); and a cooler (79, 78) which cools a cooling fluid prior to its entrance into the humidity control passageway (85) of the other of the adsorptive elements (81, 82).

In the thirteenth invention, a second air stream prior to the second air stream flowing into the humidity control passageway (85) and the auxiliary passageway (86) of a regenerative-side one of the adsorptive elements (81, 82) is heated by the regeneration heater (72), and the second air stream after its passage through the auxiliary passageway (86) is heated again by the auxiliary heater (78, 79) before the second air stream flows into the humidity control passageway (85). This makes it possible to sufficiently heat the regenerative-side adsorptive element (81, 82) in the auxiliary passageway (86) and in the humidity control passageway (85), thereby ensuring that the regenerative-side adsorptive element (81, 82) is prevented from undergoing a temperature fall during regeneration. This accordingly assures that a sufficient level of the amount of regeneration is maintained and, in addition, the amount of adsorption is prevented from decreasing. In addition, a cooling fluid prior to the cooling fluid flowing into the humidity control passageway (85) of an adsorptive-side one of the adsorptive elements (81, 82) is cooled by the cooler. This ensures that the rise in temperature of the adsorptive-side adsorptive element due to adsorption is also avoided.

A fourteenth invention provides a humidity control device according to the humidity control device of the thirteenth invention. The humidity control device of the fourteenth invention is characterized in that it includes a refrigerant circuit (70) through which a refrigerant is circulated to perform a refrigeration cycle, and that the regeneration heater (72) and the auxiliary heater (78, 79) are formed by heating-heat exchangers of the refrigerant circuit (70) and the cooler (79, 78) is formed by a cooling-heat exchanger of the refrigerant circuit (70).

In the fourteenth invention, the refrigerant dissipates heat in the regeneration heater (72) and the auxiliary heater (78, 79) which are the heating-heat exchangers of the refrigerant circuit (70), as a result of which a heating fluid and a second air stream are heated. And, a regenerative-side one of the adsorptive elements (81, 82) is heated by the heating fluid while simultaneously being regenerated by the second air stream, thereby not only assuring that a sufficient level of the amount of regeneration is maintained but also preventing the amount of adsorption from decreasing. In addition, refrigerant absorbs heat in the cooler (79, 78) which is a cooling-heat exchanger of the refrigerant circuit (70) and, as a result, a cooling fluid is cooled. And, an adsorptive-side one of the adsorptive elements (81, 82) is cooled by the cooling fluid, and dehumidifies a first air stream, thereby assuring that a sufficient level of the amount of adsorption is maintained.

A fifteenth invention provides a humidity control device according to the humidity control device of the twelfth invention. The humidity control device of the fifteenth invention is characterized in that the direction of refrigerant circulation in the refrigerant circuit (70) is reversible, and that the direction of circulation of the refrigerant circuit (70) is changed in response to switching between adsorptive and regenerative sides in the batch running operation.

A sixteenth invention provides a humidity control device according to the humidity control device of the fourteenth invention. The humidity control device of the sixteenth invention is characterized in that the direction of refrigerant circulation in the refrigerant circuit (70) is reversible, and that the direction of circulation of the refrigerant circuit (70) is changed in response to switching between adsorptive and regenerative sides in the batch running operation.

In the fifteenth and sixteenth inventions, when performing a batch switching operation in the humidity control device, the direction of refrigerant circulation in the refrigerant circuit (70) is changed in conformity to the flow of a heating fluid through the auxiliary passageway (86) of a regenerative-side one of the adsorptive elements (81, 82) and the flow of a cooling fluid through the auxiliary passageway (86) of an adsorptive-side one of the adsorptive elements (81, 82). Also, in this case, it becomes possible to accomplish improvement in device performance by performing a heating/regeneration operating mode and a cooling/adsorption operating mode.

EFFECTS

In accordance with the first invention, it is arranged such that the adsorptive element (81, 82) is provided with the auxiliary passageway (86) through which a heating fluid flows during regeneration of the adsorptive element (81, 82). As a result of such arrangement, the adsorptive element (81, 82) is heated by the heating fluid flowing through the auxiliary passageway (86) during regeneration of the adsorptive element (81, 82). Hereby, the adsorptive element (81, 82) is maintained at high temperature, thereby making it possible to increase the amount of release moisture (i.e., the amount of regeneration) more than is conventionally achieved. Consequently, the amount of adsorption can likewise be increased the next time the adsorptive element (81, 82) adsorbs moisture in a first air stream, thereby accomplishing improvement in device performance.

In accordance with the second invention, during regeneration of the adsorptive element (81, 82), all of a second air stream of high temperature which is used to regenerate the adsorptive element (81, 82) flows, as a heating fluid, through the auxiliary passageway (86) and heats the adsorptive element (81, 82). Thereafter, the second air stream flows through the humidity control passageway (85). Consequently, the adsorptive element (81, 82) is prevented from undergoing a temperature fall. This therefore assures that a sufficient level of the amount of regeneration is maintained, and the amount of adsorption is prevented from decreasing.

In accordance with the third invention, during regeneration of the adsorptive element (81, 82), a part of a second air stream of high temperature prior to its passage through the humidity control passageway (85) flows, as a heating fluid, into and through the auxiliary passageway (86) while heating the adsorptive element (81, 82). Thereafter, the part of the second air stream joins the rest of the second air stream and flows through the humidity control passageway (85), whereby the adsorptive element (81, 82) is regenerated without undergoing a temperature fall. This assures that a sufficient level of the amount of regeneration is maintained, and the amount of adsorption is prevented from decreasing.

In accordance with the fourth invention, during regeneration of the adsorptive element (81, 82), a second air stream prior to the second air stream flowing into the humidity control passageway (85) is heated by the regeneration heater (72), thereby making it possible to sufficiently heat the adsorptive element (81, 82). Consequently, the adsorptive element (81, 82) is prevented, without fail, from undergoing a temperature fall. This assures that a sufficient level of the amount of regeneration is maintained, and the amount of adsorption is prevented from decreasing.

In accordance with the fifth invention, a second air stream and a heating fluid are heated by the regeneration heater (72) which is a heating-heat exchanger of the refrigerant circuit (70), thereby to regenerate the adsorptive element (81, 82). This assures that a sufficient level of the amount of regeneration is maintained, and the amount of adsorption is prevented from decreasing.

In accordance with the sixth invention, during regeneration of the adsorptive element (81, 82), a second air stream prior to the second air stream flowing into the humidity control passageway (85) is heated by the regeneration heater (72). In addition, the second air stream after its passage through the auxiliary passageway (86) is heated by the auxiliary heater (78, 79) before the second air stream flows into the humidity control passageway (85). This makes it possible to sufficiently heat the adsorptive element (81, 82), thereby ensuring that the adsorptive element (81, 82) is prevented from undergoing a temperature fall. This assures that a sufficient level of the amount of regeneration is maintained and, in addition, the amount of adsorption is prevented from decreasing.

In accordance with the seventh invention, it is arranged such that a second air stream and a heating fluid are heated by the regeneration heater (72) and the auxiliary heater (78, 79) which are heating-heat exchangers of the refrigerant circuit (70), thereby to regenerate the adsorptive element (81, 82). Such arrangement assures that a sufficient level of the amount of regeneration is maintained and, in addition, the amount of adsorption is prevented from decreasing.

In accordance with the eighth invention, when performing a batch running operation which alternately switches between a first operation in which moisture in a first air stream is adsorbed in the first adsorptive element (81) while moisture is released to a second air stream in the second adsorptive element (82) and a second operation in which moisture in a first air stream is adsorbed in the second adsorptive element (82) while moisture is released to a second air stream in the first adsorptive element (81), it is possible to perform (i) a heating/regeneration operating mode in which a heating fluid is made to flow through the auxiliary passageway (86) of the first adsorptive element (81) or the second adsorptive element (82) whichever releases moisture to the second air stream and (ii) a cooling/adsorption operating mode in which a cooling fluid is made to flow through the auxiliary passageway (86) of the first adsorptive element (81) or the second adsorptive element (82) whichever adsorbs moisture in the first air stream. This assures that a sufficient level of the amount of regeneration is maintained, thereby enhancing the regenerative capability, and that a sufficient level of the amount of adsorption is maintained, thereby enhancing the adsorptive capability.

In accordance with the ninth invention, when performing a batch running operation in the humidity control device provided with the first adsorptive element (81) and the second adsorptive element (82), a cooling/adsorption operating mode in one of the adsorptive elements (81, 82) and a heating/regeneration operating mode in the other of the adsorptive elements (81, 82) are conducted at the same time. This makes it possible to enhance both the adsorptive capability and the regenerative capability, thereby accomplishing improvement in total device performance.

In accordance with the tenth invention, when performing a batch running operation in the humidity control device provided with the first adsorptive element (81) and the second adsorptive element (82), the operation of the humidity control device selectively switches between a cooling/adsorption operating mode in one of the adsorptive elements (81, 82) and a heating/regeneration operating mode in the other of the adsorptive elements (81, 82). This makes it possible to enhance either the adsorptive capability or the regenerative capability.

In accordance with the eleventh invention, it is arranged such that the regeneration heater (72) for heating a second air stream prior to the second air stream flowing into the humidity control passageway (85) of one of the adsorptive elements (81, 82), and the cooler (79, 78) for cooling a cooling fluid prior to the cooling fluid flowing into the humidity control passageway (85) of the other of the adsorptive elements (81, 82) are provided. As a result of such arrangement, the regenerative-side adsorptive element (81, 82) can be heated by the regeneration heater (72) while on the other hand the adsorptive-side adsorptive element (81, 82) can be cooled by the cooler. This ensures that the regenerative-side adsorptive element (81, 82) is prevented from undergoing a temperature fall during regeneration, thereby assuring that a sufficient level of the regenerative capability is maintained, and that the adsorptive-side adsorptive element (81, 82) is prevented from undergoing a temperature rise during adsorption, thereby assuring that a sufficient level of the adsorptive capability is maintained.

In accordance with the twelfth invention, a heating fluid and a second air stream are heated by the regeneration heater (72), thereby not only assuring that a sufficient level of the amount of regeneration is maintained but also preventing the amount of adsorption from decreasing. In addition, since a cooling fluid is cooled by the cooler (79, 78), this assures that a sufficient level of the amount of adsorption is maintained.

In accordance with the thirteenth invention, it is arranged such that the regeneration heater (72) for heating a second air stream prior to the second air stream flowing into the humidity control passageway (85) of one of the adsorptive elements (81, 82), the auxiliary heater (78, 79) for heating a second air stream after its passage through the auxiliary passageway (86) of the one of the adsorptive elements (81, 82) before the second air stream flows into the humidity control passageway (85), and the cooler (79, 78) for cooling a cooling fluid prior to the cooling fluid flowing into the humidity control passageway (85) of the other of the adsorptive elements (81, 82) are provided. As a result of such arrangement, the regenerative-side adsorptive element (81, 82) can be heated by the regeneration heater (72) and the auxiliary heater (78, 79) while on the other hand the adsorptive-side adsorptive element (81, 82) can be cooled by the cooler. This ensures without fail that the regenerative-side adsorptive elements (81, 82) is prevented from undergoing a temperature fall during regeneration, thereby assuring that a sufficient level of the regenerative capability is maintained, and that the adsorptive-side adsorptive elements (81, 82) is prevented from undergoing a temperature rise during adsorption, thereby assuring that a sufficient level of the adsorptive capability is maintained.

In accordance with the fourteenth invention, it is arranged such that a heating fluid and a second air stream are heated by the regeneration heater (72) and the auxiliary heater (78, 79), thereby not only assuring that a sufficient level of the amount of regeneration is maintained but also preventing the amount of adsorption from decreasing. In addition, a cooling fluid is cooled by the cooler (79, 78), thereby assuring that a sufficient level of the amount of adsorption is maintained.

In accordance with the fifteenth and sixteenth inventions, when performing a batch switching operation in the humidity control device, it becomes possible to accomplish improvement in device performance by performing a heating/regeneration operating mode and a cooling/adsorption operation mode while changing the direction of refrigerant circulation in the refrigerant circuit (70) in conformity to the flow of a heating fluid through the auxiliary passageway (86) of the regenerative-side adsorptive element (81, 82) and the flow of a cooling fluid through the auxiliary passageway (86) of the adsorptive-side adsorptive elements (81, 82).

BRIEF DESCRIPTION OF THE DRAWINGS

FIG. 1 is a schematic constructional diagram of a humidity control device according to a first embodiment of the present invention, wherein FIG. 1(A) is a top view, FIG. 1(B) is a left side view, FIG. 1(C) is a right side view, and FIG. 1(D) is a rear view.

FIG. 3 is an explanatory diagram which conceptually illustrates the running operation of the humidity control device of the first embodiment, wherein FIG. 3(A) depicts the flow of air streams in a first operation and FIG. 3(B) depicts the flow of air streams in a second operation.

FIG. 8 is an explanatory diagram which conceptually illustrates the running operation of a humidity control device according to a first variation of the first embodiment, wherein FIG. 8(A) depicts the flow of air streams in a first operation and FIG. 8(B) depicts the flow of air streams in a second operation.

FIG. 9 is a schematic constructional diagram of a humidity control device according to a second variation of the first embodiment, wherein FIG. 9(A) is a top view, FIG. 9(B) is a left side view, FIG. 9(C) is a right side view, and FIG. 9(D) is a rear view.

FIG. 10 is an explanatory diagram which conceptually illustrates the configuration and the running operation of a humidity control device according to a third variation of the first embodiment, wherein FIG. 10(A) depicts the flow of air streams in a first operation and FIG. 10(B) depicts the flow of air streams in a second operation.

FIG. 11 is an explanatory diagram which conceptually illustrates the configuration and the running operation of a humidity control device according to a fourth variation of the first embodiment, wherein FIG. 11(A) depicts the flow of air streams in a first operation and FIG. 11(B) depicts the flow of air streams in a second operation.

FIG. 12 is a schematic constructional diagram of a humidity control device according to a second embodiment of the present invention, wherein FIG. 12(A) is a top view, FIG. 12(B) is a left side view, FIG. 12(C) is a right side view, and FIG. 12(D) is a rear view.

13(A) depicts the flow of air streams in a first operation and FIG. 13(B) depicts the flow of air streams in a second operation.

FIG. 18 is an explanatory diagram which conceptually illustrates the running operation of a humidity control device according to a first variation of the second embodiment, wherein FIG. 18(A) depicts the flow of air streams in a first operation and FIG. 18(B) depicts the flow of air streams in a second operation.

FIG. 19 is a schematic constructional diagram of a humidity control device according to a second variation of the second embodiment, wherein FIG. 19(A) is a top view, FIG. 19(B) is a left side view, FIG. 19(C) is a right side view, and FIG. 19(D) is a rear view.

FIG. 24 is an explanatory diagram which conceptually illustrates the running operation of the humidity control device of the third embodiment, wherein FIG. 24(A) depicts the flow of air streams in a first operation and FIG. 24(B) depicts the flow of air streams in a second operation.

BEST MODE FOR CARRYING OUT THE INVENTION

Hereinafter, embodiments of the present invention are described in detail with reference to the drawings.

FIRST EMBODIMENT OF THE INVENTION

Configuration of Humidity Control Device

A humidity control device (1) according to a first embodiment of the present invention is configured, such that its operation is selectively switchable between a dehumidification operating mode in which air is dehumidified and is then supplied into the room and a humidification operating mode in which air is humidified and is then supplied into the room. In addition, the humidity control device (1) of the first embodiment is provided with two identical adsorptive elements (81, 82). The humidity control device (1) is configured so as to perform a batch running operation in which the adsorptive elements (81, 82) alternately switch between "serving as an adsorptive-side adsorptive element" and "serving as a regenerative-side adsorptive element". Here, the configuration of the humidity control device (1) according to the present embodiment is described with reference to FIG. 1 and FIG. 2. In addition, the following description of the first embodiment includes terms, such as "upper", "lower", "left", "right", "rear", "front", and "back". Each of the terms means, unless otherwise stated, a respective direction when viewing the humidity control device (1) of FIG. 1(A) from the front side thereof (from the bottom side relative to the figure).

Figure 1:
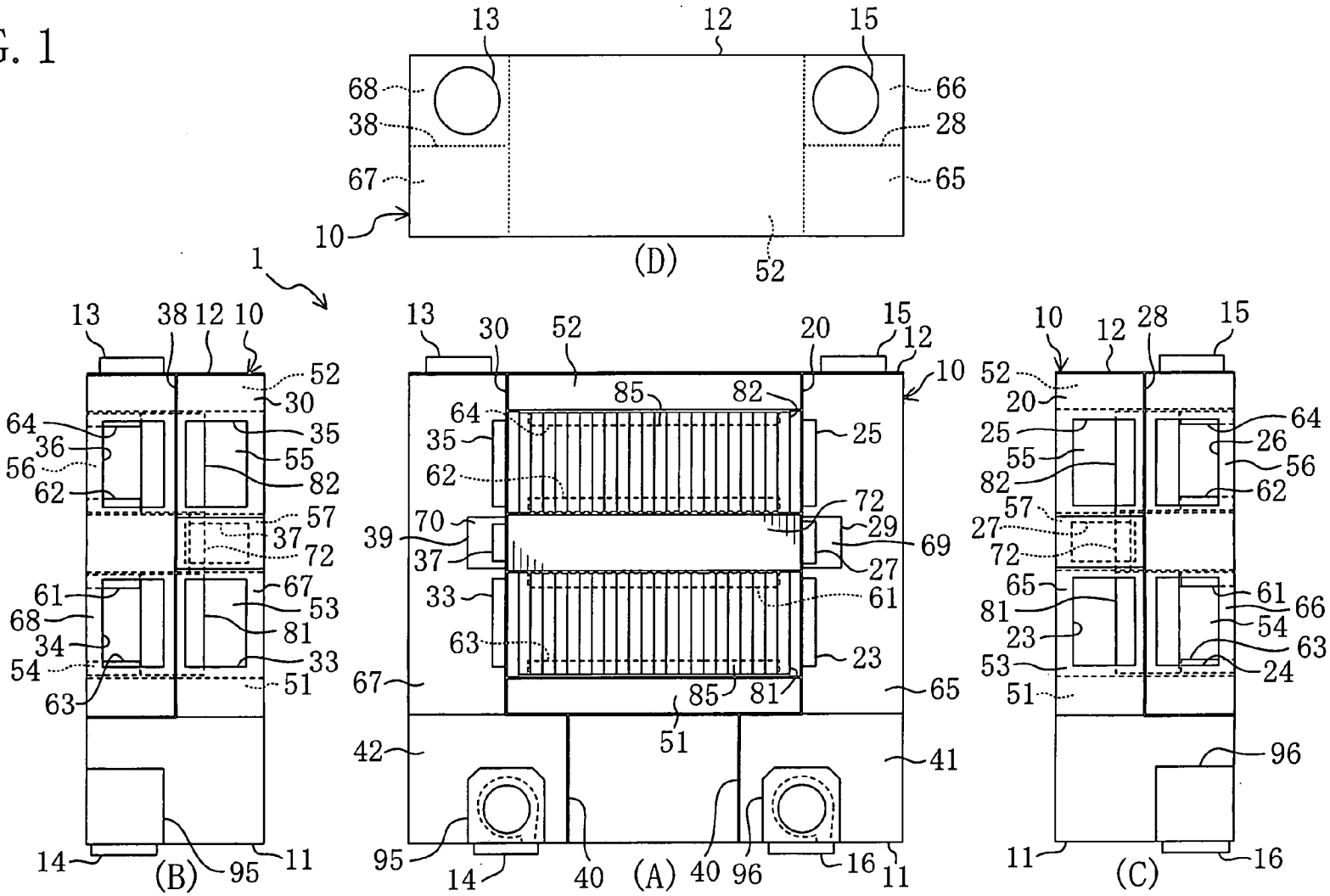

FIG. 1 includes FIG. 1(A) which is a top view, FIG. 1(B) which is a left side view, FIG. 1(C) which is a right side view, and FIG. 1(D) which is a rear view. As shown in FIG. 1, the humidity control device (1) has a somewhat flat, rectangular parallelepiped-shaped casing (10). Formed within the casing (10) are a first air passageway through which outside air is drawn in and is then supplied into the room, and a second air passageway through which room air drawn in and is then discharged to outside the room. In addition, the two adsorptive elements (81, 82) and a regeneration heat exchanger (72) as a regeneration heater are accommodated within the casing (10). The adsorptive elements (81, 82) are disposed, respectively, in the air passageways. The regeneration heat exchanger (72) is a heat exchanger which heats air by making use of heated water flowing therethrough. The regeneration heat exchanger (72) is disposed between the adsorptive elements (81, 82).

Figure 2:
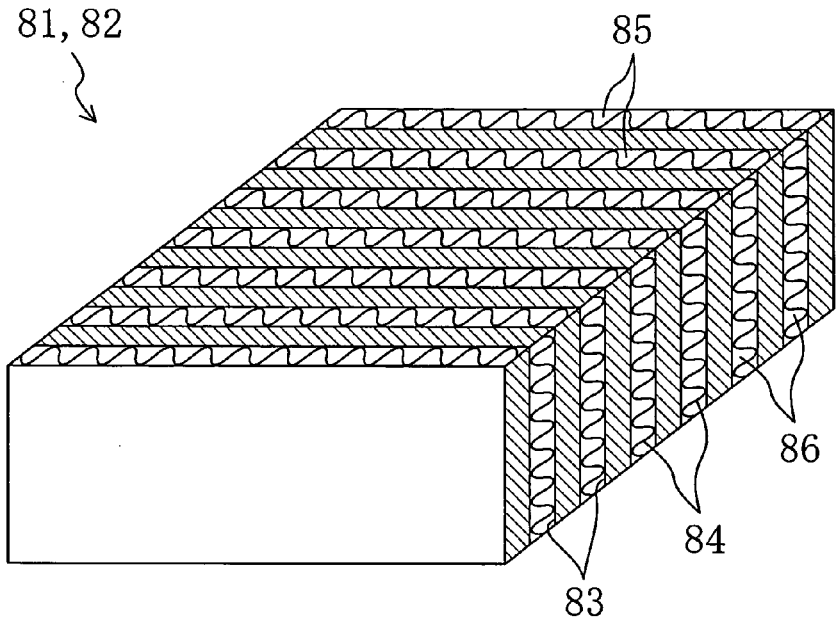
FIG. 2 is a schematic perspective view illustrating an adsorptive element of the humidity control device of the first embodiment.

As shown in FIG. 2, the adsorptive element (81, 82) comprises a laminated structure, in other words flat plate members (83) shaped like a flat plate and corrugated plate members (84) shaped like a corrugated plate are alternately stacked one upon the other to form the laminated structure. The corrugated plate members (84) are stacked in layers in such an orientation that adjoining corrugated plate members (84) are deviated an angle of 90 degrees from each other relative to the ridge line direction. And, the adsorptive element (81, 82) is generally shaped like a rectangular parallelepiped or like a quadratic prism.

In the adsorptive element (81, 82), humidity control passageways (85) and auxiliary passageways (86) are alternately partition-formed so as to be located opposite each other across respective flat plate members (83), in the direction in which the flat plate members (83) and the corrugated plate members (84) are alternately stacked one upon the other. The humidity control passageway (85) opens at opposing side surfaces of the adsorptive element (81, 82) on the side of longer sides of the flat plate member (83) while on the other hand the auxiliary passageway (86) opens at side surfaces of the adsorptive element (81, 82) on the side of shorter sides of the flat plate member (83).

In the adsorptive element (81, 82), an adsorbent for adsorbing moisture is applied onto a surface of the flat plate member (83) that faces the humidity control passageway (85), and onto a surface of the corrugated plate member (84) disposed in the humidity control passageway (85). As this sort of adsorbent, for example, silica gel, zeolite, ion-exchange resin, and other substance may be used.

As shown in FIG. 1, in the casing (10), a first panel (11) is the frontmost-side panel and a second panel (12) is the backmost-side panel. An air supply opening (14) is formed at a lower part of the first panel (11) in the vicinity of its left periphery. An air discharge opening (16) is formed at a lower part of the first panel (11) in the vicinity of its right periphery. On the other hand, an indoor-side suction opening (13) is formed at a lower part of the second panel (12) in the vicinity of its left periphery. An outdoor-side suction opening (15) is formed at a lower part of the second panel (12) in the vicinity of its right periphery.

The interior of the casing (10) is partitioned, relative to the direction extending from the front-side first panel (11) to the back-side second panel (12), into two spaces.

The space formed on the side of the second panel (12) of the casing (10), i.e., the space formed on the back side of the casing (10), is first described. This space is laterally divided into three spaces by a right side partition plate (20) and a left side partition plate (30).

The space on the right side of the right side partition plate (20) is vertically partitioned by a right side lower/upper-partition plate (28) into an upper space and a lower space. In the space, the upper space forms an upper right flow passage (65) and the lower space forms a lower right flow passage (66). The lower right flow passage (66) is in fluid communication with an outdoor space through the outdoor-side suction opening (15).

On the other hand, the space on the left side of the left side partition plate (30) is vertically partitioned by a left side lower/upper-partition plate (38) into an upper space and a lower space. In the space, the upper space forms an upper left flow passage (67) and the lower space forms a lower left flow passage (68). The lower left flow passage (68) is in fluid communication with an indoor space through the indoor-side suction opening (13).

Arranged in the space between the right side partition plate (20) and the left side partition plate (30) are two adsorptive elements (81, 82). The adsorptive elements (81, 82) are arranged in side by side and front-to-rear relationship at a specific distance apart from each other. More specifically, the first adsorptive element (81) is disposed in the vicinity of the front-side first panel (11) while on the other hand the second adsorptive element (82) is disposed in the vicinity of the back-side second panel (12).

Each of the adsorptive elements (81, 82) is arranged such that the direction, in which the flat and corrugated plate members (83, 84) are laminated together, agrees with the lateral direction of the casing (10). And, in each of the adsorptive elements (81, 82), the humidity control passageway (85) opens in the vertical direction of the casing (10) while the auxiliary passageway (86) opens in the front-to-rear direction of the casing (10).

The third space defined between the right side partition plate (20) and the left side partition plate (30) is partitioned into a first flow passage (51), a second flow passage (52), a first upper flow passage (53), a first lower flow passage (54), a second upper flow passage (55), a second lower flow passage (56), and a central flow passage (57).

The first flow passage (51) is formed on the front side of the first adsorptive element (81), being in fluid communication with the auxiliary passageway (86) of the first adsorptive element (81). The second flow passage (52) is formed on the back side of the second adsorptive element (82), being in fluid communication with the auxiliary passageway (86) of the second adsorptive element (82).

The first upper flow passage (53) is formed on the upper side of the first adsorptive element (81) and is in fluid communication with the humidity control passageway (85) of the first adsorptive element (81). The first lower flow passage (54) is formed on the lower side of the first adsorptive element (81) and is in fluid communication with the humidity control passageway (85) of the first adsorptive element (81). On the other hand, the second upper flow passage (55) is formed on the upper side of the second adsorptive element (82) and is in fluid communication with the humidity control passageway (85) of the second adsorptive element (82). The second lower flow passage (56) is formed on the lower side of the second adsorptive element (82) and is in fluid communication with the humidity control passageway (85) of the second adsorptive element (82).

The central flow passage (57) is formed between the first adsorptive element (81) and the second adsorptive element (82) and is in fluid communication with the auxiliary passageway (86) of each of the adsorptive elements (81, 82). The regeneration heat exchanger (72) is placed, substantially in a horizontal position, in the central flow passage (57). The regeneration heat exchanger (72) is disposed such that its top surface lies at a level of height substantially corresponding to that of the first and second adsorptive elements (81, 82). The regeneration heat exchanger (72) is configured so that a stream of air flowing through the central flow passage (57) is heated by heat exchange with heated water.

As a partition between the central flow passage (57) and the first lower flow passage (54), an inside first shutter (61) is provided. On the other hand, as a partition between the central flow passage (57) and the second lower flow passage (56), an inside second shutter (62) is provided. Both the inside first shutter (61) and the inside second shutter (62) are constructed, such that they can freely be placed in the open or closed state.

As a partition between the first flow passage (51) and the first lower flow passage (54), an outside first shutter (63) is provided. On the other hand, as a partition between the second flow passage (52) and the second lower flow passage (56), an outside second shutter (64) is provided. Both the outside first shutter (63) and the outside second shutter (64) are constructed, such that they can freely be placed in the open or closed state.

Formed in the right side partition plate (20) are a first upper right opening (23), a first lower right opening (24), a second upper right opening (25), a second lower right opening (26), and a third upper right opening (27). Each of these openings (23, 24, . . . ) is provided with a respective opening/closing shutter, in other word each opening is configured so as to be capable of freely being placed in the open or closed state.

The first upper right opening (23) is positioned at the upper side of a part of the right side partition plate (20) situated adjacent to the first adsorptive element (81). When the opening/closing shutter of the first upper right opening (23) is placed in the open state, the first upper flow passage (53) and the upper right flow passage (65) come into fluid communication with each other. The first lower right opening (24) is positioned at the lower side of a part of the right side partition plate (20) situated adjacent to the first adsorptive element (81). When the opening/closing shutter of the first lower right opening (24) is placed in the open state, the first lower flow passage (54) and the lower right flow passage (66) come into fluid communication with each other.

The second upper right opening (25) is positioned at the upper side of a part of the right side partition plate (20) situated adjacent to the second adsorptive element (82). When the opening/closing shutter of the second upper right opening (25) is placed in the open state, the second upper flow passage (55) and the upper right flow passage (65) come into fluid communication with each other. The second lower right opening (26) is positioned at the lower side of a part of the right side partition plate (20) situated adjacent to the second adsorptive element (82). When the opening/closing shutter of the second lower right opening (26) is placed in the open state, the second lower flow passage (56) and the lower right flow passage (66) come into fluid communication with each other.

The third upper right opening (27) is formed between the first upper right opening (23) and the second upper right opening (25). The third upper right opening (27) is positioned at the upper side of a part of the right side partition plate (20) situated adjacent to the regeneration heat exchanger (72). Provided around the third upper right opening (27) is a right side partition wall (29). A right side air introducing path (69) in fluid communication with the central flow passage (57) is partition-formed between the right side partition plate (20) and the right side partition wall (29). The right side air introducing path (69) within the right side partition wall (29) is isolated from the upper right flow passage (65), but it is in fluid communication with the lower right flow passage (66) through the opening of the right side lower/upper-partition plate (28).

Formed in the left side partition plate (30) are a first upper left opening (33), a first lower left opening (34), a second upper left opening (35), a second lower left opening (36), and a third upper left opening (37). Each of these openings (33, 34, . . . ) is provided with a respective opening/closing shutter, in other word each opening is configured so as to be capable of freely being placed in the open or closed state.

The first upper left opening (33) is positioned at the upper side of a part of the left side partition plate (30) situated adjacent to the first adsorptive element (81). When the opening/closing shutter of the first upper left opening (33) is placed in the open state, the first upper flow passage (53) and the upper left flow passage (67) come into fluid communication with each other. The first lower left opening (34) is positioned at the lower side of a part of the left side partition plate (30) situated adjacent to the first adsorptive element (81). When the opening/closing shutter of the first lower left opening (34) is placed in the open state, the first lower flow passage (54) and the lower left flow passage (68) come into fluid communication with each other.

The second upper left opening (35) is positioned at the upper side of a part of the left side partition plate (30) situated adjacent to the second adsorptive element (82). When the opening/closing shutter of the second upper left opening (35) is placed in the open state, the second upper flow passage (55) and the upper left flow passage (67) come into fluid communication with each other. The second lower left opening (36) is positioned at the lower side of a part of the left side partition plate (30) situated adjacent to the second adsorptive element (82). When the opening/closing shutter of the second lower left opening (36) is placed in the open state, the second lower flow passage (56) and the lower left flow passage (68) come into fluid communication with each other.

The third upper left opening (37) is formed between the first upper left opening (33) and the second upper left opening (35). The third upper left opening (37) is positioned at the upper side of a part of the left side partition plate (30) situated adjacent to the regeneration heat exchanger (72). Provided around the third upper left opening (37) is a left side partition wall (39). A left side air introducing path (70) in fluid communication with the central flow passage (57) is partition-formed between the left side partition plate (30) and the left side partition wall (39). The left side air introducing path (70) within the left side partition wall (39) is isolated from the upper left flow passage (67), but it is in fluid communication with the lower left flow passage (68) through the opening of the left side lower/upper-partition plate (38).

Next, the space formed on the side of the first panel (11) of the casing (10), i.e., the space formed on the front side of the casing (10), is described. The space is laterally partitioned into three spaces by two partition plates (40) which are mounted centrally in the space. And, of the spaces a right side space and a left side space constitute an air discharge chamber (41) and an air supply chamber (42), respectively.

The air discharge chamber (41) is in fluid communication with the upper right flow passage (65) as well as in fluid communication with an outdoor space through the air discharge opening (16). The air discharge chamber (41) is provided with an air discharge fan (96). The air discharge fan (96) is to deliver air to be treated to outside the room through the air discharge opening (16).

The air supply chamber (42) is in communication with the upper left flow passage (67) as well as in fluid communication with an indoor space through the air supply opening (14). The air supply chamber (42) is provided with an air supply fan (95). The air supply fan (95) is to deliver air to be treated into the room through the air supply opening (14).

Running Operation

Next, the running operation of the above-described humidity control device (1) is described. The humidity control device (1) takes in a first air stream which is a first process-air stream and a second air stream which is a second process-air stream and its operation selectively switches between a dehumidification operating mode and a humidification operating mode. In addition, the humidity control device (1) alternately performs a first operation and a second operation (these two different operation will be described later), thereby to continuously provide dehumidification or humidification.

Figure 3:
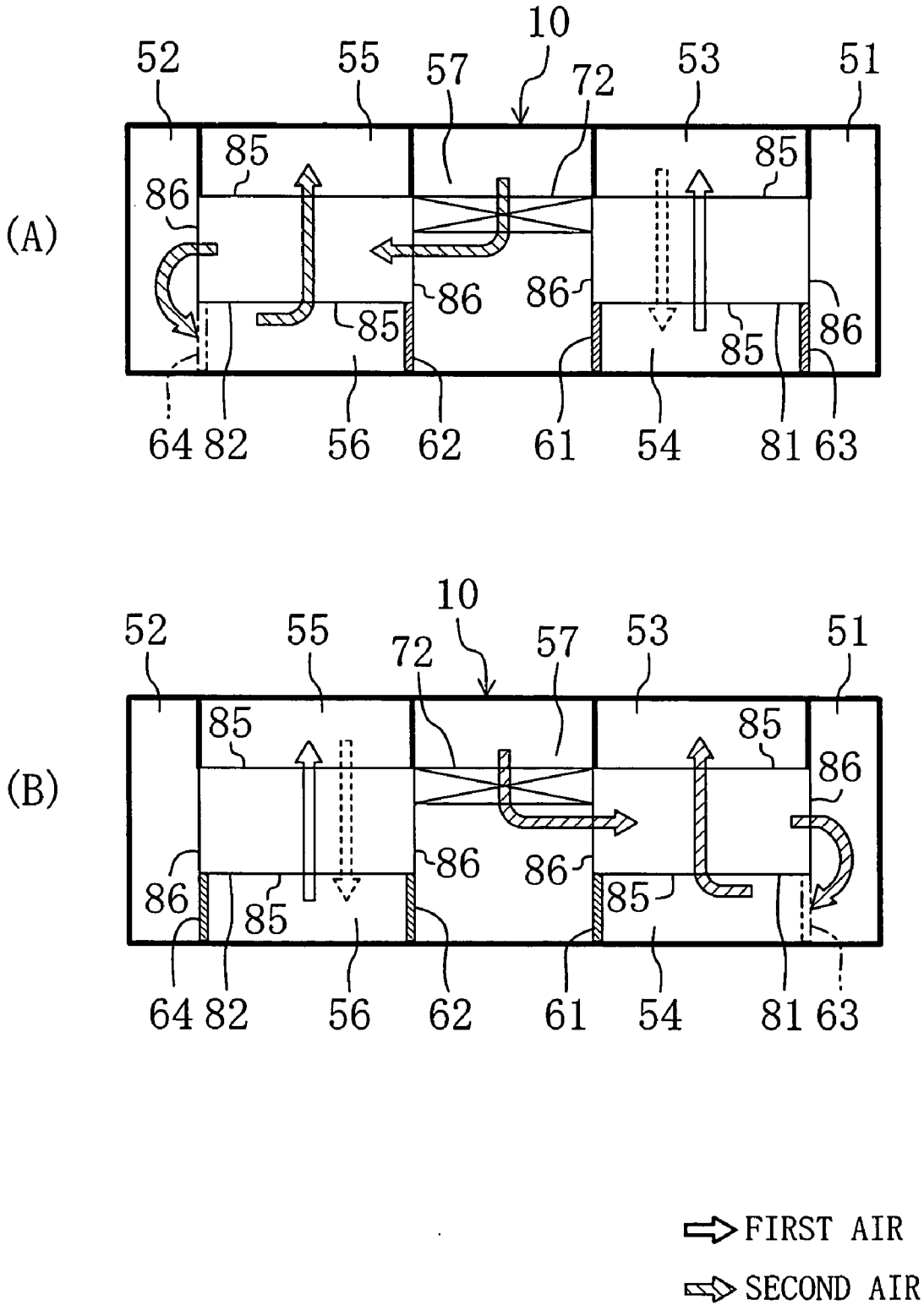

With reference first to FIG. 3, there is provided a brief explanation of the operation during the dehumidification operating mode.

FIG. 3(A) illustrates the flow of air streams in the first operation. FIG. 3(B) illustrates the flow of air streams in the second operation. In the first operation, a first air stream passes through the humidity control passageway (85) of the first adsorptive element (81) where the first air stream is dehumidified, after which the first air stream is supplied into the room. On the other hand, a second air stream is heated in the regeneration heat exchanger (72). Thereafter, the second air stream passes through the auxiliary passageway (86) of the second adsorptive element (82), thereby heating the second adsorptive element (82). Then, the second air stream passes through the humidity control passageway (85) of the second adsorptive element (82), thereby regenerating the second adsorptive element (82). On the other hand, in the second operation, a first air stream is dehumidified in the second adsorptive element (82) while a second air stream regenerates the first adsorptive element (81). More specifically, a first air stream is dehumidified as a result of releasing moisture to the adsorptive element (81, 82). Then, the dehumidified first air stream is supplied into the room. On the other hand, a second air stream regenerates the adsorptive element (81, 82) by absorbing moisture therefrom. The second air stream is then discharged to outside the room.

During the humidification operating mode, a second air stream, humidified as a result of absorbing moisture from the adsorptive element (81, 82), is supplied into the room. On the other hand, a first air stream releases moisture to the adsorptive element (81, 82). The first air stream is then discharged to outside the room.

Although FIGS. 3(A) and 3(B) show examples in which a first air stream and a second air stream flow through the humidity control passageway (85) of each of the adsorptive elements (81, 82) in the same direction, it may be arranged such that a first air stream and a second air stream flow through the humidity control passageway (85) in opposite directions, in other words a first and a second air stream flow countercurrently, as indicated by broken line. The configuration of a humidity control device of the countercurrent type will be described later in a third embodiment of the present invention.

Dehumidification Operating Mode

Figure 4:
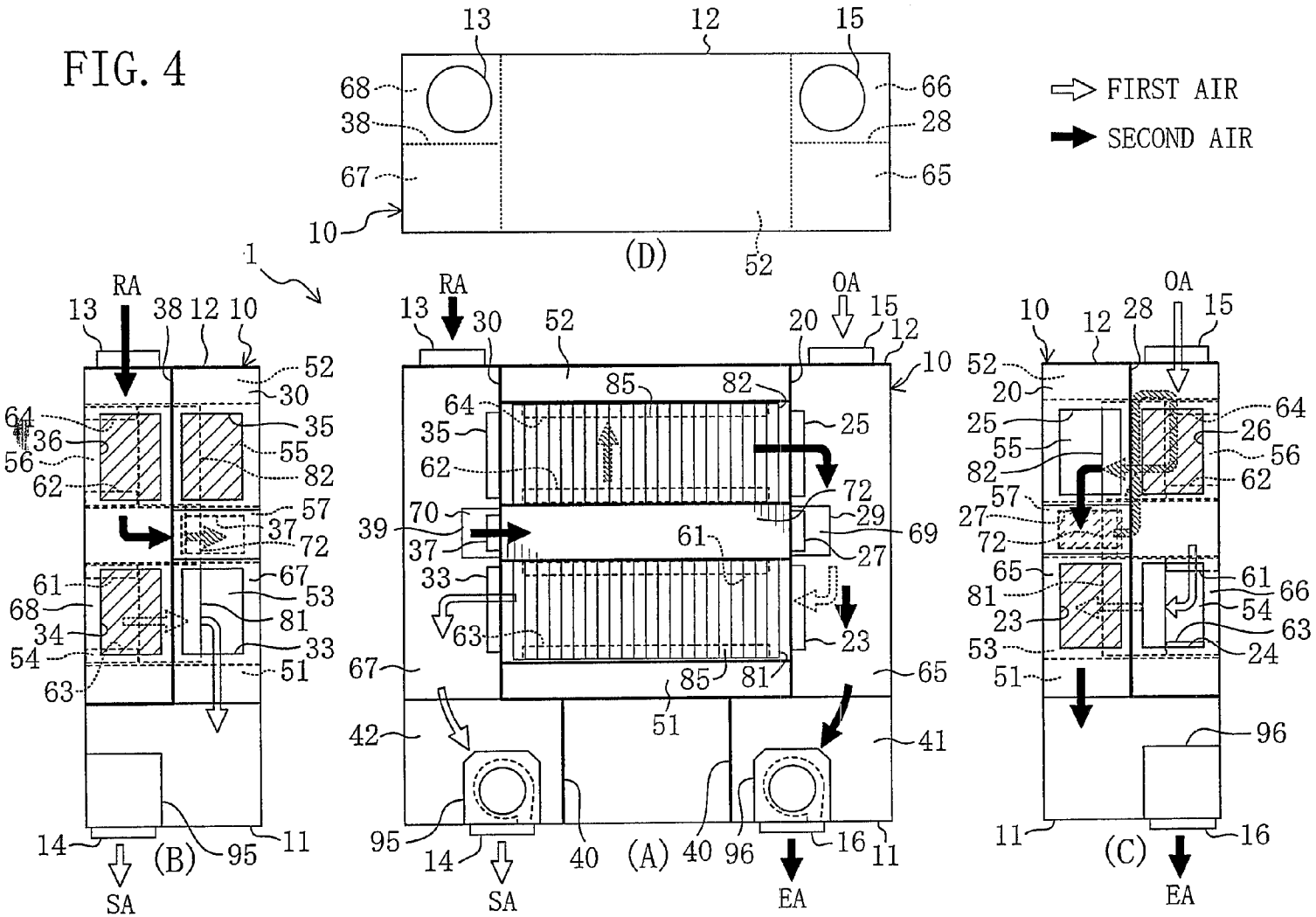
FIG. 4 is an explanatory diagram which illustrates the flow of air streams in a first operation of the dehumidification operating mode of the humidity control device of the first embodiment.
Figure 5:
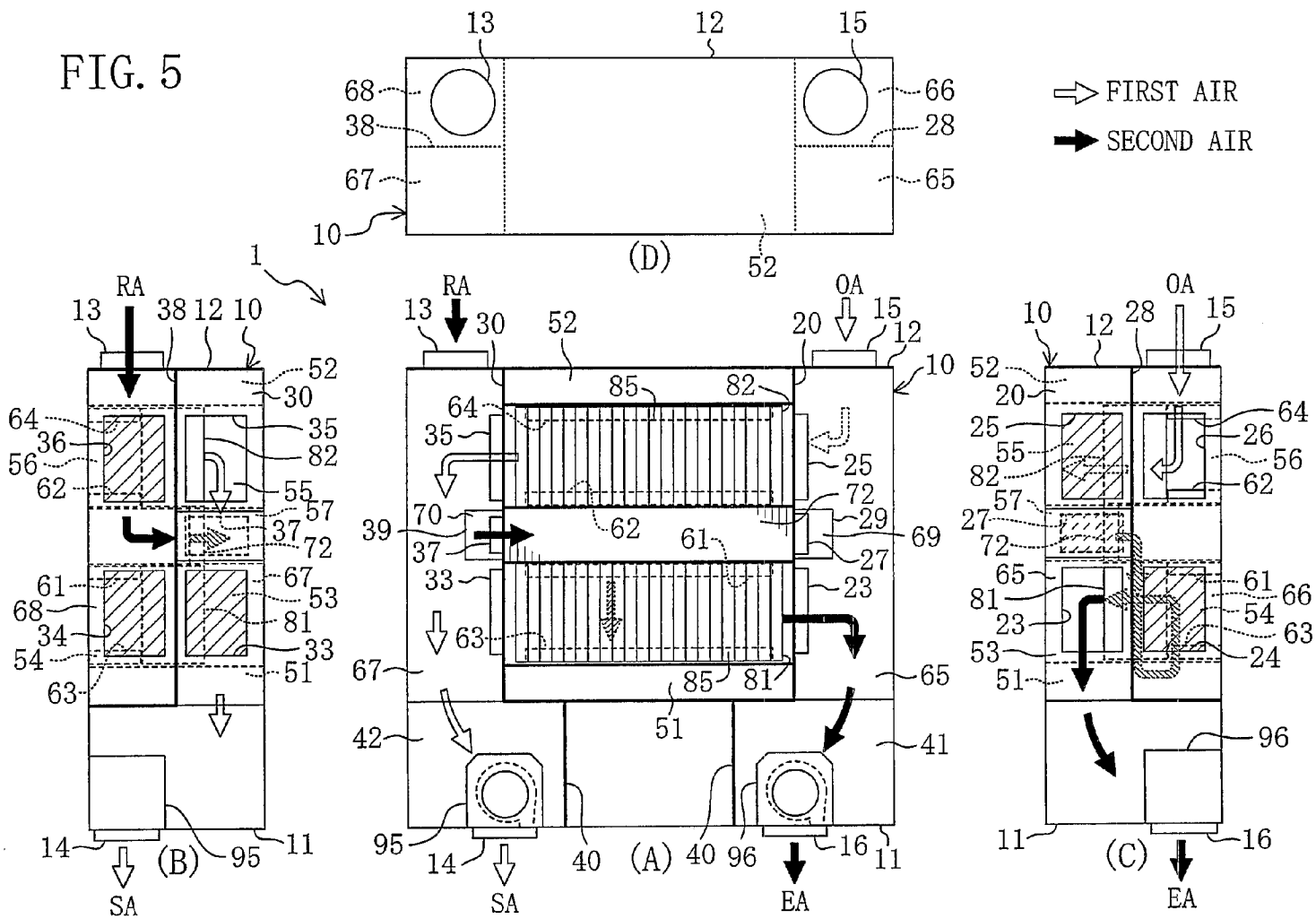
FIG. 5 is an explanatory diagram which illustrates the flow of air streams in a second operation of the dehumidification operating mode of the humidity control device of the first embodiment.

In the dehumidification operating mode, when the air supply fan (95) is activated, outside air (OA) as a first air stream is taken, through the outdoor side suction opening (15), into the lower right flow passage (66) within the casing (10), as shown in FIGS. 4 and 5. On the other hand, when the air discharge fan (96) is activated, room air (RA) as a second air stream is taken, through the indoor side suction opening (13), into the lower left flow passage (68) within the casing (10).

In addition, in the dehumidification operating mode, heated water flows through the regeneration heat exchanger (72), whereby the heat of the heated water is given to a stream of air flowing through the regeneration heat exchanger (72).

First Operation

As shown in FIG. 3(A) and FIG. 4, in a first operation, the process of adsorption occurs in the first adsorptive element (81) and the process of regeneration occurs in the second adsorptive element (82). In other words, in the first operation, air is dehumidified in the first adsorptive element (81) and the adsorbent of the second adsorptive element (82) is regenerated.

As shown in FIG. 4, in the right side partition plate (20), the first lower right opening (24) and the second upper right opening (25) enter the open state while the remaining other openings (23, 26, 27) are placed in the closed state. In this state, the first lower right opening (24) allows fluid communication between the lower right flow passage (66) and the first lower flow passage (54), and the second upper right opening (25) allows fluid communication between the second upper flow passage (55) and the upper right flow passage (65).

On the other hand, in the left side partition plate (30), the first upper left opening (33) and the third upper left opening (37) enter the open state while the remaining other openings (34, 35, 36) are placed in the closed state. In this state, the third upper left opening (37) allows fluid communication between the lower left flow passage (68) and the central flow passage (57) through the left side air introducing path (70) within the left side partition wall (39), and the first upper left opening (33) allows fluid communication between the first upper flow passage (53) and the upper left flow passage (67).

The inside first shutter (61), the inside second shutter (62), and the outside first shutter (63) enter the closed state while on the other hand the outside second shutter (64) is placed in the open state. This state allows fluid communication between the second flow passage (52) and the second lower flow passage (56) through the outside second shutter (64).

A first air stream, taken into the lower right flow passage (66), flows into the first lower flow passage (54) via the first lower right opening (24). As also shown in FIG. 3(A), after the entrance into the first lower flow passage (54), the first air stream flows into the humidity control passageway (85) of the first adsorptive element (81). During the flow through the humidity control passageway (85) of the first adsorptive element (81), water vapors contained in the first air stream are adsorbed on the adsorbent of the first adsorptive element (81). The first air stream, thus dehumidified in the first adsorptive element (81), flows into the first upper flow passage (53).

After the entrance into the first upper flow passage (53), the dehumidified first air stream flows into the upper left flow passage (67) via the first upper left opening (33). Thereafter, the first air stream flows into the air supply chamber (42). After the entrance into the air supply chamber (42), the first air stream is supplied into the room via the air supply opening (14) by the air supply fan (95).

Meanwhile, a second air stream, taken into the lower left flow passage (68), flows, through the left side air introducing path (70) within the left side partition wall (39) and then through the third upper left opening (37), into the central flow passage (57). The second air stream is heated while flowing downwardly through the regeneration heat exchanger (72). Thereafter, the second air stream is passed through the auxiliary passageway (86) of the second adsorptive element (82). After the passage through the auxiliary passageway (86) of the second adsorptive element (82), the second air stream flows into the second flow passage (52), passes through the opening of the outside second shutter (64), and flows into the second lower flow passage (56). The second air stream passes upwardly through the humidity control passageway (85) of the second adsorptive element (82). In the humidity control passageway (85), the adsorbent is heated by the second air stream and, as a result, water vapors are desorbed from the adsorbent. In other words, the adsorbent of the second adsorptive element (82) is regenerated. The water vapors desorbed from the adsorbent flow, together with the second air stream, into the second upper flow passage (55).

After the entrance into the second upper flow passage (55), the second air stream flows into the upper right flow passage (65) via the second upper right opening (25). Thereafter, the second air stream flows into the air discharge chamber (41). After the entrance into the air discharge chamber (41), the second air stream is discharged to outside the room via the air discharge opening (16) by the air discharge fan (96).

Second Operation

As shown in FIG. 3(B) and FIG. 5, contrary to the above-described first operation, in a second operation, the process of adsorption occurs in the second adsorptive element (82) and the process of regeneration occurs in the first adsorptive element (81). In other words, in the second operation, air is dehumidified in the second adsorptive element (82) and the adsorbent of the first adsorptive element (81) is regenerated.

As shown in FIG. 5, in the right side partition plate (20), the first upper right opening (23) and the second lower right opening (26) enter the open state while the remaining other openings (24, 25, 27) are placed in the closed state. In this state, the first upper right opening (23) allows fluid communication between the first upper flow passage (53) and the upper right flow passage (65), and the second lower right opening (26) allows fluid communication between the lower right flow passage (66) and the second lower flow passage (56).

In the left side partition plate (30), the second upper left opening (35) and the third upper left opening (37) enter the open state while the remaining other openings (33, 34, 36) are placed in the closed state. In this state, the third upper left opening (37) allows fluid communication between the lower left flow passage (68) and the central flow passage (57) through the left side air introducing path (70) within the left side partition wall (39), and the second upper left opening (35) allows fluid communication between the second upper flow passage (55) and the upper left flow passage (67).

The inside first shutter (61), the inside second shutter (62), and the outside second shutter (64) enter the closed state while on the other hand the outside first shutter (63) is placed in the open state. This state allows fluid communication between the first flow passage (51) and the first lower flow passage (54) through the outside first shutter (63).

A first air stream, taken into the lower right flow passage (66), flows into the second lower flow passage (56) via the second lower right opening (26). As also shown in FIG. 3(B), after the entrance into the second lower flow passage (56), the first air stream flows into the humidity control passageway (85) of the second adsorptive element (82). During the flow through the humidity control passageway (85), water vapors contained in the first air stream are adsorbed on the adsorbent of the second adsorptive element (82). The first air stream, thus dehumidified in the second adsorptive element (82), flows into the second upper flow passage (55).

After the entrance into the second upper flow passage (55), the dehumidified first air stream flows into the upper left flow passage (67) via the second upper left opening (35). Thereafter, the first air stream flows into the air supply chamber (42). After the entrance into the air supply chamber (42), the first air stream is supplied into the room via the air supply opening (14) by the air supply fan (95).

On the other hand, a second air stream, taken into the lower left flow passage (68), flows, through the left side air introducing path (70) within the left side partition wall (39) and then through the third upper left opening (37), into the central flow passage (57). The second air stream is heated while flowing downwardly through the regeneration heat exchanger (72). Thereafter, the second air stream is passed through the auxiliary passageway (86) of the first adsorptive element (81). After the passage through the auxiliary passageway (86) of the first adsorptive element (81), the second air stream flows into the first flow passage (51), passes through the opening of the outside first shutter (63), and flows into the first lower flow passage (54). The second air stream passes upwardly through the humidity control passageway (85) of the first adsorptive element (81). In the humidity control passageway (85), the adsorbent is heated by the second air stream and, as a result, water vapors are desorbed from the adsorbent. In other words, the adsorbent of the first adsorptive element (81) is regenerated. The water vapors desorbed from the adsorbent flow, together with the second air stream, into the first upper flow passage (53).

After the entrance into the first upper flow passage (53), the second air stream flows into the upper right flow passage (65) via the first upper right opening (23). Thereafter, the second air stream flows into the air discharge chamber (41). After the entrance into the air discharge chamber (41), the second air stream is discharged to outside the room via the air discharge opening (16) by the air discharge fan (96).

Humidification Operating Mode

Figure 6:
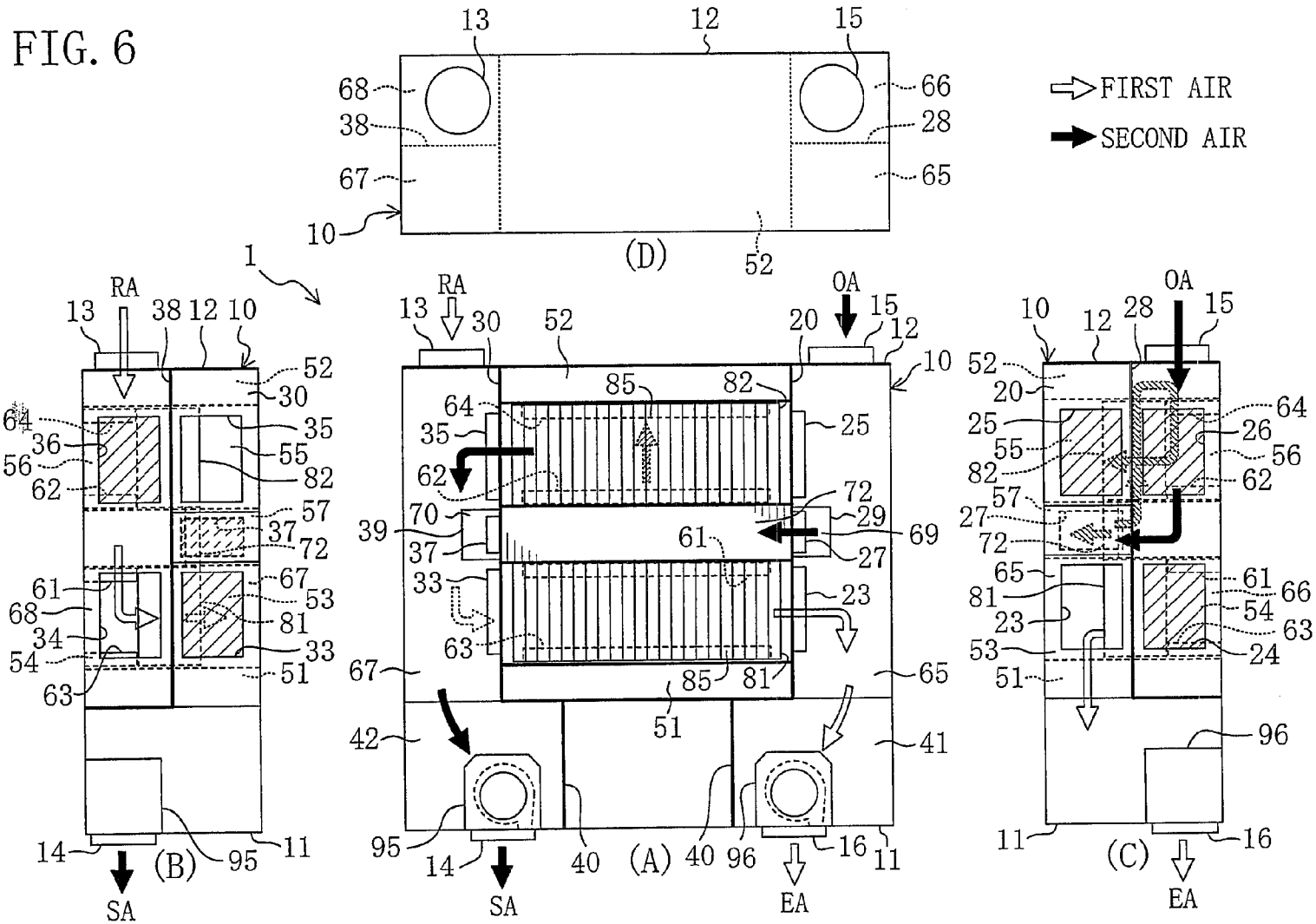
FIG. 6 is an explanatory diagram which illustrates the flow of air streams in a first operation of the humidification operating mode of the humidity control device of the first embodiment.
Figure 7:
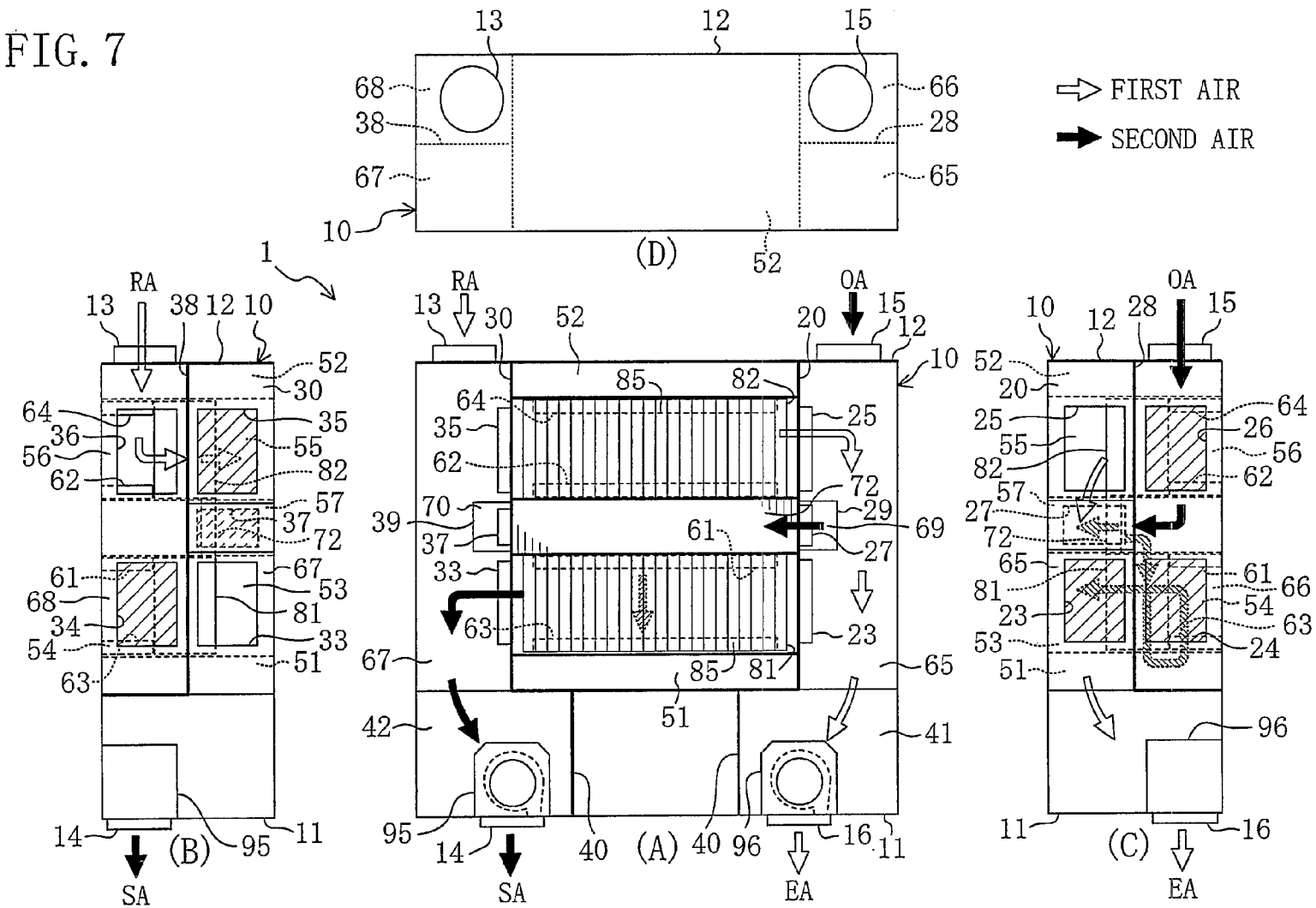
FIG. 7 is an explanatory diagram which illustrates the flow of air streams in a second operation of the humidification operating mode of the humidity control device of the first embodiment.

In the humidification operating mode, when the air supply fan (95) is activated, outside air (OA) as a second air stream is taken into the lower right flow passage (66) within the casing (10) through the outdoor side suction opening (15), as shown in FIGS. 6 and 7. On the other hand, when the air discharge fan (96) is activated, room air (RA) as a first air stream is taken into the lower left flow passage (68) within the casing (10) through the indoor side suction opening (13).

In addition, in the humidification operating mode, heated water flows through the regeneration heat exchanger (72), whereby the heat of the heated water is given to a stream of air flowing through the regeneration heat exchanger (72).

First Operation

As shown in FIG. 3(A) and FIG. 6, in a first operation, the process of adsorption occurs in the first adsorptive element (81) and the process of regeneration occurs in the second adsorptive element (82). In other words, in the first operation, air is humidified in the second adsorptive element (82) and water vapors are adsorbed on the adsorbent of the first adsorptive element (81).

As shown in FIG. 6, in the right side partition plate (20), the first upper right opening (23) and the third upper right opening (27) enter the open state while the remaining other openings (24, 25, 26) are placed in the closed state. In this state, the first upper right opening (23) allows fluid communication between the upper right flow passage (65) and the first upper flow passage (53), and the lower right flow passage (66) and the central flow passage (57) come into fluid communication with each other through the right side air introducing path (69) within the right side partition wall (29) and the third upper right opening (27).

On the other hand, in the left side partition plate (30), the first lower left opening (34) and the second upper left opening (35) enter the open state while the remaining other openings (33, 36, 37) are placed in the closed state. In this state, the first lower left opening (34) allows fluid communication between the lower left flow passage (68) and the first lower flow passage (54), and the second upper left opening (35) allows fluid communication between the second upper flow passage (55) and the upper left flow passage (67).

The inside first shutter (61), the inside second shutter (62), and the outside first shutter (63) enter the closed state while on the other hand the outside second shutter (64) is placed in the open state. This state allows fluid communication between the second flow passage (52) and the second lower flow passage (56) through the outside second shutter (64).

A first air stream, taken into the lower left flow passage (68), flows into the first lower flow passage (54) via the first lower left opening (34). As also shown in FIG. 3(A), after the entrance into the first lower flow passage (54), the first air stream flows into the humidity control passageway (85) of the first adsorptive element (81). During the flow through the humidity control passageway (85), water vapors contained in the first air stream are adsorbed on the adsorbent of the first adsorptive element (81). The first air stream thus dehumidified in the first adsorptive element (81) flows into the first upper flow passage (53).

After the entrance into the first upper flow passage (53), the first air stream flows into the upper right flow passage (65) via the first upper right opening (23). Thereafter, the first air stream flows into the air discharge chamber (41). After the entrance into the air discharge chamber (41), the first air stream is discharged to outside the room via the air discharge opening (16) by the air discharge fan (96).

On the other hand, a second air stream, taken into the lower right flow passage (66), flows, through the right side air introducing path (69) within the right side partition wall (29) and then through the third upper right opening (27), into the central flow passage (57). The second air stream is heated while flowing downwardly through the regeneration heat exchanger (72). Thereafter, the second air stream passes through the auxiliary passageway (86) of the second adsorptive element (82). After the passage through the auxiliary passageway (86) of the second adsorptive element (82), the second air stream flows into the second flow passage (52), passes through the opening of the outside second shutter (64), and flows into the second lower flow passage (56). The second air stream passes upwardly through the humidity control passageway (85) of the second adsorptive element (82). In the humidity control passageway (85), the adsorbent is heated by the second air stream and, as a result, water vapors are desorbed from the adsorbent. In other words, the adsorbent of the second adsorptive element (82) is regenerated. The water vapors desorbed from the adsorbent are given to the second air stream, as a result of which the second air stream is humidified. The second air stream thus humidified in the second adsorptive element (82) flows into the second upper flow passage (55).

After the entrance into the second upper flow passage (55), the humidified second air stream flows into the upper left flow passage (67) via the second upper left opening (35). Thereafter, the second air stream flows into the air supply chamber (42). After the entrance into the air supply chamber (42), the second air stream is supplied into the room via the air supply opening (14) by the air supply fan (95).

Second Operation

As shown in FIG. 3(B) and FIG. 7, contrary to the first operation, in a second operation, the process of adsorption takes place in the second adsorptive element (82) and the process of regeneration takes place in the first adsorptive element (81). In other words, in the second operation, air is humidified in the first adsorptive element (81) and water vapors are adsorbed on the adsorbent of the second adsorptive element (82).

As shown in FIG. 7, in the right side partition plate (20), the second upper right opening (25) and the third upper right opening (27) enter the open state while the remaining other openings (23, 24, 26) are placed in the closed state. In this state, the second upper right opening (25) allows fluid communication between the upper right flow passage (65) and the second upper flow passage (55), and the lower right flow passage (66) and the central flow passage (57) come into fluid communication with each other through the right side air introducing path (69) within the right side partition wall (29) and the third upper right opening (27).

On the other hand, in the left side partition plate (30), the first upper left opening (33) and the second lower left opening (36) enter the open state while the remaining other openings (34, 35, 37) are placed in the closed state. In this state, the second lower left opening (36) allows fluid communication between the lower left flow passage (68) and the second lower flow passage (56), and the first upper left opening (33) allows fluid communication between the first upper flow passage (53) and the upper left flow passage (67).

The inside first shutter (61), the inside second shutter (62), and the outside second shutter (64) enter the closed state while on the other hand the outside first shutter (63) is placed in the open state. This state allows fluid communication between the first flow passage (51) and the first lower flow passage (54) through the outside first shutter (63).

A first air stream, taken into the lower left flow passage (68), flows into the second lower flow passage (56) via the second lower left opening (36). As also shown in FIG. 3(B), after the entrance into the second lower flow passage (56), the first air stream flows into the humidity control passageway (85) of the second adsorptive element (82). During the flow through the humidity control passageway (85), water vapors contained in the first air stream are adsorbed on the adsorbent of the second adsorptive element (82). The first air stream thus dehumidified in the second adsorptive element (82) flows into the second upper flow passage (55).

After the entrance into the second upper flow passage (55), the first air stream flows into the upper right flow passage (65) via the second upper right opening (25). Thereafter, the first air stream flows into the air discharge chamber (41). After the entrance into the air discharge chamber (41), the first air stream is discharged to outside the room via the air discharge opening (16) by the air discharge fan (96).

On the other hand, a second air stream, taken into the lower right flow passage (66), flows, through the right side air introducing path (69) within the right side partition wall (29) and then through the third upper right opening (27), into the central flow passage (57). The second air stream is heated while flowing downwardly through the regeneration heat exchanger (72). Thereafter, the second air stream passes through the auxiliary passageway (86) of the first adsorptive element (81). After the passage through the auxiliary passageway (86) of the first adsorptive element (81), the second air stream flows into the first flow passage (51), passes through the opening of the outside first shutter (63), and flows into the first lower flow passage (54). The second air stream passes upwardly through the humidity control passageway (85) of the first adsorptive element (81). In the humidity control passageway (85), the adsorbent is heated by the second air stream and, as a result, water vapors are desorbed from the adsorbent. In other words, the adsorbent of the first adsorptive element (81) is regenerated. And, the water vapors desorbed from the adsorbent are given to the second air stream, as a result of which the second air stream is humidified. The second air stream thus humidified in the first adsorptive element (81) flows into the second upper flow passage (55).

After the entrance into the second upper flow passage (55), the second air stream flows into the upper left flow passage (67) via the first upper left opening (33). Thereafter, the second air stream flows into the air supply chamber (42). After the entrance into the air supply chamber (42), the second air stream is supplied into the room via the air supply opening (14) by the air supply fan (95).

In the first embodiment, as can clearly be seen from the description of the foregoing operations, the inside first and second shutters (61, 62) are constantly placed in the closed state. Therefore, the inside first and second shutters (61, 62) may be implemented by fixed partition plates as long as the above-described running operations are carried out in the first embodiment.

Effects of the First Embodiment

As described above, in accordance with the first embodiment, it is arranged such that each adsorptive element (81, 82) is provided with the auxiliary passageway (86) through which a heating fluid flows at the time of regeneration of the adsorptive element (81, 82). As a result of such arrangement, it becomes possible to provide heating and regeneration by preheating the adsorptive element (81, 82) with a heating fluid (i.e., a second air stream) flowing through the auxiliary passageway (86) at the time of regeneration of the adsorptive element (81, 82). Consequently, the adsorptive element (81, 82) is maintained at high temperature, thereby making it possible to increase the amount of release moisture (the amount of regeneration) more than is conventionally achieved. Accordingly, it becomes possible to increase the amount of adsorption the next time the adsorptive element (81, 82) adsorbs moisture in a first air stream, and the device performance is enhanced.

Especially, at the time of regeneration of the adsorptive element (81, 82), all of a second air stream of high temperature flows, as a heating fluid, through the auxiliary passageway (86), heats the adsorptive element (81, 82), and flows through the humidity control passageway (85), therefore assuring without fail that the adsorptive element (81, 82) is prevented from undergoing a temperature fall, and that a sufficient level of the amount of regeneration is maintained.

VARIATIONAL EXAMPLES OF THE FIRST EMBODIMENT

First Variational Example

A first variational example is a humidity control device having the same configuration as the humidity control device of the first embodiment. The first variational example is characterized in that the flow of air streams in the first operation and the flow of air streams in the second operation are changed. In the present variational example, the inside first shutter (61) and the inside second shutter (62) are placed in the open or closed state.

Figure 8:
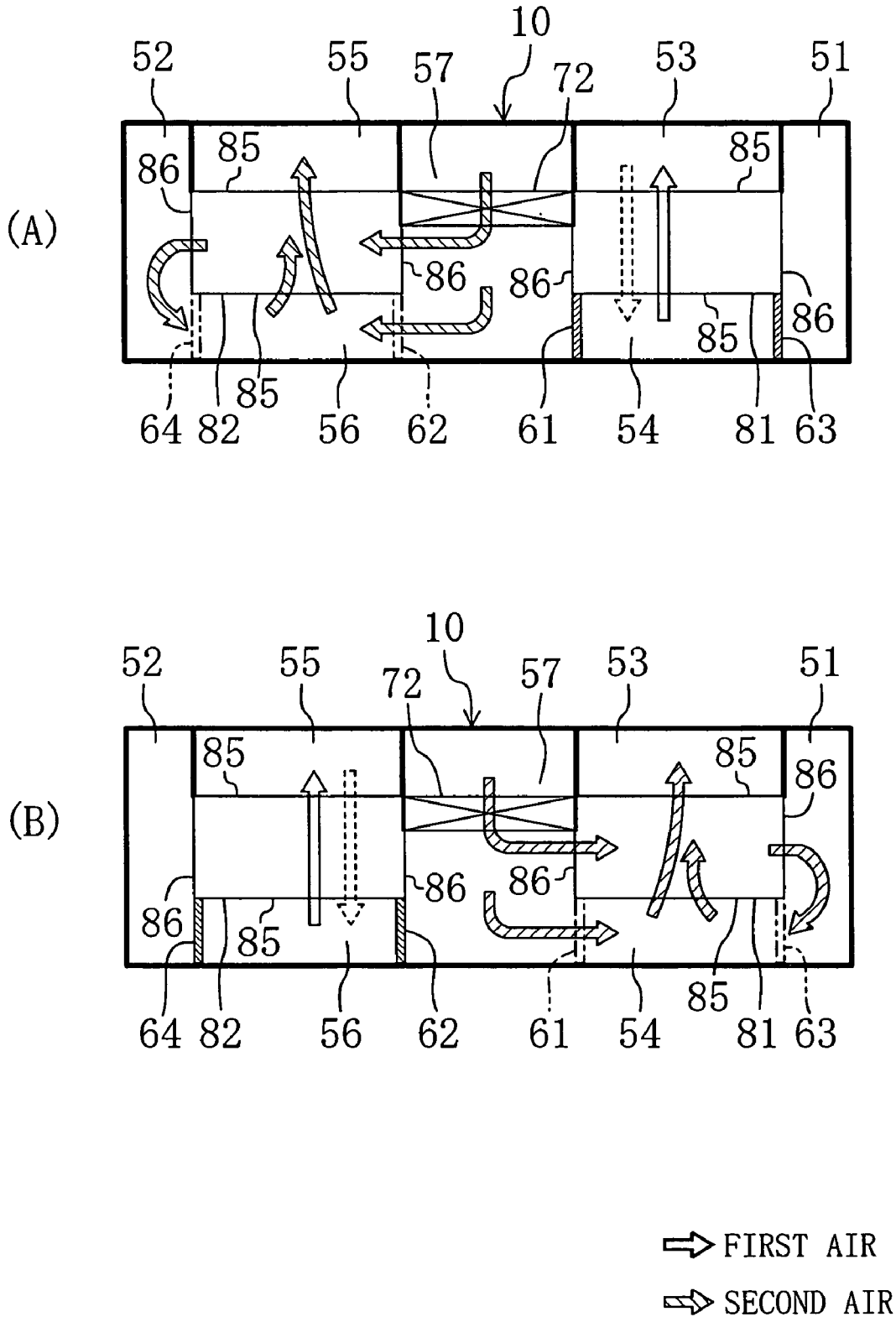

With reference to FIG. 8, operation during the dehumidification operating mode is briefly described.

FIG. 8(A) illustrates the flow of air streams in the first operation. FIG. 8(B) illustrates the flow of air streams in the second operation. In the first operation, a first air stream is dehumidified when passing through the humidity control passageway (85) of the first adsorptive element (81). The dehumidified first air stream is supplied into the room. On the other hand, a second air stream is heated in the regeneration heat exchanger (72). Then, the flow of the second air stream is divided into two branch flows. More specifically, a part of the second air stream passes through the auxiliary passageway (86) of the second adsorptive element (82) and heats the second adsorptive element (82). Thereafter, the part of the second air stream joins the rest of the second air stream. The merged second air stream flows through the humidity control passageway (85) of the second adsorptive element (82). As a result, the second adsorptive element (82) is regenerated. On the other hand, in the second operation, a first air stream is dehumidified in the second adsorptive element (82), and when the first adsorptive element (81) is regenerated by a second air stream, a part of the second air stream, after its passage through the auxiliary passageway (86), joins the rest of the second air stream. Then, the merged second air stream flows into the humidity control passageway (85). And, the first air stream, dehumidified as a result of releasing moisture to the adsorptive element (81, 82), is supplied into the room while on the other hand the second air stream, used to regenerate the adsorptive element (81, 82) by absorbing moisture therefrom, is discharged to outside the room.

In the examples of FIGS. 1-7, both the inside first shutter (61) and the inside second shutter (62) are constantly placed in the closed state. Unlike these examples, when performing the operation of FIG. 8 in the present variational example, the inside first shutter (61) is placed in the open state at the same time the outside first shutter (63) is placed in the open state, and the inside second shutter (62) is placed in the open state at the same time the outside second shutter (64) is placed in the open state. As a result of such arrangement, a part of an air stream after the passage through the regeneration heat exchanger (72) passes through the auxiliary passageway (86) of the adsorptive element (81, 82) and joins the rest of the air stream. Thereafter, the merged air stream flows into the humidity control passageway (85).

During the humidification operating mode, a second air stream is humidified as a result of absorbing moisture from the adsorptive element (81, 82). Then, the second air stream is supplied into the room. On the other hand, a first air stream releases moisture to the adsorptive element (81, 82). Then, the first air stream is discharged to outside the room.

In addition, also in the example of FIG. 8, a first air stream and a second air stream flow through the humidity control passageway (85) of each adsorptive element (81, 82) in the same direction. Alternatively, it may be arranged such that a first air stream and a second air stream flow through the humidity control passageway (85) in opposite directions, as indicated by broken line.

In the first variational example, at the time of regeneration of the adsorptive element (81, 82), a part of a second air stream prior to its passage through the humidity control passageway (85) enters, as a heating fluid, the auxiliary passageway (86). A second air stream is a high-temperature air stream which is used to regenerate the adsorptive element (81, 82). A part of the second air stream flows through the auxiliary passageway (86) and joins the rest of the second air stream while heating the adsorptive element (81, 82). Then, the merged second air stream flows through the humidity control passageway (85), thereby preventing the adsorptive element (81, 82) from undergoing a temperature fall during regeneration. Hereby, it becomes possible to assure that a sufficient level of the amount of regeneration is maintained, and that the amount of adsorption is also prevented from decreasing.

Second Variational Example

Figure 9:
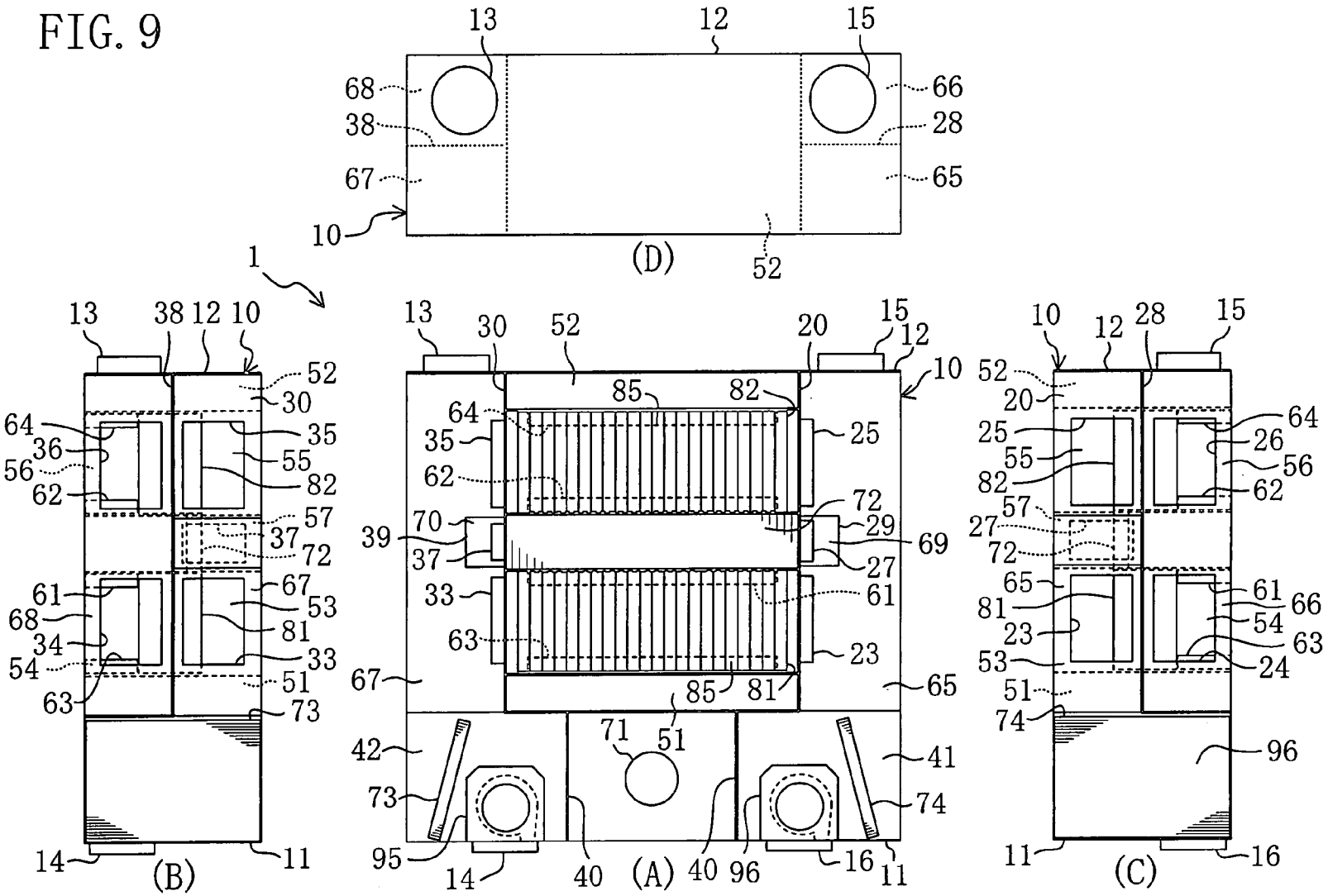

As shown in FIG. 9, a second variational example is an example of the humidity control device of the first embodiment with the addition of a refrigerant circuit.

The refrigerant circuit is provided with, in addition to the regeneration heat exchanger (72), a first heat exchanger (73), a second heat exchanger (74), a compressor (71), and an expansion valve (not shown), In the refrigerant circuit charged with a refrigerant, the refrigerant is circulated, thereby to perform a refrigeration cycle. Additionally, the refrigerant circuit is configured, such that its operation selectively switches between the operation in which the first heat exchanger (73) operates as an evaporator and the operation in which the second heat exchanger (74) operates as an evaporator.

In the present variational example, the regeneration heat exchanger (72) is not a heat exchanger through which heated water flows but a heat exchanger through which refrigerant flows, and a stream of air flowing through the central flow passage (57) is heated by heat exchange with the refrigerant of the refrigerant circuit.

In addition, the compressor (71) is disposed in a space defined between the air discharge chamber (41) and the air supply chamber (42).

In addition to the air discharge fan (96), the second heat exchanger (74) is disposed in the air discharge chamber (41). During the humidification operating mode, the refrigerant is distributed through the second heat exchanger (74), wherein a process-air stream flowing in the direction of the air discharge fan (96) is cooled by being subjected to heat exchange with the refrigerant of the refrigerant circuit. On the other hand, during the dehumidification operating mode, the second heat exchanger (74) is stopped, in other word the second heat exchanger (74) neither heats nor cools process air.

In addition to the air supply fan (95), the first heat exchanger (73) is disposed in the air supply chamber (42). During the dehumidification operating mode, the refrigerant is distributed through the first heat exchanger (73), wherein a process-air stream flowing in the direction of the air supply fan (95) is cooled by being subjected heat exchange with the refrigerant of the refrigerant circuit. On the other hand, during the humidification operating mode, the first heat exchanger (73) is stopped, in other words the first heat exchanger (73) neither heats nor cools process air.

In the second variational example, during the dehumidification operating mode, outside air (OA) introduced into the casing (10) via the outdoor side suction opening (15) is dehumidified in the adsorptive element (81, 82) when flowing in the casing (10) as illustrated in FIGS. 4 and 5. Then, the first air stream enters the air supply chamber (42). After the entrance into the air supply chamber (42), the first air stream is cooled as a result of heat exchange with the refrigerant in the first heat exchanger (73). Thereafter, the first air stream is supplied into the room via the air supply opening (14) by the air supply fan (95).

On the other hand, room air (RA) introduced into the casing (10) via the indoor side suction opening (13) regenerates the adsorptive element (81, 82) when flowing in the casing (10) as illustrated in FIGS. 4 and 5. Then, the second air stream enters the air discharge chamber (41). After the entrance into the air discharge chamber (41), the second air stream passes through the second heat exchanger (74), and is discharged to outside the room via the air discharge opening (16) by the air discharge fan (96). At that time, the second heat exchanger (74) is stopped, so that the second air stream is neither heated nor cooled.

In addition, during the humidification operating mode, outdoor air (OA) introduced into the casing (10) via the outdoor side suction opening (15) is humidified in the adsorptive element (81, 82) when flowing in the casing (10) as illustrated in FIGS. 6 and 7. Then, the second air stream enters the air supply chamber (42). After the entrance into the air supply chamber (42), the second air stream passes through the first heat exchanger (73), and is supplied into the room via the air supply opening (14) by the air supply fan (95).

On the other hand, room air (OA) introduced into the casing (10) via the indoor side suction opening (13) is dehumidified in the adsorptive element (81, 82) when flowing in the casing (10) as indicated in FIGS. 6 and 7, and then flows into the air discharge chamber (41). After the entrance into the air discharge chamber (41), the first air stream is cooled as a result of heat exchange with the refrigerant in the second heat exchanger (74). Then, the first air stream is discharged to outside the room via the air discharge opening (16) by the air discharge fan (96).

Also in the second variational example, during regeneration of the adsorptive element (81, 82), the adsorptive element (81, 82) is heated by a heating fluid (i.e., a second air stream) flowing through the auxiliary passageway (86). Consequently, the adsorptive element (81, 82) is maintained at high temperature, thereby making it possible to increase the amount of release moisture (the amount of regeneration) more than is conventionally achieved. Accordingly, it becomes possible to increase also the amount of adsorption the next time the adsorptive element (81, 82) adsorbs moisture in a first air stream, and the device performance is enhanced.

In addition, it may be arranged such that, at the time of regeneration of the adsorptive element (81, 82), all of a second air stream of high temperature for regeneration of the adsorptive element (81, 82) flows, as a heating fluid, through the auxiliary passageway (86), heats the adsorptive element (81, 82), and flows through the humidity control passageway (85), as in the first embodiment of FIG. 3. Alternatively, it may be arranged such that a part of a second air stream prior to its passage through the humidity control passageway (85) flows, as a heating fluid, through the auxiliary passageway (86), heats the adsorptive element (81, 82), joins the rest of the second air stream, and flows through the humidity control passageway (85), as in the first variational example of FIG. 8. These arrangements assure that the adsorptive element (81, 82) is prevented from undergoing a temperature fall during regeneration, and that a sufficient level of the amount of regeneration is maintained.

Third Variational Example

Figure 10:
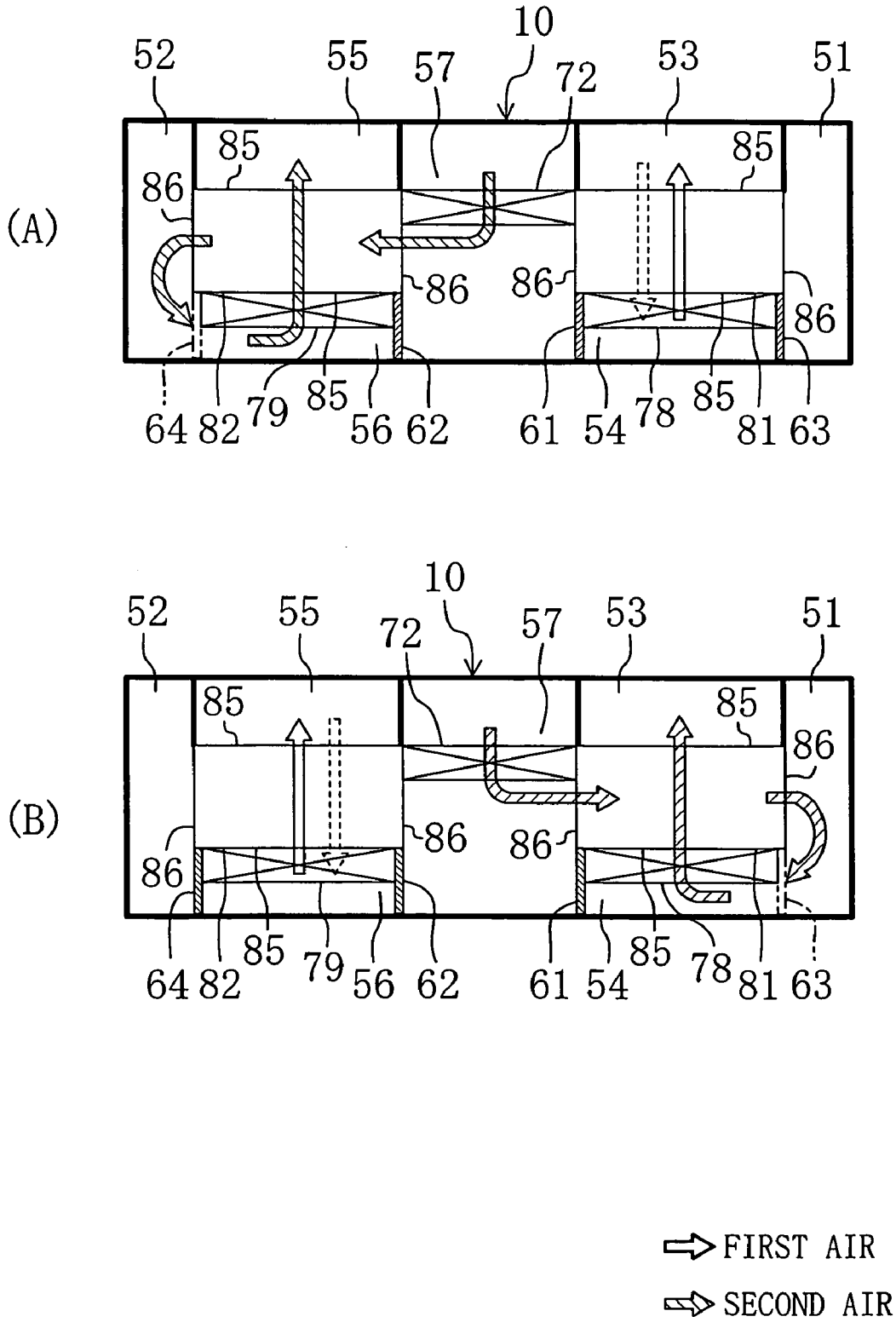

A third variational example is an example of the humidity control device of the first embodiment in which, as shown in FIGS. 10(A) and 10(B), an auxiliary heater (78, 79) is disposed along the lower surface of each adsorptive element. Of the auxiliary heaters (78, 79), only the regenerative side one is turned on to heat a second air stream. The auxiliary heater (78, 79) may be implemented by a hot-water heat exchanger or an electric heater, or by a heating-heat exchanger of the refrigerant circuit.

As a result of such arrangement, all of a second air stream heated in the regeneration heat exchanger (72) flows, as a heating fluid, into one of the adsorptive elements (81, 82) and heats the one adsorptive element (81, 82). Thereafter, the second air stream is heated again in the auxiliary heater (78, 79), and flows through the humidity control passageway (85). This prevents the adsorptive element (81, 82) from undergoing a temperature fall during regeneration, thereby assuring that a sufficient level of the amount of regeneration is maintained.

Fourth Variational Example

Figure 11:
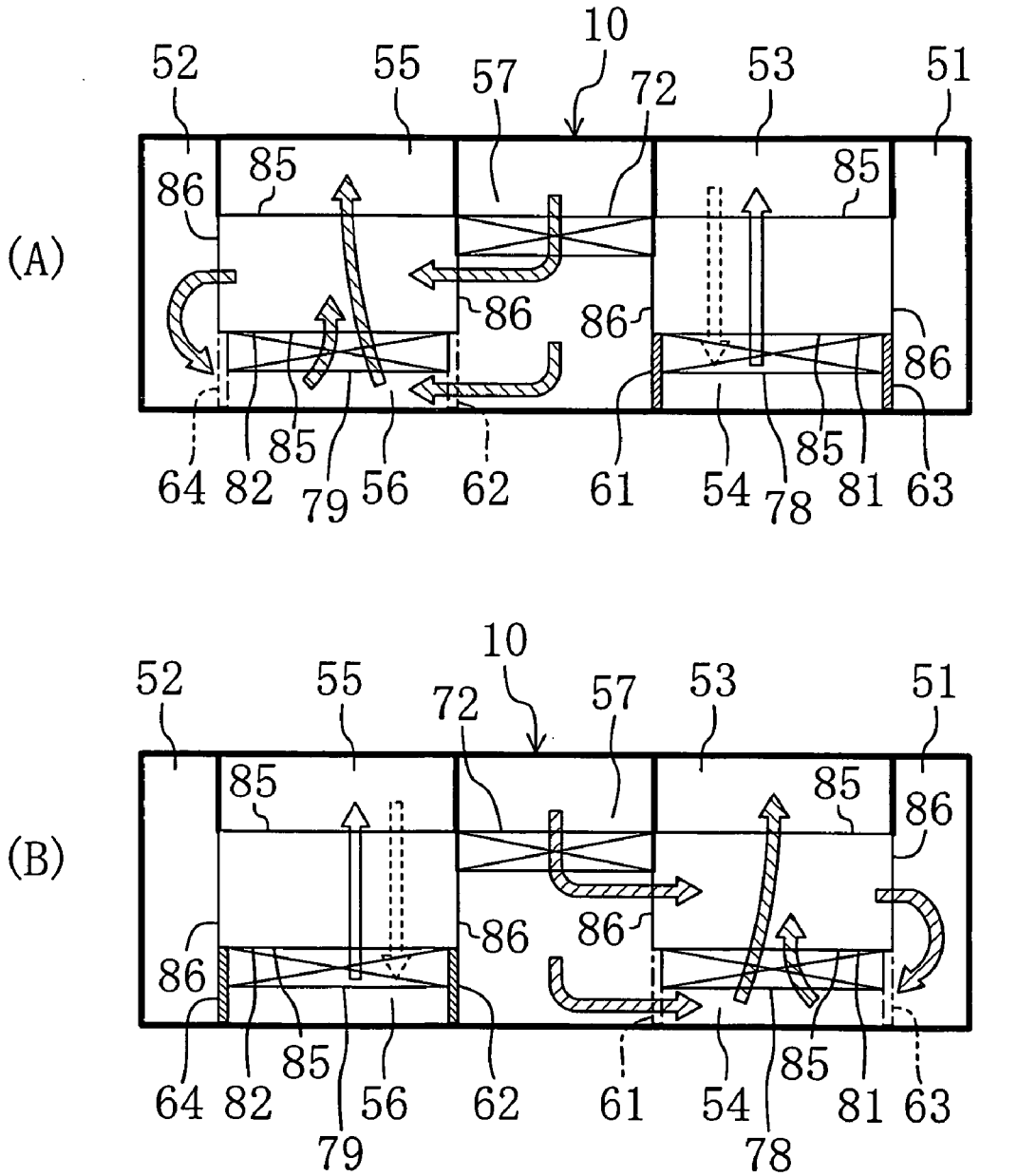

Additionally, it may be arranged such that, in the humidity control device of the first variational example, the auxiliary heater (78, 79) is disposed along the lower surface of the adsorptive element (81, 82), as shown in FIGS. 11(A) and 11(B).

As a result of such arrangement, a part of a second air stream heated in the regeneration heat exchanger (72) is flows, as a heating fluid, into the auxiliary passageway (86) of one of the adsorptive elements (81, 82), joins the rest of the second air stream, is heated in the auxiliary heater (78, 79), and flows into the humidity control passageway (85) of the adsorptive element (81, 82). This also prevents the adsorptive element (81, 82) from undergoing a temperature fall during regeneration, thereby assuring that a sufficient level of the amount of regeneration is maintained.

SECOND EMBODIMENT OF THE INVENTION

Configuration of Humidity Control Device

Figure 12:
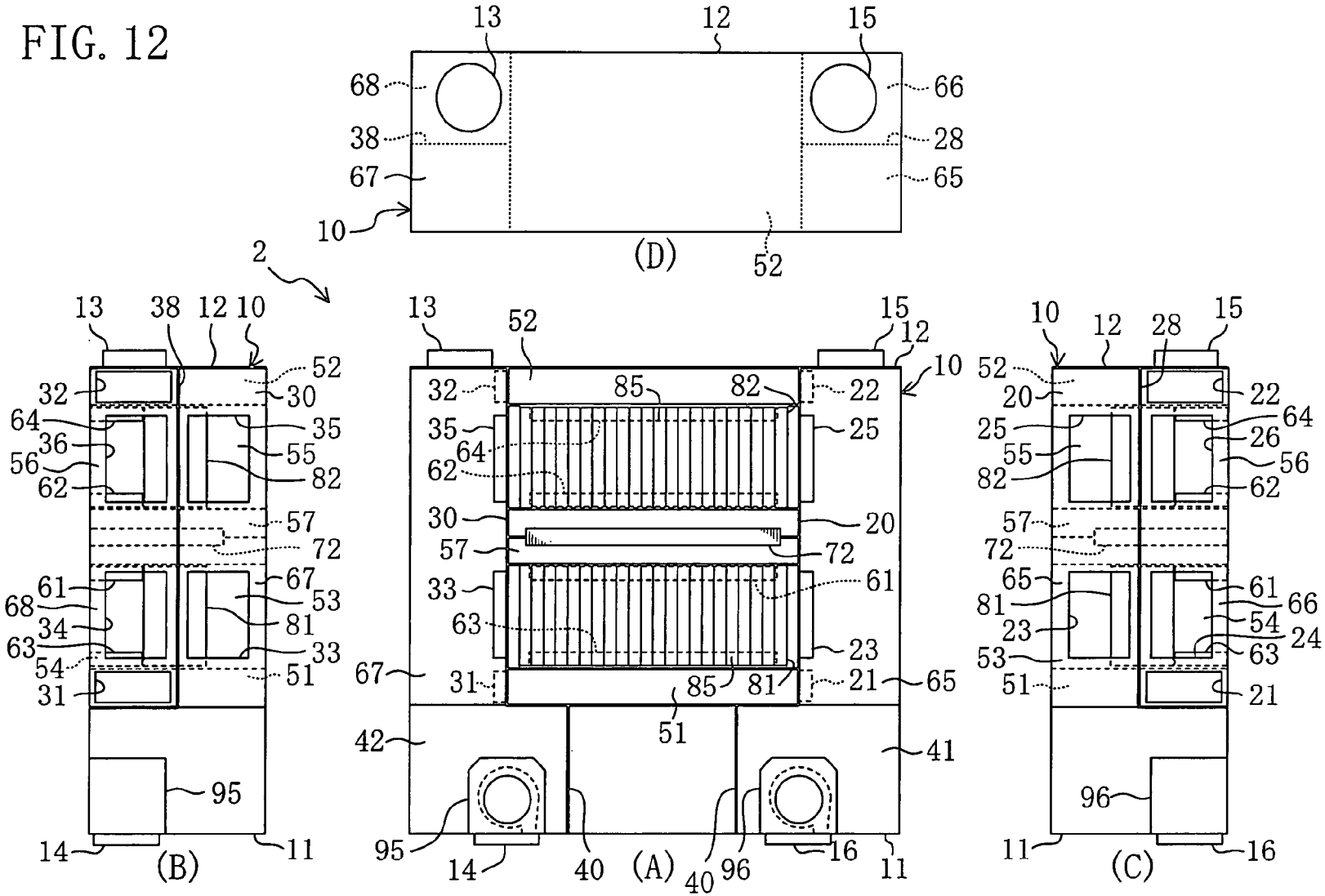

With reference to FIG. 12, there is shown a humidity control device (2) of a second embodiment of the present invention. The second embodiment is a modification of the first embodiment with changes in the configuration of the air passageways and changes in the layout of some devices. More specifically, the location of the openings (21-26, 31-36) of the right and left side partition plates (20, 30) is changed, and the resulting air passageways differ from the air passageways in the first embodiment and the location of the regeneration heat exchanger (72) is also changed.

Hereinafter, the difference between the first embodiment and the second embodiment is described.

Unlike the first embodiment, the regeneration heat exchanger (72) of the second embodiment is disposed, not in a horizontal position but in substantially an upright position, in the central flow passage (57) formed between the first adsorptive element (81) and the second adsorptive element (82). The regeneration heat exchanger (72) is configured, such that an air stream flowing through the central flow passage (57) is heated as a result of heat exchange with heated water.

Formed in the right side partition plate (20) are a first right side opening (21), a second right side opening (22), a first upper right opening (23), a first lower right opening (24), a second upper right opening (25), and a second lower right opening (26). Each of these openings (21, 22, . . . ) is provided with a respective opening/closing shutter and is configured, such that it can freely be placed in the open or closed state. The third upper right opening (27) of the first embodiment is not provided.

The right side opening (21) is positioned at a front-side lower part of the right side partition plate (20). When the opening/closing shutter of the first right side opening (21) is placed in the open state, the first flow passage (51) and the lower right flow passage (66) come into fluid communication with each other. The second right side opening (22) is positioned at a back-side lower part of the right side partition plate (20). When the opening/closing shutter of the second right side opening (22) is placed in the open state, the second flow passage (52) and the lower right flow passage (66) come into fluid communication with each other. The first upper right opening (23), the first lower right opening (24), the second upper right opening (25), and the second lower right opening (26) are formed in the same way that their counterparts of the first embodiment are formed.

Formed in the left side partition plate (30) are a first left side opening (31), a second left side opening (32), a first upper left opening (33), a first lower left opening (34), a second upper left opening (35), and a second lower left opening (36). Each of these openings (31, 32, . . . ) is provided with a respective opening/closing shutter and is configured, such that it can freely be placed in the open or closed state. The third upper left opening (37) of the first embodiment is not provided.

The first left side opening (31) is positioned at a front-side lower part of the left side partition plate (30). When the opening/closing shutter of the first left side opening (31) is placed in the open state, the first flow passage (51) and the lower left flow passage (68) come into fluid communication with each other. The second left side opening (32) is positioned at a back-side lower part of the left side partition plate (30). When the opening/closing shutter of the second left side opening (32) is placed in the open state, the second flow passage (52) and the lower left flow passage (68) come into fluid communication with each other. The first upper left opening (33), the first lower left opening (34), the second upper left opening (35), and the second lower left opening (36) are formed in the same way that their counterparts of the first embodiment are formed.

Other portions that are assigned the same reference numerals as those already described in the first embodiment are formed in the same way as in the first embodiment. Accordingly, the configuration of the present humidity control device is not described here.

Running Operation

Next, the running operation of the above-described humidity control device (2) is described. The humidity control device (2) takes in a first air stream which is a first process-air stream and a second air stream which is a second process-air stream and its operation selectively switches between a dehumidification operating mode and a humidification operating mode. In addition, the humidity control device (2) alternately performs a first operation and a second operation, thereby to continuously provide dehumidification or humidification.

Figure 13:
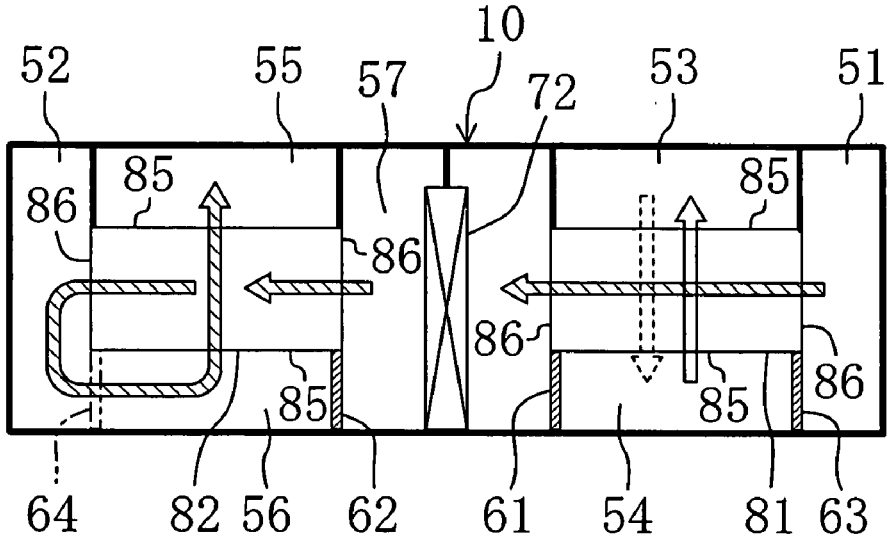
FIG. 13 is an explanatory diagram which conceptually illustrates the running operation of the humidity control device according to the second embodiment, wherein FIG.
Figure 13:
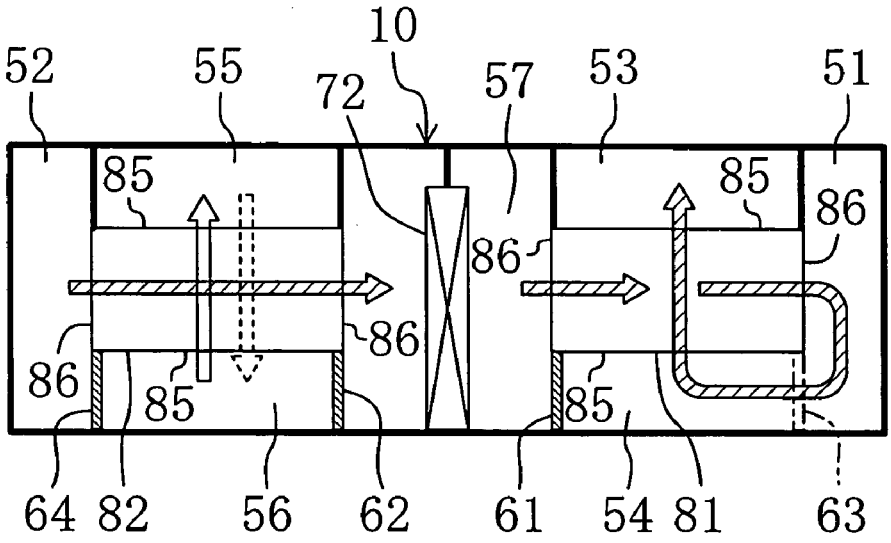

In the first place, with reference to FIG. 13, operation during the dehumidification operating mode is described briefly.

FIG. 13(A) illustrates the flow of air streams in the first operation. FIG. 13(B) illustrates the flow of air streams in the second operation. In the first operation, a first air stream passes through the humidity control passageway (85) of the first adsorptive element (81) where the first air stream is dehumidified, after which the first air stream is supplied into the room. On the other hand, during the passage through the auxiliary passageway (86) of the first adsorptive element (81), a second air stream absorbs heat of adsorption of the first air stream. Thereafter, the second air stream is heated in the regeneration heat exchanger (72). Then, the second air stream passes through the auxiliary passageway (86) of the second adsorptive element (82) and heats the second adsorptive element (82). Thereafter, the second air stream passes through the humidity control passageway (85) of the second adsorptive element (82) and regenerates the second adsorptive element (82). In the second operation, a first air stream is dehumidified in the second adsorptive element (82) and the first adsorptive element (81) is regenerated by a second air stream. And, the first air stream, dehumidified as a result of releasing moisture to the adsorptive element (81, 82), is supplied into the room while on the other hand the second air stream, used to regenerate the adsorptive element (81, 82) by absorbing moisture therefrom, is discharged to outside the room.

During the humidification operating mode, a second air stream, humidified as a result of absorbing moisture from the adsorptive element (81, 82), is supplied into the room while on the other hand a first air stream releases moisture to the adsorptive element (81, 82), and is discharged to outside the room.

Although FIGS. 13(A) and 13(B) show examples in which the first and second air streams flow through the humidity control passageway (85) of each adsorptive element (81, 82) in the same direction, it may be arranged such the first and second air streams flow through the humidity control passageway (85) in opposite directions, in other words the first and second air streams flow countercurrently.

Dehumidification Operating Mode

Figure 14:
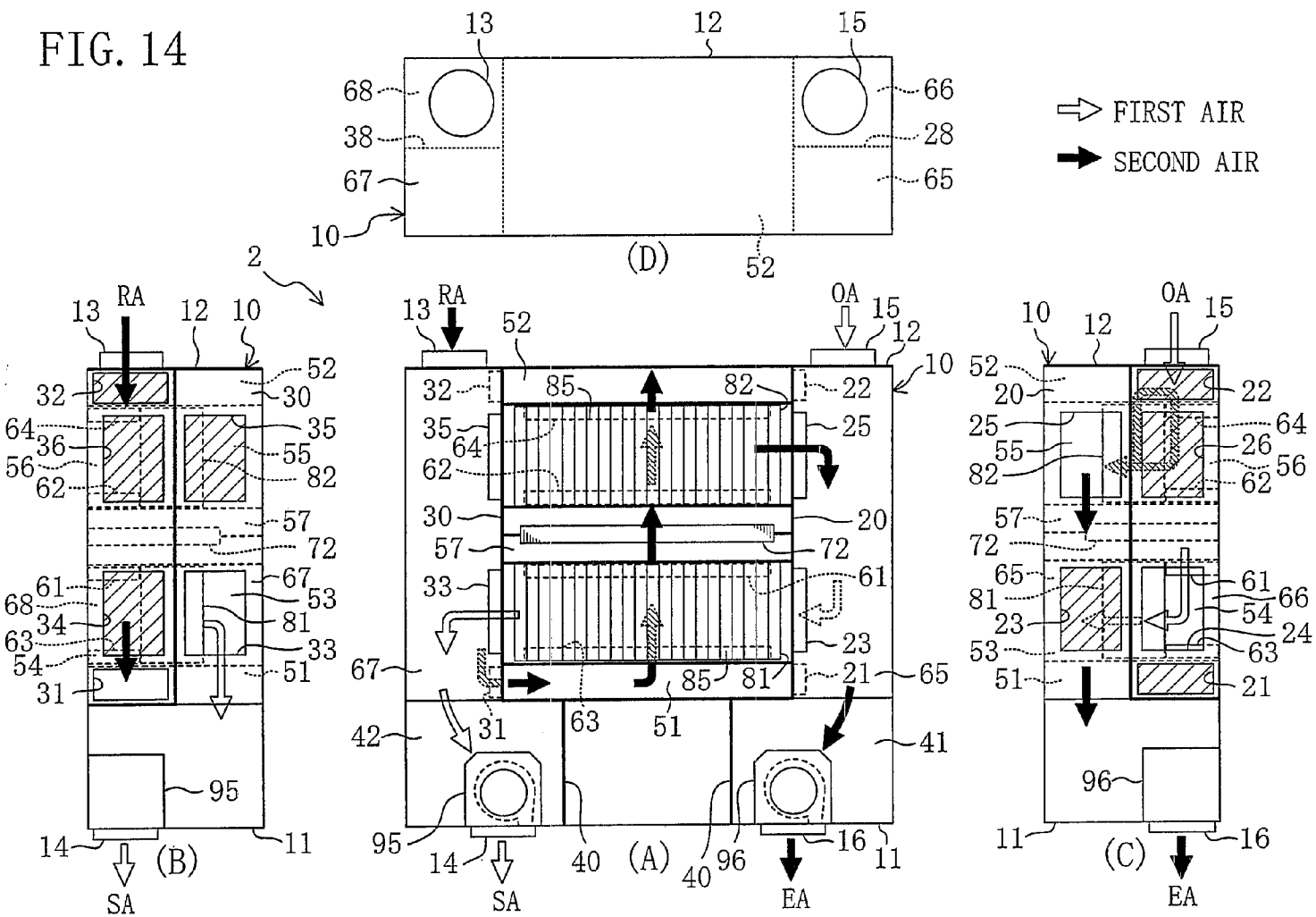
FIG. 14 is an explanatory diagram which illustrates the flow of air streams in a first operation of the dehumidification operating mode of the humidity control device of the second embodiment.
Figure 15:
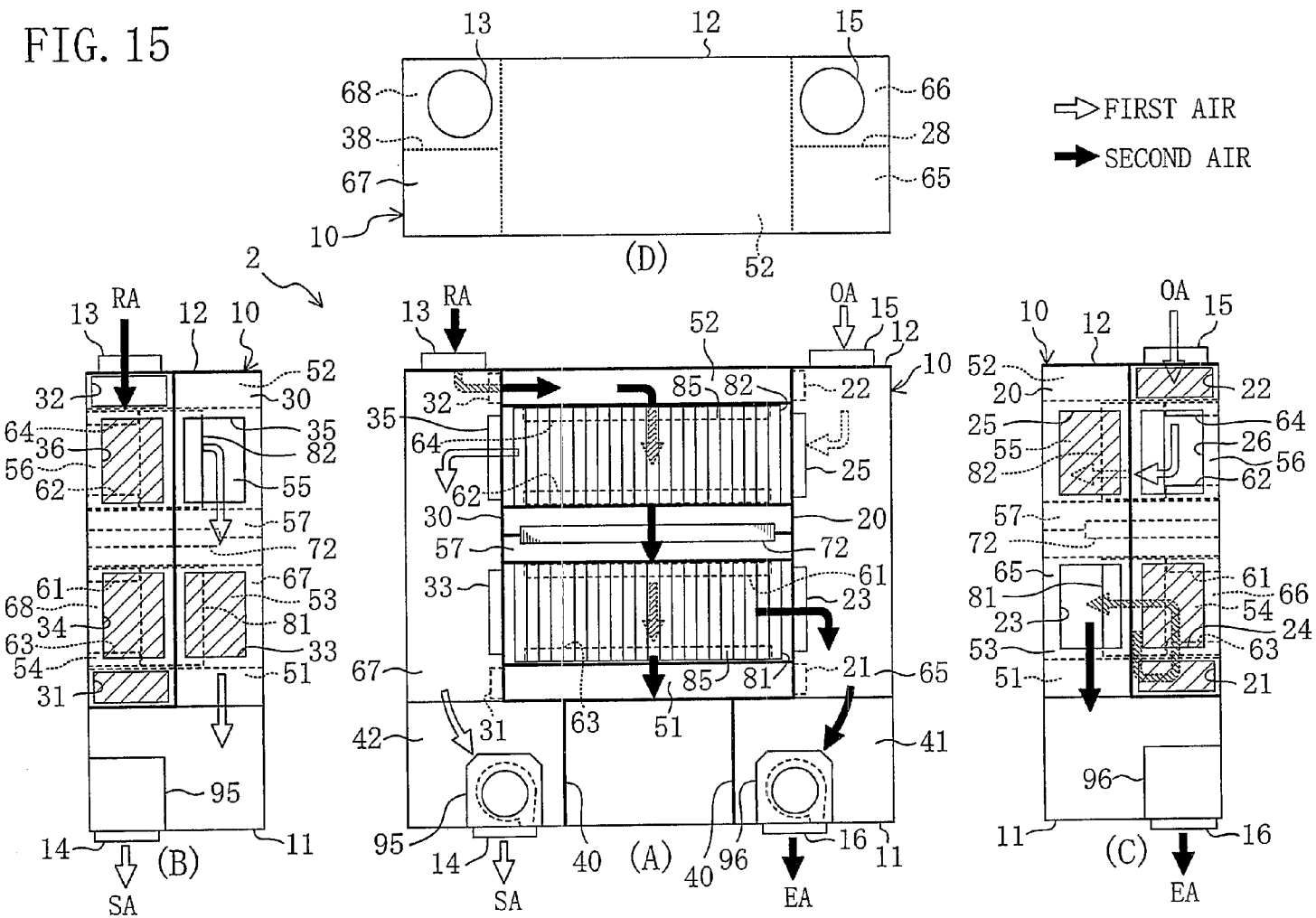
FIG. 15 is an explanatory diagram which illustrates the flow of air streams in a second operation of the dehumidification operating mode of the humidity control device of the second embodiment.

In the dehumidification operating mode, when the air supply fan (95) is activated, outside air (OA) as a first air stream is taken, through the outdoor side suction opening (15), into the lower right flow passage (66) within the casing (10), as shown in FIGS. 14 and 15. On the other hand, when the air discharge fan (96) is activated, room air (RA) as a second air stream is taken, through the indoor side suction opening (13), into the lower left flow passage (68) within the casing (10).

In addition, in the dehumidification operating mode, heated water flows through the regeneration heat exchanger (72), whereby the heat of the heated water is given to an air stream flowing through the regeneration heat exchanger (72).

First Operation

As shown in FIG. 13(A) and FIG. 14, in a first operation of the dehumidification operating mode, the process of adsorption takes place in the first adsorptive element (81) and the process of regeneration takes place in the second adsorptive element (82). In other words, in the first operation, air is dehumidified in the first adsorptive element (81) and the adsorbent of the second adsorptive element (82) is regenerated.

As shown in FIG. 14, in the right side partition plate (20), the first lower right opening (24) and the second upper right opening (25) enter the open state while the remaining other openings (21, 22, 23, 26) are placed in the closed state. In this state, the first lower right opening (24) allows fluid communication between the lower right flow passage (66) and the first lower flow passage (54), and the second upper right opening (25) allows fluid communication between the second upper flow passage (55) and the upper right flow passage (65).

On the other hand, in the left side partition plate (30), the first left side opening (31) and the first upper left opening (33) enter the open state while the remaining other openings (32, 34, 35, 36) are placed in the closed state. In this state, the first left side opening (31) allows fluid communication between the lower left flow passage (68) and the first flow passage (51), and the first upper left opening (33) allows fluid communication between the first upper flow passage (53) and the upper left flow passage (67).

The inside first shutter (61), the inside second shutter (62), and the outside first shutter (63) enter the closed state while on the other hand the outside second shutter (64) is placed in the open state. This state allows fluid communication between the second flow passage (52) and the second lower flow passage (56) through the outside second shutter (64).

A first air stream, taken into the lower right flow passage (66), flows into the first lower flow passage (54) via the first lower right opening (24). On the other hand, a second air stream, taken into the lower left flow passage (68), flows into the first flow passage (51) via the first left side opening (31).

As also shown in FIG. 13(A), after the entrance into the first lower flow passage (54), the first air stream flows into the humidity control passageway (85) of the first adsorptive element (81). During the flow through the humidity control passageway (85), water vapors contained in the first air stream are adsorbed on the adsorbent of the first adsorptive element (81). The first air stream thus dehumidified in the first adsorptive element (81) flows into the first upper flow passage (53).

Meanwhile, after the entrance into the first flow passage (51), the second air stream flows into the auxiliary passageway (86) of the first adsorptive element (81). During the flow through the auxiliary passageway (86), the second air stream absorbs heat of adsorption generated as a result of water vapor adsorption by the adsorbent in the humidity control passageway (85). After having absorbed such heat of adsorption, the second air stream enters the central flow passage (57) and then passes through the regeneration heat exchanger (72). At that time, in the regeneration heat exchanger (72), the second air stream is heated by heat exchange with heated water.

The second air stream, heated by the first adsorptive element (81) and the regeneration heat exchanger (72), is introduced into the auxiliary passageway (86) of the second adsorptive element (82) by way of the central flow passage (57). Thereafter, the second air stream flows into the second flow passage (52), flows, through the opening of the outside second shutter (64), into the second lower flow passage (56), and is introduced into the humidity control passageway (85) of the second adsorptive element (82). In the humidity control passageway (85), the adsorbent is heated by the second air stream and, as a result, water vapors are desorbed from the adsorbent. In other words, the adsorbent of the second adsorptive element (82) is regenerated. The water vapors desorbed from the adsorbent flow, together with the second air stream, into the second upper flow passage (55).

After the entrance into the first upper flow passage (53), the dehumidified first air stream flows into the upper left flow passage (67) via the first upper left opening (33) and flows into the air supply chamber (42). After the entrance into the air supply chamber (42), the first air stream is supplied into the room via the air supply opening (14) by the air supply fan (95).

On the other hand, after the entrance into the second upper flow passage (55), the second air stream flows into the upper right flow passage (65) via the second upper right opening (25) and flows into the air discharge chamber (41). After the entrance into the air discharge chamber (41), the second air stream is discharged to outside the room via the air discharge opening (16) by the air discharge fan (96).

Second Operation

As shown in FIG. 13(B) and FIG. 15, contrary to the first operation, in a second operation of the dehumidification operating mode, the process of adsorption takes place in the second adsorptive element (82) and the process of regeneration takes place in the first adsorptive element (81). In other words, in the second operation, air is dehumidified in the second adsorptive element (82) at the same time the adsorbent of the first adsorptive element (81) is regenerated.

As shown in FIG. 15, in the right side partition plate (20), the first upper right opening (23) and the second lower right opening (26) enter the open state while the remaining other openings (21, 22, 24, 25) are placed in the closed state. In this state, the first upper right opening (23) allows fluid communication between the first upper flow passage (53) and the upper right flow passage (65), and the second lower right opening (26) allows fluid communication between the lower right flow passage (66) and the second lower flow passage (56).

On the other hand, in the left side partition plate (30), the second left side opening (32) and the second upper left opening (35) enter the open state while the remaining other openings (31, 33, 34, 36) are placed in the closed state. In this state, the second left side opening (32) allows fluid communication between the lower left flow passage (68) and the second flow passage (52), and the second upper left opening (35) allows fluid communication between the second upper flow passage (55) and the upper left flow passage (67).

The inside first shutter (61), the inside second shutter (62), and the outside second shutter (64) enter the closed state while on the other hand the outside first shutter (63) is placed in the open state. This state allows fluid communication between the first flow passage (51) and the first lower flow passage (54) through the outside first shutter (63).

The first air stream, taken into the lower right flow passage (66), flows into the second lower flow passage (56) via the second lower right opening (26). On the other hand, the second air stream, taken into the lower left flow passage (68), flows into the second flow passage (52) via the second left side opening (32).

As also shown in FIG. 13(B), after the entrance into the second lower flow passage (56), the first air stream flows into the humidity control passageway (85) of the second adsorptive element (82). During the flow through the humidity control passageway (85), water vapors contained in the first air stream are adsorbed on the adsorbent of the second adsorptive element (82). The first air stream thus dehumidified in the second adsorptive element (82) flows into the second upper flow passage (55).

On the other hand, after the entrance into the second flow passage (52), the second air stream flows into the auxiliary passageway (86) of the second adsorptive element (82). During the flow through the auxiliary passageway (86), the second air stream absorbs heat of adsorption generated as a result of water vapor adsorption by the adsorbent in the humidity control passageway (85). After having absorbed such heat of adsorption, the second air stream enters the central flow passage (57) and passes through the regeneration heat exchanger (72). At that time, in the regeneration heat exchanger (72), the second air stream is heated by heat exchange with heated water.

The second air stream, heated by the second adsorptive element (82) and the regeneration heat exchanger (72), is introduced into the auxiliary passageway (86) of the first adsorptive element (81) by way of the central flow passage (57). Thereafter, the second air stream enters the first flow passage (51), flows, through the opening of the outside first shutter (63), into the first lower flow passage (54), and is introduced into the humidity control passageway (85) of the first adsorptive element (81). In the humidity control passageway (85), the adsorbent is heated by the second air stream and, as a result, water vapors are desorbed from the adsorbent. In other words, the adsorbent of the first adsorptive element (81) is regenerated. The water vapors desorbed from the adsorbent flow, together with the second air stream, into the first upper flow passage (53).

After the entrance into the second upper flow passage (55), the dehumidified first air stream flows into the upper left flow passage (67) via the second upper left opening (35). Thereafter, the first air stream flows into the air supply chamber (42). After the entrance into the air supply chamber (42), the first air stream is supplied into the room via the air supply opening (14) by the air supply fan (95).

On the other hand, after the entrance into the first upper flow passage (53), the second air stream flows into the upper right flow passage (65) via the first upper right opening (23). Thereafter, the second air stream flows into the air discharge chamber (41). After the entrance into the air discharge chamber (41), the second air stream is discharged to outside the room via the air discharge opening (16) by the air discharge fan (96).

Humidification Operating Mode

Figure 16:
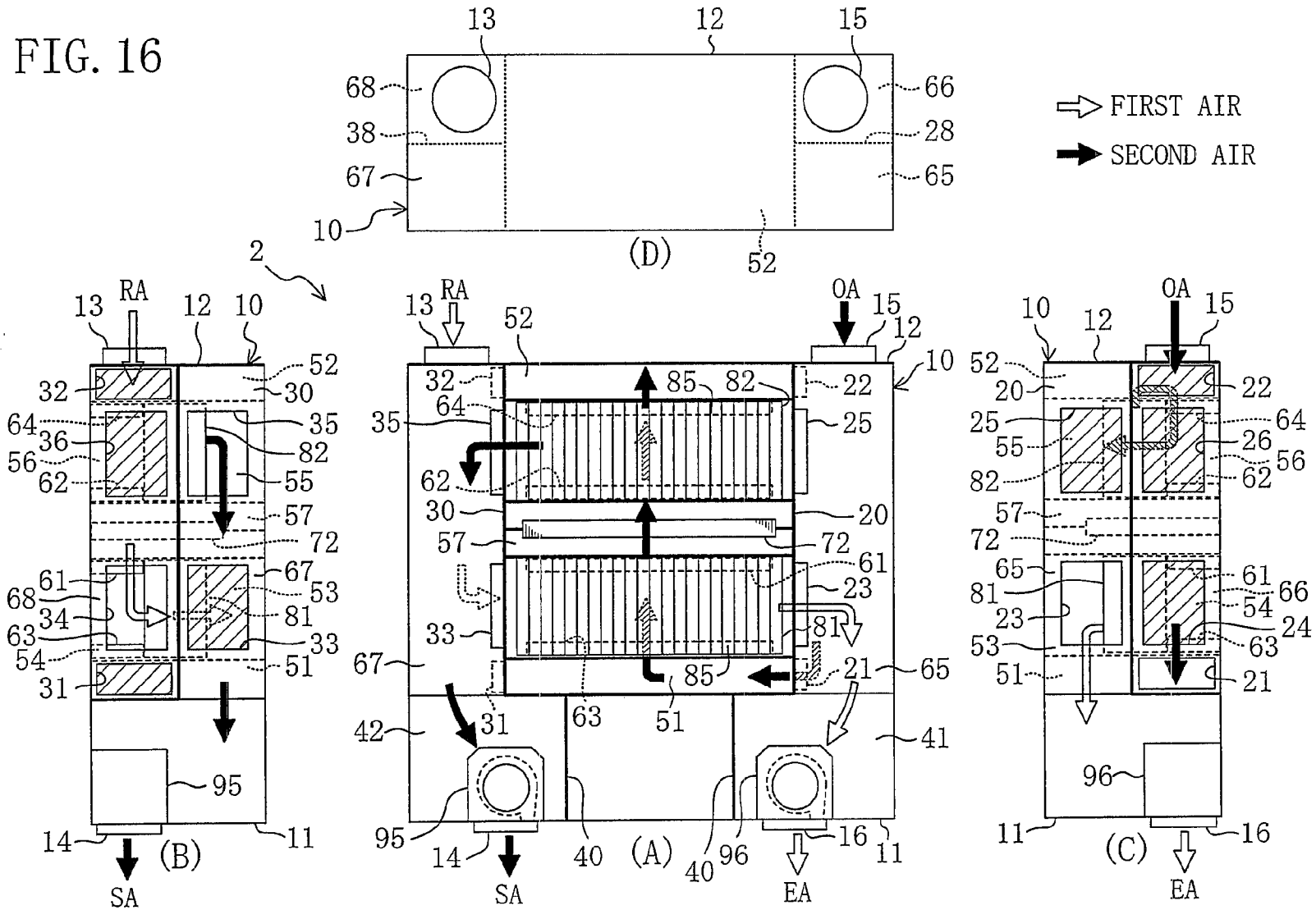
FIG. 16 is an explanatory diagram which illustrates the flow of air streams in a first operation of the humidification operating mode of the humidity control device of the second embodiment.

In the humidification operating mode (as shown in FIGS. 13A and 16), when the air supply fan (95) is activated, outside air (OA) as a second air stream is taken into the lower right flow passage (66) within the casing (10) through the outdoor side suction opening (15). On the other hand, when the air discharge fan (96) is activated, room air (RA) as a first air stream is taken into the lower left flow passage (68) within the casing (10) through the indoor side suction opening (13).

In addition, in the humidification operating mode, heated water flows through the regeneration heat exchanger (72), whereby the heat of the heated water is given to an air stream flowing through the regeneration heat exchanger (72).

First Operation

As shown in FIG. 13(A) and FIG. 16, in a first operation of the humidification operating mode, the process of adsorption takes place in the first adsorptive element (81) and the process of regeneration takes place in the second adsorptive element (82). In other words, in the first operation, air is humidified in the second adsorptive element (82) and water vapors are adsorbed on the adsorbent of the first adsorptive element (81).

As shown in FIG. 16, in the right side partition plate (20), the first right side opening (21) and the first upper right opening (23) enter the open state while the remaining other openings (22, 24, 25, 26) are placed in the closed state. In this state, the first right side opening (21) allows fluid communication between the lower right flow passage (66) and the first flow passage (51), and the first upper right opening (23) allows fluid communication between the first upper flow passage (53) and the upper right flow passage (65).

On the other hand, in the left side partition plate (30), the first lower left opening (34) and the second upper left opening (35) enter the open state while the remaining other openings (31, 32, 33, 36) are placed in the closed state. In this state, the first lower left opening (34) allows fluid communication between the lower left flow passage (68) and the first lower flow passage (54), and the second upper left opening (35) allows fluid communication between the second upper flow passage (55) and the upper left flow passage (67).

The inside first shutter (61), the inside second shutter (62), and the outside first shutter (63) enter the closed state while on the other hand the outside second shutter (64) is placed in the open state. This state allows fluid communication between the second flow passage (52) and the second lower flow passage (56) through the outside second shutter (64).

The first air stream, taken into the lower left flow passage (68), flows into the first lower flow passage (54) via the first lower left opening (34). On the other hand, the second air stream, taken into the lower right flow passage (66), flows into the first flow passage (51) via the first right side opening (21).

As also shown in FIG. 13(A), after the entrance into the first lower flow passage (54), the first air stream flows into the humidity control passageway (85) of the first adsorptive element (81). During the flow through the humidity control passageway (85), water vapors contained in the first air stream are adsorbed on the adsorbent of the first adsorptive element (81). The first air stream thus dehumidified in the first adsorptive element (81) flows into the first upper flow passage (53).

Meanwhile, after the entrance into the first flow passage (51), the second air stream flows into the auxiliary passageway (86) of the first adsorptive element (81). During the flow through the auxiliary passageway (86), the second air stream absorbs heat of adsorption generated as a result of water vapor adsorption by the adsorbent in the humidity control passageway (85). After having absorbed such heat of adsorption, the second air stream enters the central flow passage (57) and passes through the regeneration heat exchanger (72). At that time, in the regeneration heat exchanger (72), the second air stream is heated by heat exchange with heated water.

The second air stream, heated by the first adsorptive element (81) and the regeneration heat exchanger (72), is introduced into the auxiliary passageway (86) of the second adsorptive element (82) by way of the central flow passage (57). Thereafter, the second air stream flows into the second flow passage (52), flows, through the opening of the outside second shutter (64), into the second lower flow passage (56), and is introduced into the humidity control passageway (85) of the second adsorptive element (82). In the humidity control passageway (85), the adsorbent is heated by the second air stream and, as a result, water vapors are desorbed from the adsorbent. In other words, the adsorbent of the second adsorptive element (82) is regenerated. And, the water vapors desorbed from the adsorbent are given to the second air stream, in other words the second air stream is humidified. The water vapors desorbed from the adsorbent flow, together with the second air stream, into the second upper flow passage (55).

After the entrance into the first upper flow passage (53), the dehumidified first air stream flows into the upper right flow passage (65) via the first upper right opening (23). Thereafter, the first air stream flows into the air discharge chamber (41). After the entrance into the air discharge chamber (41), the first air stream is discharged to outside the room via the air discharge opening (16) by the air discharge fan (96).

After the entrance into the second upper flow passage (55), the second air stream flows into the upper left flow passage (67) via the second upper left opening (35). Thereafter, the second air stream flows into the air supply chamber (42). After the entrance into the air supply chamber (42), the second air stream is supplied into the room via the air supply opening (14) by the air supply fan (95).

Second Operation

Figure 17:
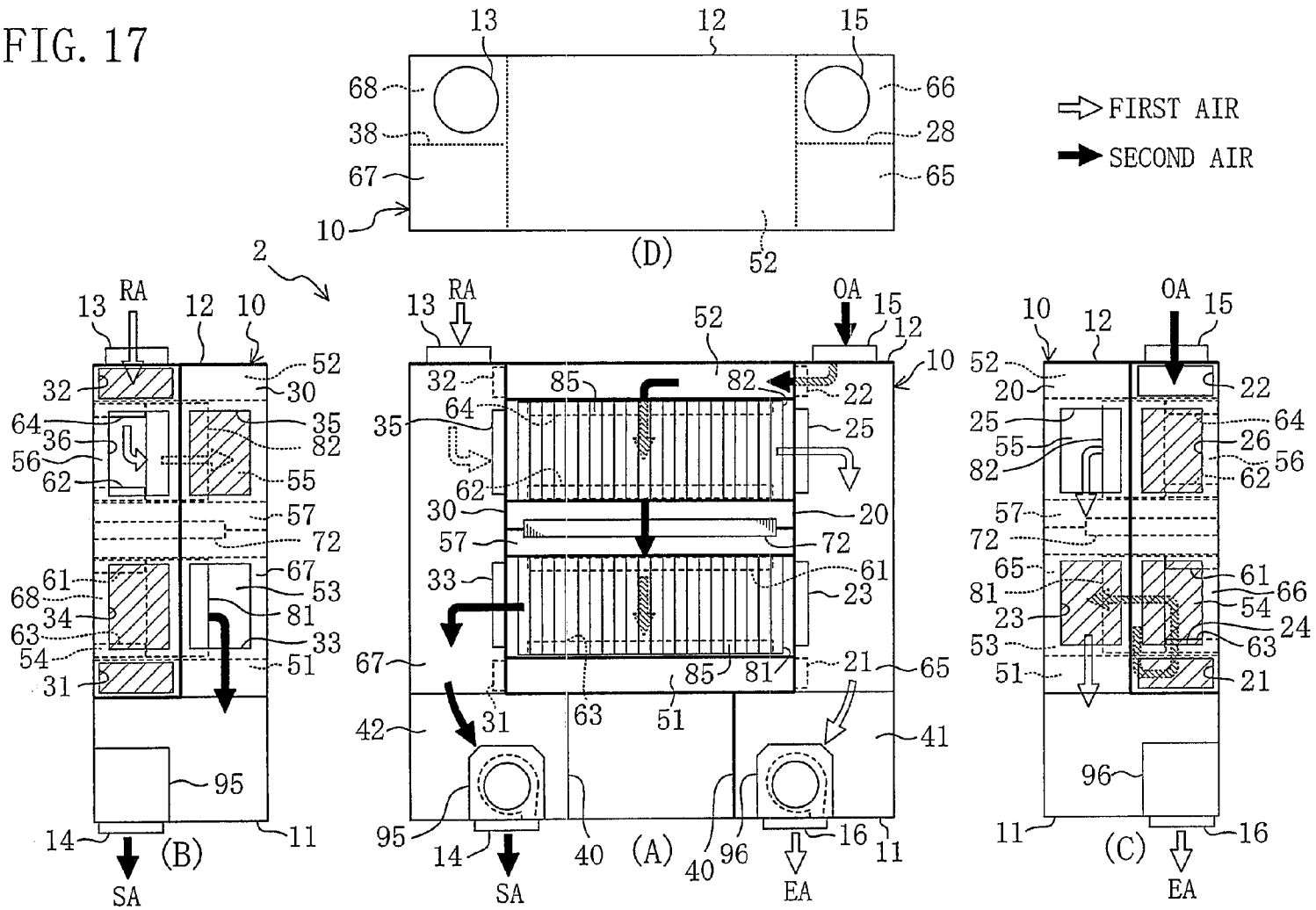
FIG. 17 is an explanatory diagram which illustrates the flow of air streams in a second operation of the humidification operating mode of the humidity control device of the second embodiment.

As shown in FIG. 13(B) and FIG. 17, contrary to the first operation, in a second operation of the humidification mode, the process of adsorption takes place in the second adsorptive element (82) and the process of regeneration takes place in the first adsorptive element (81). In other words, in the second operation, air is humidified in the first adsorptive element (81) and water vapors are adsorbed on the adsorbent of the second adsorptive element (82).

As shown in FIG. 17, in the right side partition plate (20), the second right side opening (22) and the second upper right opening (25) enter the open state while the remaining other openings (21, 23, 24, 26) are placed in the closed state. In this state, the second right side opening (22) allows fluid communication between the lower right flow passage (66) and the second flow passage (52), and the second upper right opening (25) allows fluid communication between the second upper flow passage (55) and the upper right flow passage (65).

On the other hand, in the left side partition plate (30), the first upper left opening (33) and the second lower left opening (36) enter the open state while the remaining other openings (31, 32, 34, 35) are placed in the closed state. In this state, the first upper left opening (33) allows fluid communication between the first upper flow passage (53) and the upper left flow passage (67), and the second lower left opening (36) allows fluid communication between the lower left flow passage (68) and the second lower flow passage (56).

The inside first shutter (61), the inside second shutter (62), and the outside second shutter (64) enter the closed state while on the other hand the outside first shutter (63) is placed in the open state. This state allows fluid communication between the first flow passage (51) and the first lower flow passage (54) through the outside first shutter (63).

The first air stream, taken into the lower left flow passage (68), flows into the second lower flow passage (56) via the second lower left opening (36). On the other hand, the second air stream, taken into the lower right flow passage (66), flows into the second flow passage (52) via the second right side opening (22).

As also shown in FIG. 13(B), after the entrance into the second lower flow passage (56), the first air stream flows into the humidity control passageway (85) of the second adsorptive element (82). During the flow through the humidity control passageway (85), water vapors contained in the first air stream are adsorbed on the adsorbent of the second adsorptive element (82). The first air stream thus dehumidified in the second adsorptive element (82) flows into the second upper flow passage (55).

On the other hand, after the entrance into the second flow passage (52), the second air stream flows into the auxiliary passageway (86) of the second adsorptive element (82). During the flow through the auxiliary passageway (86), the second air stream absorbs heat of adsorption generated as a result of water vapor adsorption by the adsorbent in the humidity control passageway (85). After having absorbed such heat of adsorption, the second air stream enters the central flow passage (57) and then passes through the regeneration heat exchanger (72). At that time, in the regeneration heat exchanger (72), the second air stream is heated as a result of heat exchange with heated water.

The second air stream, heated by the second adsorptive element (82) and the regeneration heat exchanger (72), is introduced into the auxiliary passageway (86) of the first adsorptive element (81) by way of the central flow passage (57). Thereafter, the second air stream enters the first flow passage (51), flows, through the opening of the outside first shutter (63), into the first lower flow passage (54), and is introduced into the humidity control passageway (85) of the first adsorptive element (81). In the humidity control passageway (85), the adsorbent is heated by the second air stream and, as a result, water vapors are desorbed from the adsorbent. In other words, the adsorbent of the first adsorptive element (81) is regenerated. The water vapors desorbed from the adsorbent are given to the second air stream and, as a result, the second air stream is humidified. The water vapors desorbed from the adsorbent flow, together with the second air stream, into the first upper flow passage (53).

After the entrance into the second upper flow passage (55), the dehumidified first air stream flows into the upper right flow passage (65) via the second upper right opening (25). Thereafter, the first air stream flows into the air supply chamber (42). After the entrance into the air supply chamber (42), the first air stream is supplied into the room via the air supply opening (14) by the air supply fan (95).

On the other hand, after the entrance into the first upper flow passage (53), the second air stream flows into the upper left flow passage (67) via the first upper left opening (33). Thereafter, the second air stream flows into the air discharge chamber (41). After the entrance into the air discharge chamber (41), the second air stream is discharged to outside the room via the air discharge opening (16) by the air discharge fan (96).

Effects of the Second Embodiment

As described above, in accordance with the second embodiment, each adsorptive element (81, 82) is provided with the auxiliary passageway (86) through which a heating fluid flows at the time the adsorptive element (81, 82) is regenerated, thereby making it possible to heat the adsorptive element (81, 82) with the heating fluid flowing through the auxiliary passageway (86) at the time of regeneration of the adsorptive element (81, 82) (heating/regeneration operating mode), as in the first embodiment. Consequently, the adsorptive element (81, 82) is maintained at high temperature, thereby making it possible to increase the amount of release moisture (the amount of regeneration) more than is conventionally achieved. Accordingly, it becomes possible to increase also the amount of adsorption the next time the adsorptive element (81, 82) adsorbs moisture in a first air stream, thereby accomplishing improvement in device performance.

Additionally, during adsorption of the adsorptive element (81, 82), the adsorptive element (81, 82) can be cooled by a cooling fluid (a second air stream) flowing through the auxiliary passageway (86) (cooling/adsorption operating mode). This prevents a temperature rise during adsorption, thereby making it possible to enhance the capability to adsorb moisture.

Furthermore, it is arranged such that, when performing a batch running operation in the humidity control device (2) provided with the first adsorptive element (81) and the second adsorptive element (82), a cooling/adsorption operating mode is conducted in one of the adsorptive elements (81, 82) while simultaneously a heating/regeneration operating mode is conducted in the other of the adsorptive elements (81, 82). This makes it possible to accomplish improvement in both adsorptive capability and regenerative capability, thereby accomplishing improvement in total device performance.

VARIATIONAL EXAMPLES OF THE SECOND EMBODIMENT

First Variational Example

A first variational example is a humidity control device having the same configuration as the humidity control device of the second embodiment. The first variational example is characterized in that the flow of air streams in the first operation and the flow of air streams in the second operation are changed. In the present variational example, the inside first shutter (61) and the inside second shutter (62) are placed in the open or closed state.

Figure 18:
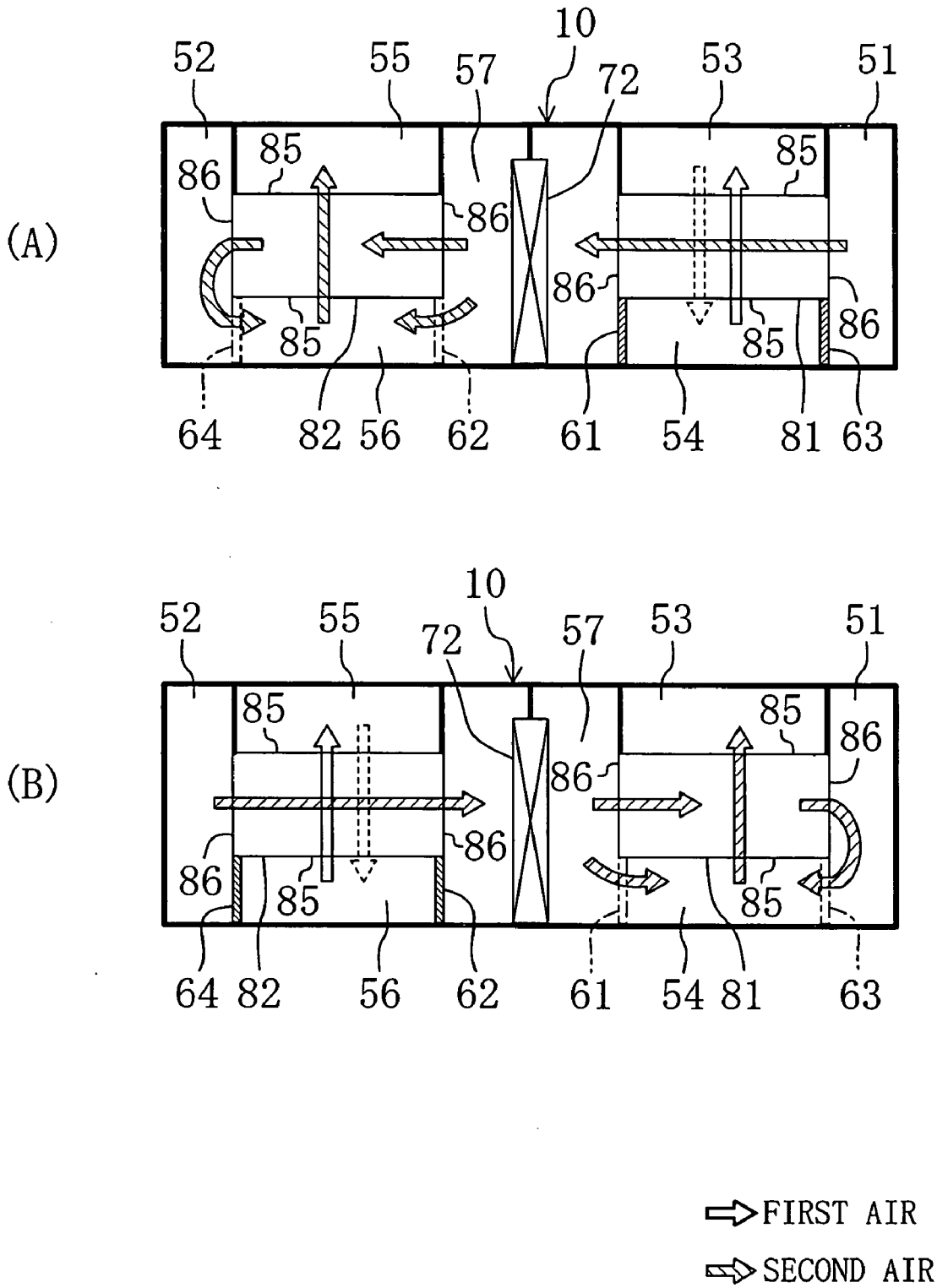

With reference to FIG. 18, operation during the dehumidification operating mode is briefly described below.

FIG. 18(A) illustrates the flow of air streams in the first operation. FIG. 18(B) illustrates the flow of air streams in the second operation. In the first operation, a first air stream is dehumidified when passing through the humidity control passageway (85) of the first adsorptive element (81). Thereafter, the first air stream is supplied into the room. On the other hand, a second air stream absorbs heat of adsorption of the first air stream when passing through the auxiliary passageway (86) of the first adsorptive element (81). Thereafter, the second air stream is heated in the regeneration heat exchanger (72). Then, the flow of the second air stream is divided into two branch flows. More specifically, a part of the second air stream passes through the auxiliary passageway (86) of the second adsorptive element (82) and heats the second adsorptive element (82). Thereafter, the part of the second air stream joins the rest of the second air stream. The merged second air stream flows through the humidity control passageway (85) of the second adsorptive element (82), and the second adsorptive element (82) is regenerated. In the second operation, a first air stream is dehumidified in the second adsorptive element (82), and when the first adsorptive element (81) is regenerated by a second air stream, a part of the second air stream, after its passage through the auxiliary passageway (86), joins the rest of the second air stream. The merged second air stream flows into the humidity control passageway (85). And, the first air stream, dehumidified as a result of releasing moisture to the adsorptive element (81, 82), is supplied into the room while on the other hand the second air stream, used to regenerate the adsorptive element (81, 82) by absorbing moisture therefrom, is discharged to outside the room.

In the examples of FIGS. 12-17, both the inside first shutter (61) and the inside second shutter (62) are constantly placed in the closed state. Unlike these examples, when performing the operation of FIG. 18, the inside first shutter (61) is placed in the open state at the same time the outside first shutter (63) is placed in the open state, and the inside second shutter (62) is placed in the open state at the same time the outside second shutter (64) is placed in the open state. As a result of such arrangement, a part of an air stream after its passage through the regeneration heat exchanger (72) passes through the auxiliary passageway (86) of the adsorptive element (81, 82) and then joins the rest of the air stream. Thereafter, the merged air stream flows into the humidity control passageway (85).

During the humidification operating mode, a second air stream is humidified as a result of absorbing moisture from the adsorptive element (81, 82). Then, the second air stream is supplied into the room. On the other hand, a first air stream releases moisture to the adsorptive element (81, 82). Then, the first air stream is discharged to outside the room.

In addition, with reference to FIGS. 18(A) and 18(B), the first and second air streams flow through the humidity control passageway (85) of each adsorptive element (81, 82) in the same direction. Alternatively, it may be arranged such that the first and second air streams flow through the humidity control passageway (85) in opposite directions, as indicated by broken line.

In the first variational example, during regeneration of the adsorptive element (81, 82), a part of a second air stream prior to its passage through the humidity control passageway (85) enters, as a heating fluid, the auxiliary passageway (86). The second air stream is a high-temperature air stream which is used to regenerate the adsorptive element (81, 82). The part of the second air stream flows through the auxiliary passageway (86) and heats the adsorptive element (81, 82) while simultaneously the rest of the second air stream flows through the humidity control passageway (85), thereby preventing the adsorptive element (81, 82) from undergoing a temperature fall during regeneration. Hereby, it becomes possible to assure that a sufficient level of the amount of regeneration is maintained, and that the amount of adsorption is also prevented from decreasing.

Furthermore, also in the present variational example, it is arranged such that, when performing a batch running operation in the humidity control device provided with the first adsorptive element (81) and the second adsorptive element (82), a cooling/adsorption operating mode is conducted in one of the adsorptive elements (81, 82) while simultaneously a heating/regeneration operating mode is conducted in the other of the adsorptive elements (81, 82). This makes it possible to accomplish improvement in both adsorptive capability and regenerative capability, thereby accomplishing improvement in total device performance.

Variational Example 2

Figure 19:
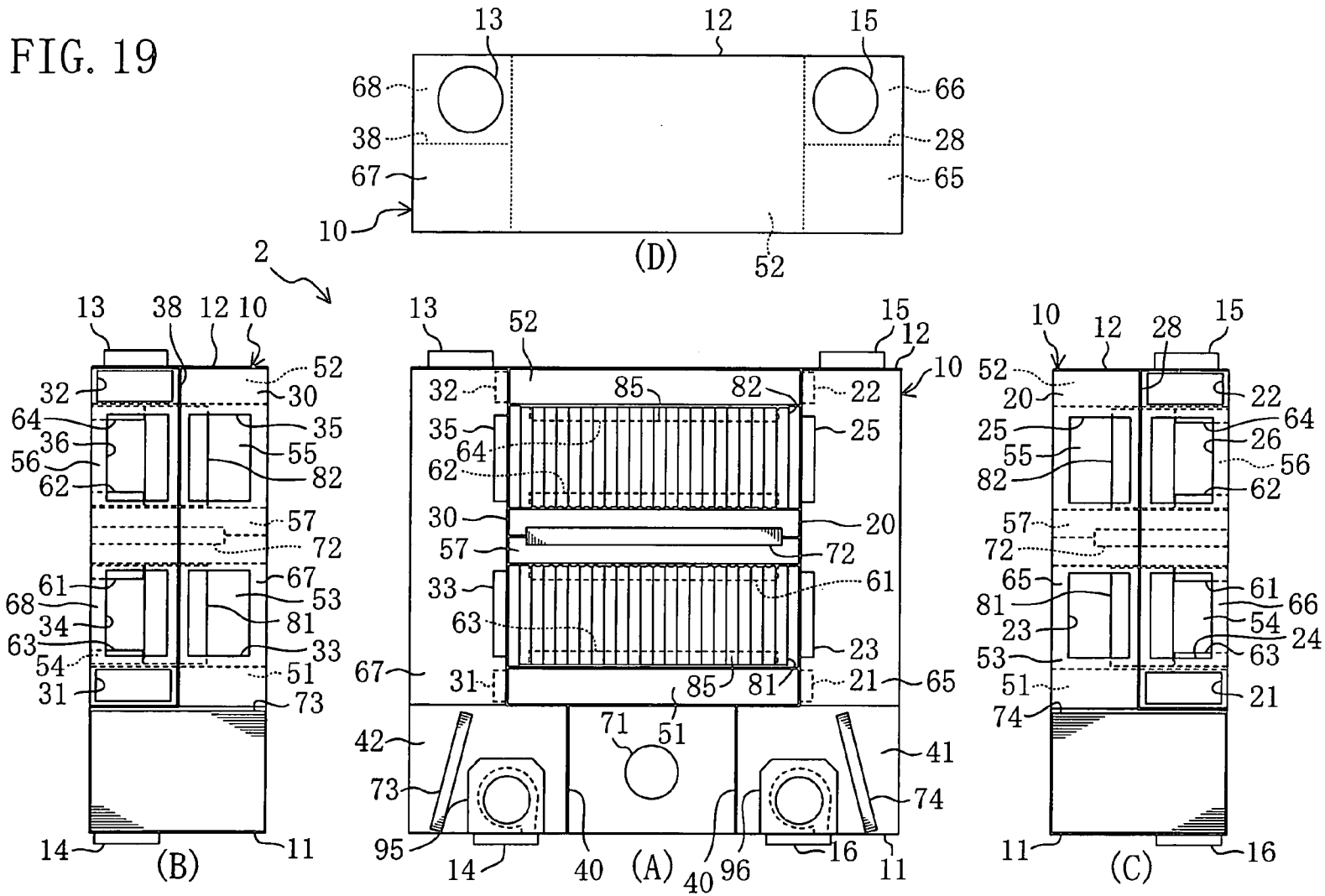

As shown in FIG. 19, a second variational example is an example of the humidity control device of the second embodiment with the addition of a refrigerant circuit.

The refrigerant circuit is provided with, in addition to the regeneration heat exchanger (72), a first heat exchanger (73), a second heat exchanger (74), a compressor (71), and an expansion valve (not shown). In the refrigerant circuit charged with a refrigerant, the refrigerant is circulated, thereby to perform a refrigeration cycle. Additionally, the refrigerant circuit is configured, such that its operation selectively switches between the operation in which the first heat exchanger (73) operates as an evaporator and the operation in which the second heat exchanger (74) operates as an evaporator.

In the present variational example, the regeneration heat exchanger (72) is not a heat exchanger through which heated water flows but a heat exchanger through which refrigerant flows, and a stream of air flowing through the central flow passage (57) is heated by heat exchange with the refrigerant of the refrigerant circuit.

In addition, the compressor (71) is disposed in a space defined between the air discharge chamber (41) and the air supply chamber (42).

In addition to the air discharge fan (96), the second heat exchanger (74) is disposed in the air discharge chamber (41). During the humidification operating mode, the refrigerant is distributed through the second heat exchanger (74), wherein a process-air stream flowing in the direction of the air discharge fan (96) is cooled by being subjected to heat exchange with the refrigerant of the refrigerant circuit. On the other hand, during the dehumidification operating mode, the second heat exchanger (74) is stopped, in other word the second heat exchanger (74) neither heats nor cools process air.

In addition to the air supply fan (95), the first heat exchanger (73) is disposed in the air supply chamber (42). During the dehumidification operating mode, the refrigerant is distributed through the first heat exchanger (73), wherein an air stream to be treated flowing in the direction of the air supply fan (95) is cooled by being subjected heat exchange with the refrigerant of the refrigerant circuit. On the other hand, during the humidification operating mode, the first heat exchanger (73) is stopped, in other words the first heat exchanger (73) neither heats nor cools air to be treated.

In the second variational example, during the dehumidification operating mode, outside air (OA) introduced into the casing (10) via the outdoor side suction opening (15) is dehumidified in the adsorptive element (81, 82) when flowing in the casing (10) as illustrated in FIGS. 14 and 15. Then, the first air stream enters the air supply chamber (42). After the entrance into the air supply chamber (42), the first air stream is cooled as a result of heat exchange with the refrigerant in the first heat exchanger (73). Thereafter, the first air stream is supplied into the room via the air supply opening (14) by the air supply fan (95).

On the other hand, room air (RA) introduced into the casing (10) via the indoor side suction opening (13) regenerates the adsorptive element (81, 82) when flowing in the casing (10) as illustrated in FIGS. 14 and 15. Then, the second air stream enters the air discharge chamber. After the entrance into the air discharge chamber (41), the second air stream passes through the second heat exchanger (74), and is discharged to outside the room via the air discharge opening (16) by the air discharge fan (96). At that time, the second heat exchanger (74) is stopped, so that the second air stream is neither heated nor cooled.

In addition, during the humidification operating mode, outdoor air (OA) introduced into the casing (10) via the outdoor side suction opening (15) is humidified in the adsorptive element (81, 82) when flowing in the casing (10) as illustrated in FIGS. 16 and 17. Then, the second air stream enters the air supply chamber (42). After the entrance into the air supply chamber (42), the second air stream passes through the first heat exchanger (73), and is supplied into the room via the air supply opening (14) by the air supply fan (95).

On the other hand, room air (OA) introduced into the casing (10) via the indoor side suction opening (13) is dehumidified in the adsorptive element (81, 82) when flowing in the casing (10) as indicated in FIGS. 16 and 17, and then flows into the air discharge chamber (41). After the entrance into the air discharge chamber (41), the first air stream is cooled as a result of heat exchange with the refrigerant in the second heat exchanger (74). Then, the first air stream is discharged to outside the room via the air discharge opening (16) by the air discharge fan (96).

Also in the second variational example, during regeneration of the adsorptive element (81, 82), the adsorptive element (81, 82) is heated by a heating fluid (i.e., a second air stream) flowing through the auxiliary passageway (86). Consequently, the adsorptive element (81, 82) is maintained at high temperature, thereby making it possible to increase the amount of release moisture (the amount of regeneration) more than is conventionally achieved. Accordingly, it becomes possible to increase also the amount of adsorption the next time the adsorptive element (81, 82) adsorbs moisture in a first air stream, and the device performance is enhanced.

In addition, it may be arranged such that, at the time of regeneration of the adsorptive element (81, 82), all of a second air stream of high temperature for regeneration of the adsorptive element (81, 82) flows, as a heating fluid, through the auxiliary passageway (86), heats the adsorptive element (81, 82), and flows through the humidity control passageway (85), as in the second embodiment of FIG. 13. Alternatively, it may be arranged such that a part of a second air stream prior to its passage through the humidity control passageway (85) flows, as a heating fluid, through the auxiliary passageway (86), heats the adsorptive element (81, 82), joins the rest of the second air stream, and flows through the humidity control passageway (85), as in the first variational example of FIG. 18. These arrangements assure that the adsorptive element (81, 82) is prevented from undergoing a temperature fall during regeneration, and that a sufficient level of the amount of regeneration is maintained.

THIRD EMBODIMENT OF THE PRESENT INVENTION

Configuration of Humidity Control Device

Figure 20:
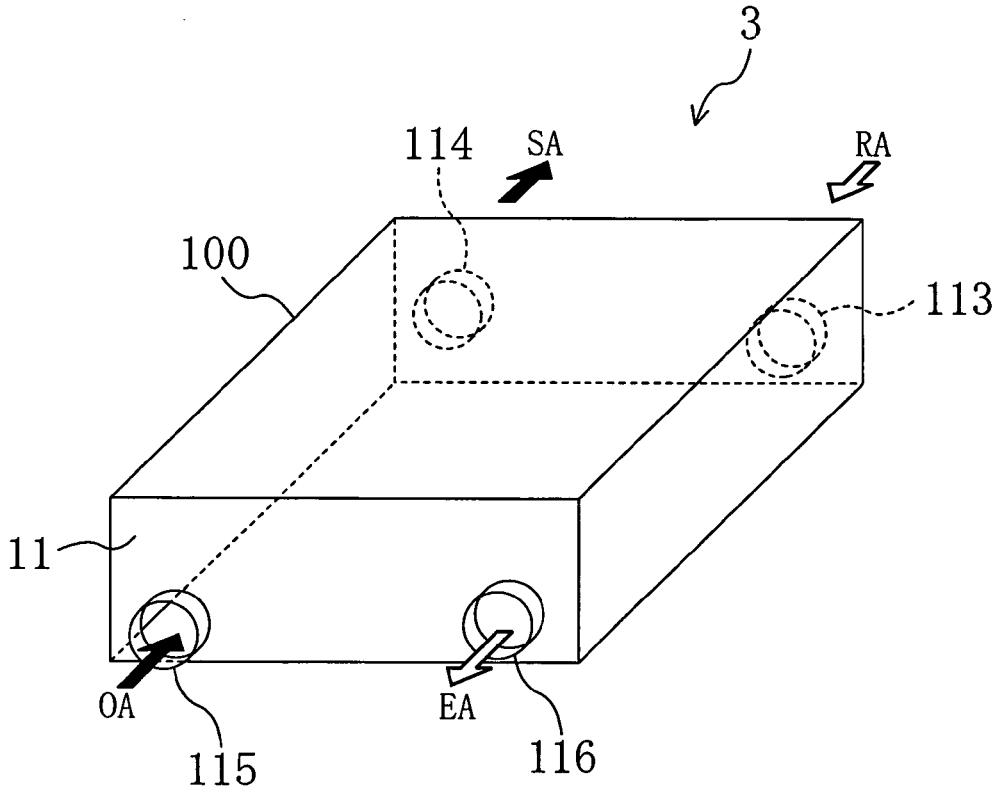
FIG. 20 is a perspective view of a humidity control device according to a third embodiment of the present invention.

With reference to FIG. 20, there is shown a humidity control device (3) according to a third embodiment of the present invention. The humidity control device (3) is provided with a somewhat flat, rectangular parallelepiped-shaped casing (100), an outdoor side suction opening (115) through which outside air is drawn in, an air supply opening (114) through which air is blown out into the room, an indoor side suction opening (113) through which room air is drawn in, and an air discharge opening (116) through which air is blown out to outside the room.

Figure 21:
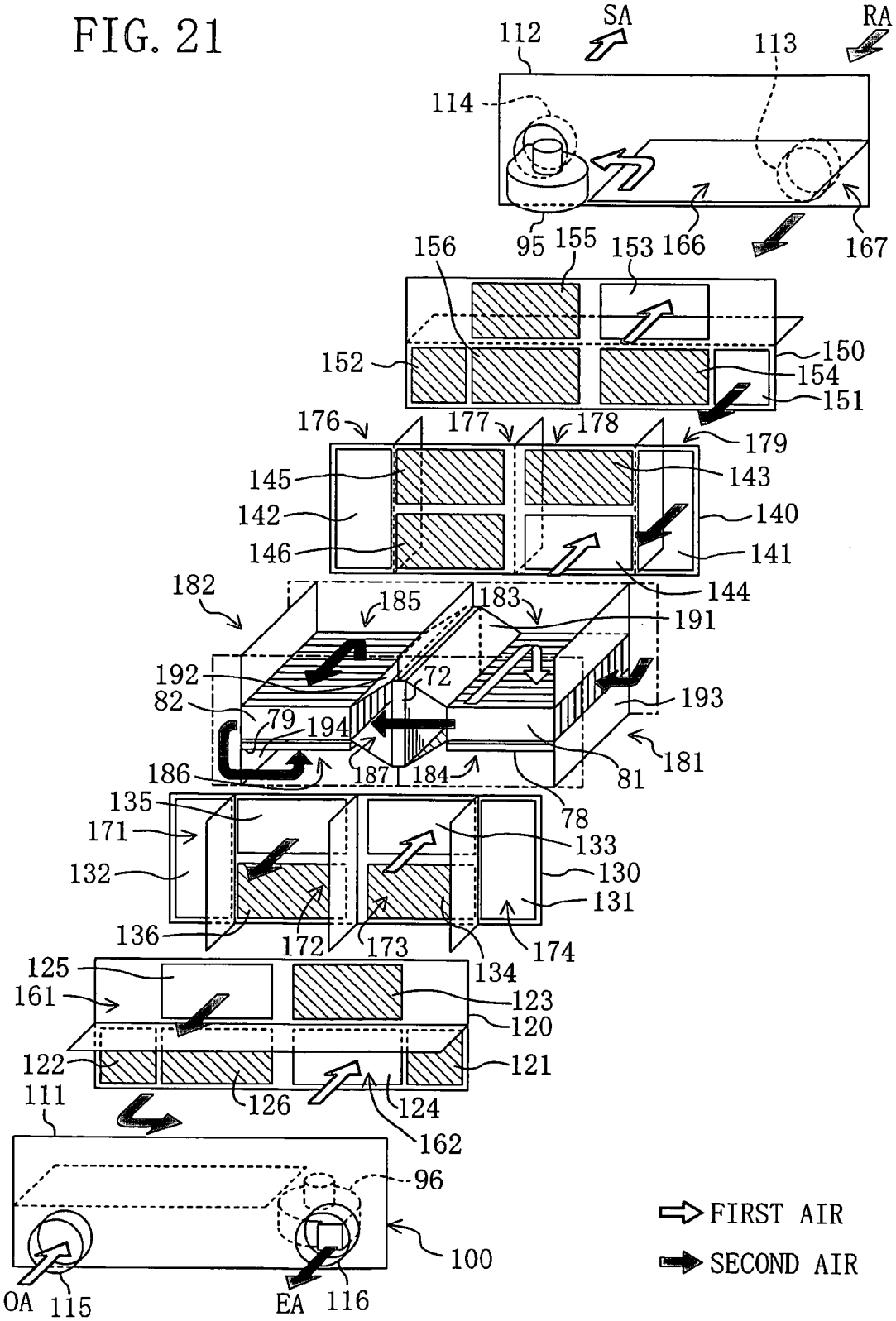
FIG. 21 is an exploded perspective view which illustrates the flow of air streams in a first operation of the dehumidification operating mode of the humidity control device of the third embodiment.

As shown in FIG. 21, the casing (100) contains therein a first adsorptive element (81) and a second adsorptive element (82). The first and second adsorptive elements (81, 82) of the present embodiment are each configured in the same way that the adsorptive elements (81, 82) in each of the first and second embodiments are configured (see FIG. 2). In addition, the casing (100) further contains therein a regeneration heat exchanger (72), a first auxiliary heat exchanger (78), and a second auxiliary heat exchanger (79). These heat exchangers (72, 78, 79) are disposed in a refrigerant circuit (described later) and are configured so as to allow refrigerant to flow therethrough.

Referring still to FIG. 21, in the casing (100), an outdoor side panel (111) is positioned on the frontmost side, and an indoor side panel (112) is positioned on the backmost side. The outdoor side suction opening (115) is formed adjacent to the left periphery of the outdoor side panel (111). The air discharge opening (116) is formed adjacent to the right periphery of the outdoor side panel (111). The air supply opening (114) is formed adjacent to the left periphery of the indoor side panel (112). The indoor side suction opening (113) is formed adjacent to the right periphery of the indoor side panel (112).

Disposed, sequentially from the front to the back side, within the casing (100) are a first partition plate (120), a second partition plate (130), a third partition plate (140), and a fourth partition plate (150). The interior space of the casing (100) is partitioned, by these partition plates (120, 130, 140, 150), in front-to-rear direction.

The space defined between the outdoor side panel (111) and the first partition plate (120) is divided into an outdoor side upper space (161) and an outdoor side lower space (162). The outdoor side upper space (161) is brought into fluid communication with an outdoor space through the air discharge opening (116). The outdoor side lower space (162) is brought into fluid communication with an outdoor space through the outdoor side suction opening (115). Arranged adjacent to the right periphery of the outdoor side upper space (161) is an air discharge fan (96).

The space defined between the first partition plate (120) and the second partition plate (130) is sequentially divided from the left to the right side into a left peripheral space (171), a left side central space (172), a right side central space (173), and a right peripheral space (174).

Formed in the first partition plate (120) are a right side opening (121), a left side opening (122), an upper right opening (123), a lower right opening (124), an upper left opening (125), and a lower left opening (126). Each of these openings (121-126) is provided with a respective opening/closing shutter and is configured such that it can freely be placed in the open or closed state.

The upper left opening (125) allows fluid communication between the outdoor side upper space (161) and the left side central space (172). The upper right opening (123) allows fluid communication between the outdoor side upper space (161) and the right side central space (173). The left side opening (122) allows fluid communication between the outdoor side lower space (162) and the left peripheral space (171). The lower left opening (126) allows fluid communication between the outdoor side lower space (162) and the left side central space (172). The lower right opening (124) allows fluid communication between the outdoor side lower space (162) and the right side central space (173). The right side opening (121) allows fluid communication between the outdoor side lower space (162) and the right peripheral space (174).

Likewise, formed in the second partition plate (130) are a right side opening (131), a left side opening (132), an upper right opening (133), a lower right opening (134), an upper left opening (135), and a lower left opening (136). The upper left opening (135), the lower left opening (136), the upper right opening (133), and the lower right opening (134) are each provided with a respective opening/closing shutter and is configured such that it can freely be placed in the open or closed state.

Disposed between the second partition plate (130) and the third partition plate (140) are the first adsorptive element (81) and the second adsorptive element (82). The adsorptive elements (81, 82) are arranged such that they lie laterally side by side at a specific distance apart from each other. More specifically, the first adsorptive element (81) is positioned to the right while on the other hand the second adsorptive element (82) is positioned to the left.

The first and second adsorptive elements (81, 82) are arranged in such orientation that the direction in which the flat plate members (83) and the corrugated plate members (84) are stacked one upon the other (the direction extending from the front to the back side) agrees with the longitudinal direction of the casing (100), and that the direction in which the flat and corrugated plate members (83, 84) of the first adsorptive element (81) are stacked together is in parallel with the direction in which the flat and corrugated plate members (83, 84) of the second adsorptive element (82) are stacked together. Furthermore, each adsorptive element (81, 82) is arranged in such orientation that: the right and left side surfaces are substantially in parallel with the side plates of the casing (100), respectively; the upper and lower surfaces are substantially in parallel with the top and bottom plates of the casing (100), respectively; and the back and front end surfaces are substantially in parallel with the outdoor and indoor side panels (111, 112), respectively.

The first auxiliary heat exchanger (78) is disposed on the lower surface of the first adsorptive element (81). The second auxiliary heat exchanger (79) is disposed on the lower surface of the second adsorptive element (82). The first auxiliary heat exchanger (78) and the second auxiliary heat exchanger (79) are fin and tube heat exchangers of the so-called cross fin type, and are configured such that they serve not only as a cooler for cooling a first air stream but also as an auxiliary heater for heating a second air stream.

Each adsorptive element (81, 82) positioned within the casing (100) has right and left side surfaces at which the auxiliary passageway (86) opens. In other words, one side surface that opens to the auxiliary passageway (86) in the first adsorptive element (81) and one side surface that opens to the auxiliary passageway (86) in the second adsorptive element (82) are situated face to face with each other.

The space defined between the second partition plate (130) and the third partition plate (140) is divided into a right side flow passage (181), a left side flow passage (182), an upper right flow passage (183), a lower right flow passage (184), an upper left flow passage (185), a lower left flow passage (186), and a central flow passage (187).

The right side flow passage (181) is formed on the right side of the first adsorptive element (81) and is in fluid communication with the auxiliary passageway (86) of the first adsorptive element (81). On the other hand, the left side flow passage (182) is formed on the left side of the second adsorptive element (82) and is in fluid communication with the auxiliary passageway (86) of the second adsorptive element (82).

The upper right flow passage (183) is formed on the upper side of the first adsorptive element (81) and is in fluid communication with the humidity control passageway (85) of the first adsorptive element (81). The lower right flow passage (184) is formed on the lower side of the first adsorptive element (81) (to be exact, on the lower side of the first auxiliary heat exchanger (78)) and is in fluid communication with the humidity control passageway (85) of the first adsorptive element (81). The upper left flow passage (185) is formed on the upper side of the second adsorptive element (82) and is in fluid communication with the humidity control passageway (85) of the second adsorptive element (82). The lower left flow passage (186) is formed on the lower side of the second adsorptive element (82) (to be exact, on the lower side of the second auxiliary heat exchanger (79)) and is in fluid communication with the humidity control passageway (85) of the second adsorptive element (82).

The central flow passage (187) is formed between the first adsorptive element (81) and the second adsorptive element (82) and is in fluid communication with the auxiliary passageway (86) of each of the adsorptive elements (81, 82). The central flow passage (187) has a flow-passage cross section shaped like an octagon as appeared in FIG. 20.

The left side opening (132) of the second partition plate (130) allows fluid communication between the left peripheral space (171) and the left side flow passage (182). The right side opening (131) allows fluid communication between the right peripheral space (174) and the right side flow passage (181). The upper left opening (135) allows fluid communication between the left side central space (172) and the upper left flow passage (185). The lower left opening (136) allows fluid communication between the left side central space (172) and the lower left flow passage (186). The upper right opening (133) allows fluid communication between the right side central space (173) and the upper right flow passage (183). The lower right opening (134) allows fluid communication between the right side central space (173) and the lower right flow passage (184).

The regeneration heat exchanger (72) is a fin and tube heat exchanger of the so-called cross fin type and is configured such that the regeneration heat exchanger (72) heats a stream of air flowing through the central flow passage (187). The regeneration heat exchanger (72) is disposed in the central flow passage (187). Stated another way, the regeneration heat exchanger (72) lies between the first adsorptive element (81) and the second adsorptive element (82) which are arranged side by side in lateral direction. Additionally, the regeneration heat exchanger (72) is disposed in a substantially upright position, such that the central flow passage (187) is separated into right and left.

Disposed between the first adsorptive element (81) and the regeneration heat exchanger (72) is a right side partition plate (191) as a partition between the right side portion of the regeneration heat exchanger (72) in the central flow passage (187) and the upper right flow passage (183). On the other hand, disposed between the second adsorptive element (82) and the regeneration heat exchanger (72) is a left side partition plate (192) as a partition between the left side portion of the regeneration heat exchanger (72) in the central flow passage (187) and the upper left flow passage (185).

A lower right shutter (193) is provided which opens or closes fluid communication between the right side flow passage (181) and the lower right flow passage (184). A lower left shutter (194) is provided which opens or closes fluid communication between the left side flow passage (182) and the lower left flow passage (186).

The third partition plate (140) is configured in the same way that the second partition plate (130) is configured. Formed in the third partition plate (140) are a right side opening (141), a left side opening (142), an upper right opening (143), and a lower right opening (144), an upper left opening (145), and a lower left opening (146). The upper left opening (145), the lower left opening (146), the upper right opening (143) and the lower right opening (144) are each provided with a respective opening/closing shutter and is configured such that it can freely be placed in the open or closed state.

The space defined between the third partition plate (140) and the fourth partition plate (150) is divided, sequentially from the left to the right side, into a left peripheral space (176), a left side central space (177), a right side central space (178), and a right peripheral space (179).

The left side opening (142) allows fluid communication between the left side flow passage (182) and the left peripheral space (176). The right side opening (141) allows fluid communication between the right side flow passage (181) and the right peripheral space (179). The upper left opening (145) allows fluid communication between the upper left flow passage (185) and the left side central space (177). The lower left opening (146) allows fluid communication between the lower left flow passage (186) and the left side central space (177). The upper right opening (143) allows fluid communication between the upper right flow passage (183) and the right side central space (178). The lower right opening (144) allows fluid communication between the lower right flow passage (184) and the right side central space (178).

The space defined between the fourth partition plate (150) and the indoor side panel (112) is divided into an indoor side upper space (166) and an indoor side lower space (167). The indoor side upper space (166) is in fluid communication with an indoor space through the air supply opening (114). The indoor side lower space (167) is in fluid communication with the indoor space through the indoor side suction opening (113). The air supply fan (95) is disposed to the left periphery of the indoor side upper space (166).

The fourth partition plate (150) is configured in the same way that the first partition plate (120) is configured. Formed in the fourth partition plate (150) are a right side opening (151), a left side opening (152), an upper right opening (153), a lower right opening (154), an upper left opening (155), and a lower left opening (156). These openings (151-156) are each provided with a respective opening/closing shutter and is configured such that it can freely be placed in the open or closed state.

The left side opening (152) allows fluid communication between the left peripheral space (176) and the indoor side lower space (167). The lower left opening (156) allows fluid communication between the left side central space (177) and the indoor side lower space (167). The lower right opening (154) allows fluid communication between the right side central space (178) and the indoor side lower space (167). The right side opening (151) allows fluid communication between the right peripheral space (179) and the indoor side lower space (167). The upper left opening (155) allows fluid communication between the left side central space (177) and the indoor side upper space (166). The upper right opening (153) allows fluid communication between the right side central space (178) and the indoor side upper space (166).

Configuration of the Refrigerant Circuit

Figure 23:
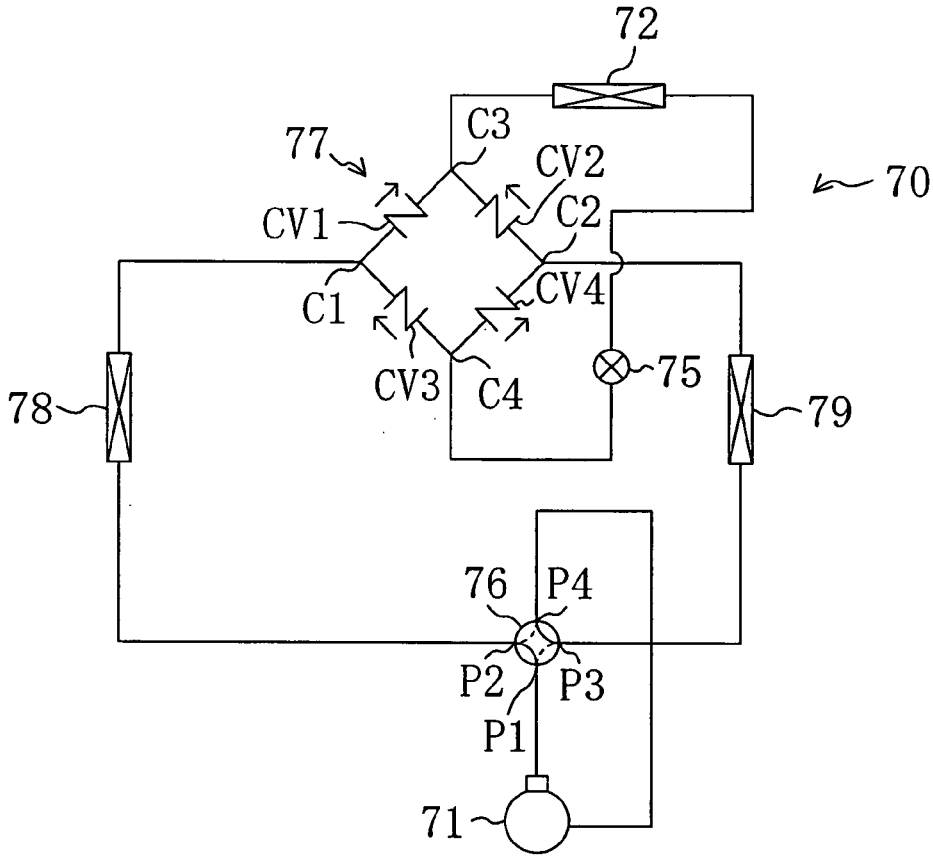
FIG. 23 is a circuit diagram showing a refrigerant circuit of the humidity control device of the third embodiment.

The refrigerant circuit (70) is configured as shown in FIG. 23.

The refrigerant circuit (70) is made up of a compressor (71), a regeneration heat exchanger (72), a first auxiliary heat exchanger (78), a second auxiliary heat exchanger (79), an expansion valve (75), a four-way switching valve (76), and a direction controlling circuit (77).

The direction controlling circuit (77) is a bridge circuit which is a combination of four check valves (CV1-CV4), and has four connection ends (C1-C4). Provided in the bridge circuit (77) are a first check valve (CV1) which allows only the flow of refrigerant from the first connection end (C1) towards the third connection end (C3), a second check valve (CV2) which allows only the flow of refrigerant from the second connection end (C2) towards the third connection end (C3), a third check valve (CV3) which allows only the flow of refrigerant from the fourth connection end (C4) towards the first connection end (C1), and a fourth check valve (CV4)

which allows only the flow of refrigerant from the fourth connection end (C4) towards the second connection end (C2).

In the refrigerant circuit (70), the discharge side of the compressor (71) is connected to a first port (P1) of the four-way switching valve (76), and a second port (P2) of the four-way switching valve (76) is connected, through the first auxiliary heat exchanger (78), to the first connection end (C1) of the bridge circuit (77). The third connection end (C3) of the bridge circuit (77) is connected, through the regeneration heat exchanger (72) and the expansion valve (75), to the fourth connection end (C4) of the bridge circuit (77). The second connection end (C2) of the bridge circuit (77) is connected, through the second auxiliary heat exchanger (79), to a third port (P3) of the four-way switching valve (76), and a fourth port (P4) of the four-way switching valve (76) is connected to the suction side of the compressor (71).

The four-way switching valve (76) is configured such that it can selectively change state between a first state in which the first and second ports (P1, P2) are in fluid communication while the third and fourth ports (P3, P4) are in fluid communication, and a second state in which the first and third ports (P1, P3) are in fluid communication while the second and fourth ports (P2, P4) are in fluid communication.

In the refrigerant circuit (70), when the four-way switching valve (76) changes state to the first state, refrigerant discharged from the compressor (71) passes through the first auxiliary heat exchanger (78), the first check valve (CV1), the regeneration heat exchanger (72), the expansion valve (75), the fourth check valve (CV4), and the second auxiliary heat exchanger (79), and is drawn into the compressor (71). Such a circulation is repeatedly carried out. At this time, the first auxiliary heat exchanger (78) and the regeneration heat exchanger (72) serve as a condenser while on the other hand the second auxiliary heat exchanger (79) serves as an evaporator.

On the other hand, when the four-way switching valve (76) changes state to the second state, refrigerant discharged from the compressor (71) passes through the second auxiliary heat exchanger (79), the second check valve (CV2), the regeneration heat exchanger (72), the expansion valve (75), the third check valve (CV3), and the first auxiliary heat exchanger (78), and is drawn into the compressor (71). Such a circulation is repeatedly carried out. At this time, the second auxiliary heat exchanger (79) and the regeneration heat exchanger (72) serve as a condenser while on the other hand the first auxiliary heat exchanger (78) serves as an evaporator.

RUNNING OPERATION OF THE HUMIDITY CONTROL DEVICE

Dehumidification Operation

Next, the running operation of the humidity control device (3) is described. The humidity control device (3) alternately repeatedly performs a first operation (see FIG. 21) in which the process of adsorption occurs in the first adsorptive element (81) while the process of regeneration occurs in the second adsorptive element (82), and a second operation (see FIG. 22) in which the process of adsorption occurs in the second adsorptive element (82) while the process of regeneration occurs in the first adsorptive element (81). In other words, the humidity control device (3) performs a so-called batch operation. The humidity control device (3) continuously provides room dehumidification by alternately repeatedly performing the first operation and the second operation.

First Operation

Referring first to FIG. 21, the first operation is described. As will be described below, in the first operation, the process of adsorption in the first adsorptive element (81) is carried out simultaneously with the process of regeneration in the second adsorptive element (82).

In the first partition plate (120), the lower right opening (124) and the upper left opening (125) are placed in the open state while on the other hand the right side opening (121), the upper right opening (123), the lower left opening (126), and the left side opening (122) are placed in the closed state. In the second partition plate (130), the lower right opening (134) and the lower left opening (136) are placed in the closed state while on the other hand the upper right opening (133) and the upper left opening (135) are placed in the open state. The right side opening (131) and the left side opening (132) are placed in the open state. In the third partition plate (140), the lower right opening (144) is placed in the open state while on the other hand the upper right opening (143), the upper left opening (145), and the lower left opening (146) are placed in the closed state. The right side opening (141) and the left side opening (142) are placed in the open state. In the fourth partition plate (150), the upper right opening (153) and the right side opening (151) are placed in the open state while on the other hand the lower right opening (154), the upper left opening (155), the lower left opening (156), and the left side opening (152) are placed in the closed state.

Outside air (hereinafter referred to as the first air stream) taken in through the outdoor side suction opening (115) passes through the outdoor side lower space (162), the lower right opening (124) of the first partition plate (120), the right side central space (173), and the upper right opening (133) of the second partition plate (130) in that order, and is introduced into the upper right flow passage (183).

Figure 24:
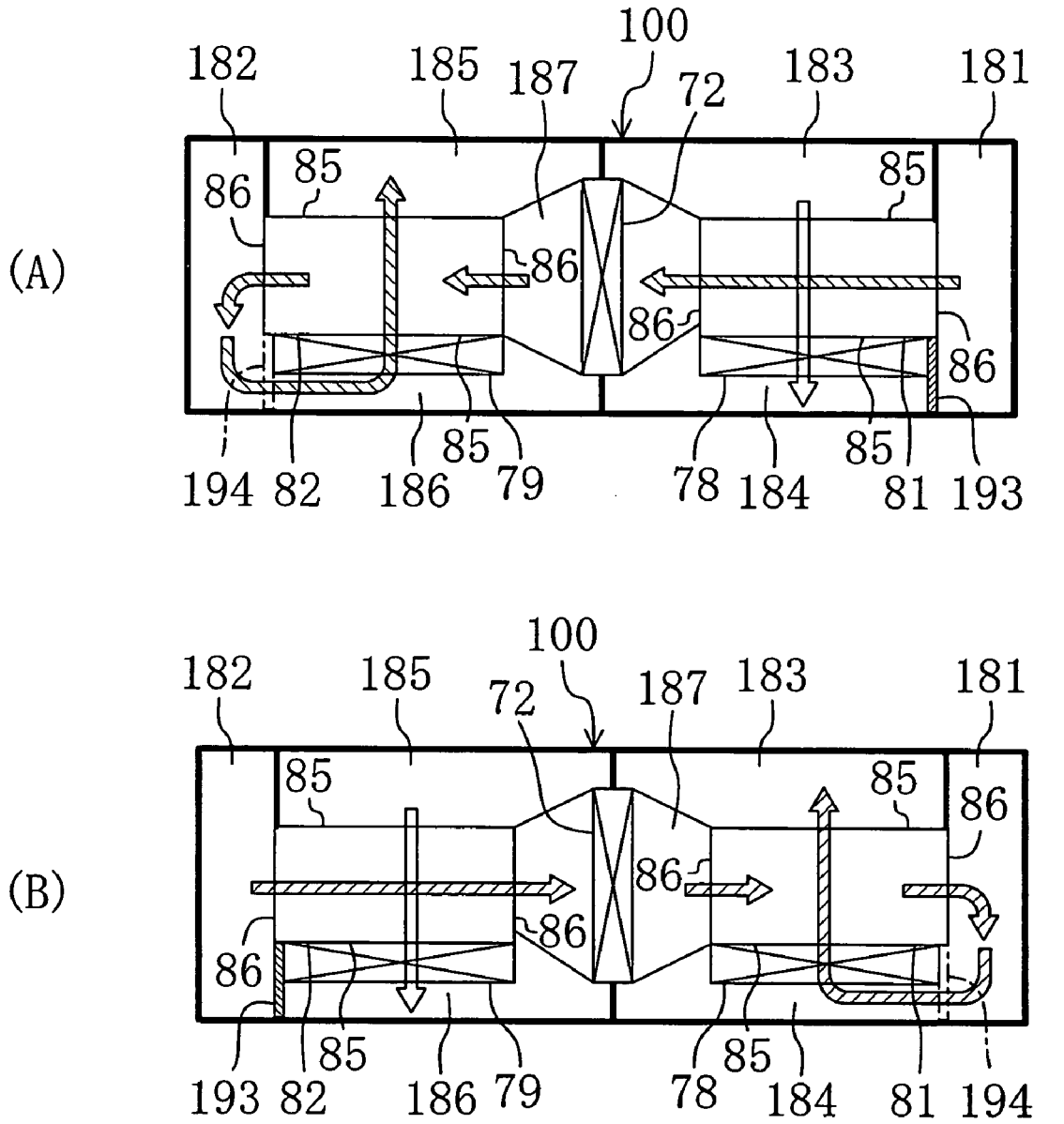

The first air stream introduced into the upper right flow passage (183) passes downwardly through the humidity control passageway (85) of the first adsorptive element (81) and the first auxiliary heat exchanger (78) and flows into the lower right flow passage (184). At that time, as shown in FIG. 24(A), the first air stream is dehumidified as a result of moisture adsorption by the first adsorptive element (81) and, at the same time, is cooled by the first auxiliary heat exchanger (as a cooler) (78) which is serving as an evaporator.

After the entrance into the lower right flow passage (184), the first air stream passes through the lower right opening (144) of the third partition plate (140), the right side central space (178), the upper right opening (153) of the fourth partition plate (150), and the indoor side upper space (166) in that order. And, the first air stream is supplied into the room via the air supply opening (114).

On the other hand, room air (hereinafter referred to as the second air stream) taken in through the indoor side suction opening (113) passes through the indoor side lower space (167), the right side opening (151) of the fourth partition plate (150), the right peripheral space (179), the right side opening (141) of the third partition plate (140) in that order, and is introduced into the right side flow passage (181).

The second air stream introduced into the right side flow passage (181) flows into the auxiliary passageway (86) of the first adsorptive element (81). During the flow through the auxiliary passageway (86), the second air stream absorbs heat of adsorption generated when water vapors are adsorbed on the adsorbent in the humidity control passageway (85). In other words, the second air stream flows, as a cooling fluid, through the auxiliary passageway (86) and cools the first adsorptive element (81). After the passage through the auxiliary passageway (86), the second air stream passes through the regeneration heat exchanger (72). At that time, in the regeneration heat exchanger (72), the second air stream is heated as a result of heat exchange with the refrigerant. Thereafter, the second air stream flows into the auxiliary passageway (86) of the second adsorptive element (82) by way of the central flow passage (187) and heats the second adsorptive element (82).

After the passage through the auxiliary passageway (86) of the second adsorptive element (82), the second air stream flows out to the left side flow passage (182) from which the second air stream flows, through the opening of the lower left shutter (194), into the lower left flow passage (186). During the passage through the second auxiliary heat exchanger (79) as an auxiliary heater, the second air stream is heated as a result of heat exchange with the refrigerant of the refrigerant circuit (70).

The second air stream thus heated is introduced into the humidity control passageway (85) of the second adsorptive element (82), passes upwardly through the humidity control passageway (85), and flows into the upper left flow passage (185). In the humidity control passageway (85), the adsorbent is heated by the second air stream and, as a result, water vapors are desorbed from the adsorbent. In other words, the second adsorptive element (82) is regenerated.

After the entrance into the upper left flow passage (185), the second air stream flows through the upper left opening (135) of the second partition plate (130), the left side central space (172), the upper left opening (125) of the first partition plate (120), and the outdoor side upper space (161) in that order, and is discharged to outside the room via the air discharge opening (116).

Figure 22:
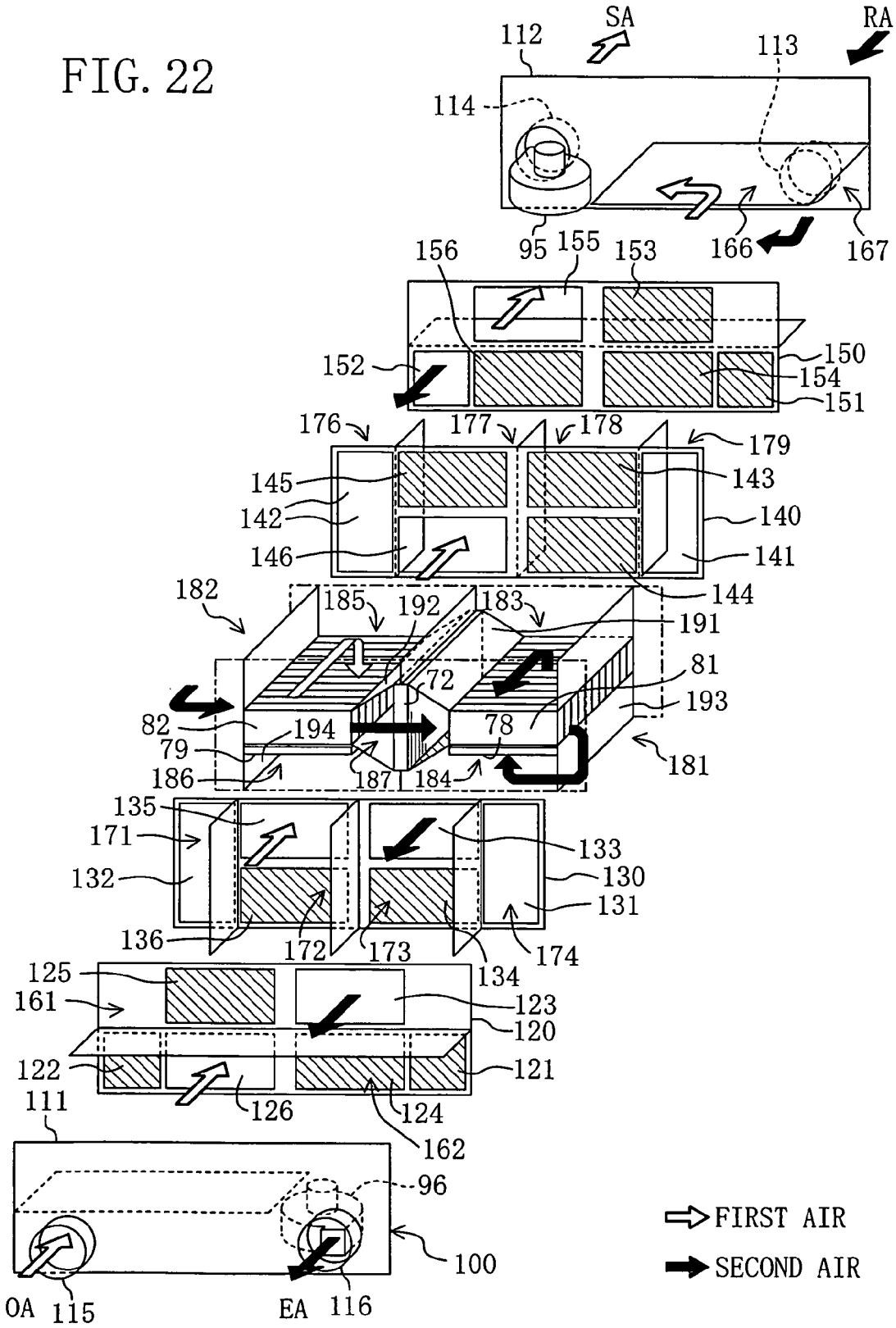
FIG. 22 is an exploded perspective view which illustrates the flow of air streams in a second operation of the dehumidification operating mode of the humidity control device of the third embodiment.

After continuing the above-described first operation for a predetermined length of time, the following second operation is started. With reference to FIG. 22, the second operation is described.

Second Operation

Contrary to the first operation, in the second operation, the process of adsorption in the second adsorptive element (82) is performed simultaneously with the process of regeneration in the first adsorptive element (81).

As shown in FIG. 22, in the first partition plate (120), the upper right opening (123) and the lower left opening (126) are placed in the open state while on the other hand the right side opening (121), the lower right opening (124), the upper left opening (125), and the left side opening (122) are placed in the closed state. In the second partition plate (130), the lower right opening (134) and the lower left opening (136) are placed in the closed state while on the other hand the upper right opening (133) and the upper left opening (135) are placed in the open state. The right side opening (131) and the left side opening (132) are placed in the open state. In the third partition plate (140), the lower left opening (146) is placed in the open state while on the other hand the upper left opening (145), the upper right opening (143), and the lower right opening (144) are placed in the closed state. The right side opening (141) and the left side opening (142) are placed in the open state. In the fourth partition plate (150), the upper left opening (155) and the left side opening (152) are placed in the open state while on the other hand the lower left opening (156), the upper right opening (153), the lower right opening (154), and the right side opening (151) are placed in the closed state.

Outside air (hereinafter referred to as the first air stream) drawn in through the outdoor side suction opening (115) passes through the outdoor side lower space (162), the lower left opening (126) of the first partition plate (120), the left side central space (172), and the upper left opening (135) of the second partition plate (130) in that order, and is introduced into the upper left flow passage (185).

The first air stream introduced into the upper left flow passage (185) passes downwardly through the humidity control passageway (85) of the second adsorptive element (82) and the second auxiliary heat exchanger (79) and flows into the lower left flow passage (186). At that time, as also shown in FIG. 24(B), the first air stream is dehumidified as a result of moisture adsorption by the second adsorptive element (82) and, at the same time, is cooled by the second auxiliary heat exchanger (cooler) (79) which is serving as an evaporator.

After the entrance into the lower left flow passage (186), the first air stream passes through the lower left opening (146) of the third partition plate (140), the left side central space (177), the upper left opening (155) of the fourth partition plate (150), and the indoor side upper space (166) in that order. And, the first air stream is supplied into the room via the air supply opening (114).

On the other hand, room air (hereinafter referred to as the second air stream) drawn in through the indoor side suction opening (113) passes through the indoor side lower space (167), the left side opening (152) of the fourth partition plate (150), the left peripheral space (176), the left side opening (142) of the third partition plate (140) in that order, and is introduced into the left side flow passage (182).

The second air stream introduced into the left side flow passage (182) flows into the auxiliary passageway (86) of the second adsorptive element (82). During the flow through the auxiliary passageway (86), the second air stream absorbs heat of adsorption generated when water vapors are adsorbed on the adsorbent in the humidity control passageway (85). In other words, the second air stream flows, as a cooling fluid, through the auxiliary passageway (86) and cools the second adsorptive element (82). After the passage through the auxiliary passageway (86), the second air stream next passes through the regeneration heat exchanger (72). At that time, in the regeneration heat exchanger (72), the second air stream is heated as a result of heat exchange with the refrigerant. Thereafter, the second air stream flows into the auxiliary passageway (86) of the first adsorptive element (81) by way of the central flow passage (187) and heats the first adsorptive element (81).

After the passage through the auxiliary passageway (86) of the first adsorptive element (81), the second air stream flows out to the right side flow passage (181) from which the second air stream flows, through the opening of the lower right shutter (193), into the lower right flow passage (184). During the passage through the first auxiliary heat exchanger (auxiliary heater) (78), the second air stream is heated as a result of heat exchange with the refrigerant of the refrigerant circuit (70).

The second air stream thus heated is introduced into the humidity control passageway (85) of the first adsorptive element (81), passes upwardly through the humidity control passageway (85), and flows into the upper right flow passage (183). In the humidity control passageway (85), the adsorbent is heated by the second air stream and, as a result, water vapors are desorbed from the adsorbent. In other words, the first adsorptive element (81) is regenerated.

After the entrance into the upper right flow passage (183), the second air stream flows through the upper right opening (133) of the second partition plate (130), the right side central space (173), the upper right opening (123) of the first partition plate (120), and the outdoor side upper space (161) in that order, and is discharged to outside the room via the air discharge opening (116).

Humidification Operation

In the humidity control device (3), also during the humidification operating mode, the first and second operations are alternately repeatedly carried out to perform a batch operation.

Figure 25:
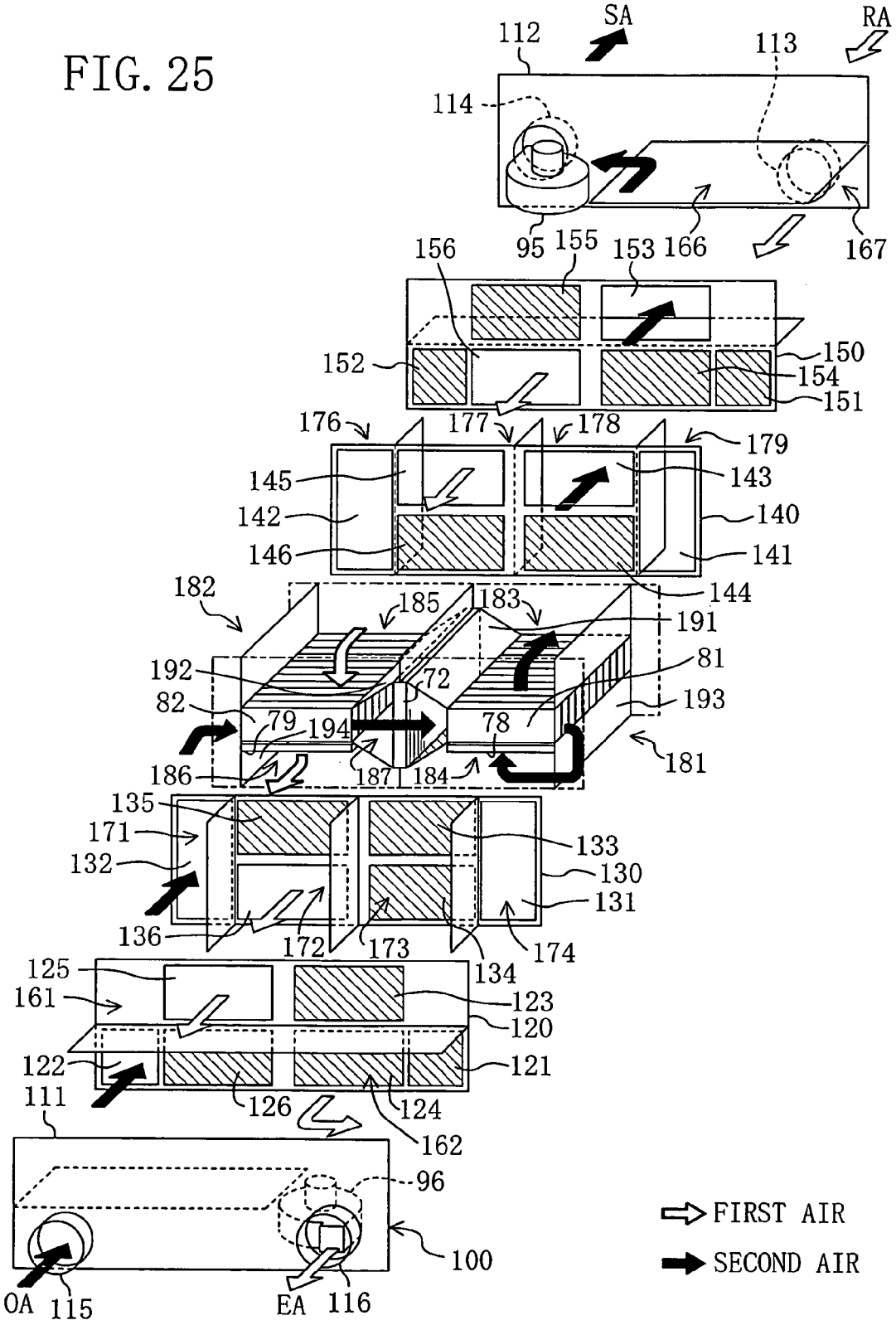
FIG. 25 is an exploded perspective view which illustrates the flow of air streams in a first operation of the humidification operating mode of the humidity control device of the third embodiment.

The state of the shutter of each of the openings and the flow of air streams are not described in detail here. It should, however, be noted that, in the first operation, outside air flows, as a second air stream, through the auxiliary passageway (86) of the second adsorptive element (82), the regeneration heat exchanger (72), the auxiliary passageway (86) of the first adsorptive element (81), the first auxiliary heat exchanger (78), and the humidity control passageway (85) of the first adsorptive element (81) in that order, is humidified/heated, and is then supplied into the room, as shown in FIG. 25. On the other hand, room air flows, as a first air stream, through the humidity control passageway (85) of the second adsorptive element (82), releases moisture to the second adsorptive element (82), and is then discharged to outside the room.

Figure 26:
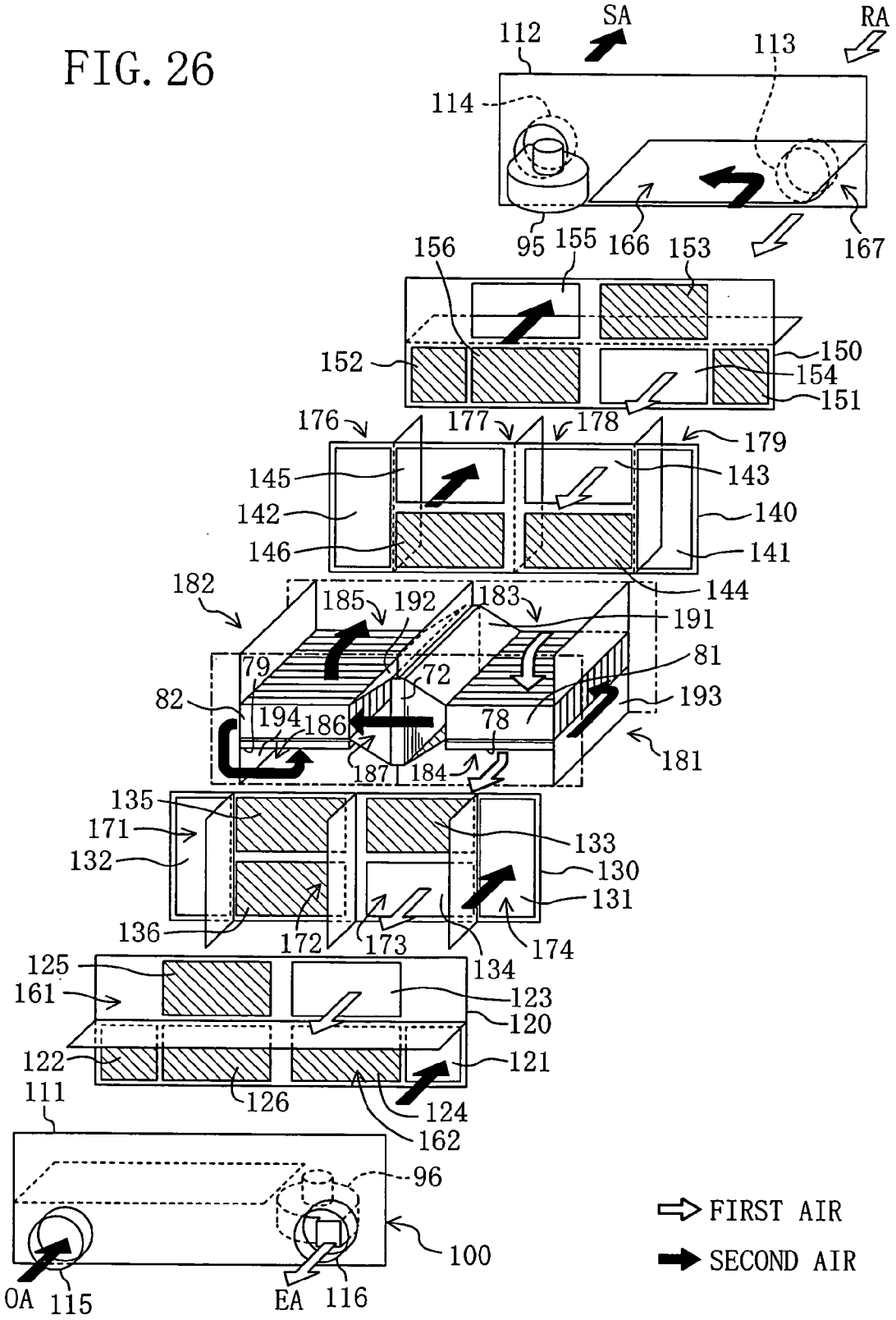
FIG. 26 is an exploded perspective view which illustrates the flow of air streams in a second operation of the humidification operating mode of the humidity control device of the third embodiment.

In addition, in the second operation, outside air flows, as a second air stream, through the auxiliary passageway (86) of the first adsorptive element (81), the regeneration heat exchanger (72), the auxiliary passageway (86) of the second adsorptive element (82), the second auxiliary heat exchanger (79), and the humidity control passageway (85) of the second adsorptive element (82) in that order, is humidified/heated, and is then supplied into the room, as shown in FIG. 26. On the other hand, room air flows, as a first air stream, through the humidity control passageway (85) of the first adsorptive element (81), releases moisture to the first adsorptive element (81), and is then discharged to outside the room.

Effects of the Third Embodiment

Also in the third embodiment, it is arranged such that, after a stream of air heated in the regeneration heat exchanger (72) is passed through the auxiliary passageway (86) of the adsorptive element (81, 82), the air stream is further heated either in the first auxiliary heat exchanger (78) or in the second auxiliary heat exchanger (79) and is made to flow through the humidity control passageway (85) so that the adsorptive element (81, 82) is regenerated. Consequently, the adsorptive element (81, 82) is maintained at high temperature, thereby making it possible to increase the amount of release moisture (the amount of regeneration) more than is conventionally achieved. Accordingly, it becomes possible to increase also the amount of adsorption the next time the adsorptive element (81, 82) adsorbs moisture in a first air stream, thereby accomplishing improvement in device performance.

In addition, it is arranged such that a second air stream before regeneration flows, as a cooling fluid, through the auxiliary passageway (86) of the adsorptive element (81, 82) under adsorption. As a result of such arrangement, heat of adsorption generated as a result of moisture adsorption can be absorbed by the cooling fluid. If no cooling fluid is made to flow, this causes the adsorptive element (81, 82) to undergoing a temperature rise due to the heat of adsorption and, as a result, the adsorption capability falls. It is, however, possible to prevent a drop in adsorption capability by the flowing of a cooling fluid.

And, in the present embodiment, it is arranged such that, when performing a batch running operation in the humidity control device (3) provided with the first adsorptive element (81) and the second adsorptive element (82), a cooling/adsorption operating mode is conducted in one of the adsorptive elements (81, 82) while simultaneously a heating/regeneration operating mode is conducted in the other of the adsorptive elements (81, 82). This makes it possible to accomplish improvement in both adsorptive capability and regenerative capability, thereby accomplishing improvement in total device performance.

Variational Examples

Figure 27:
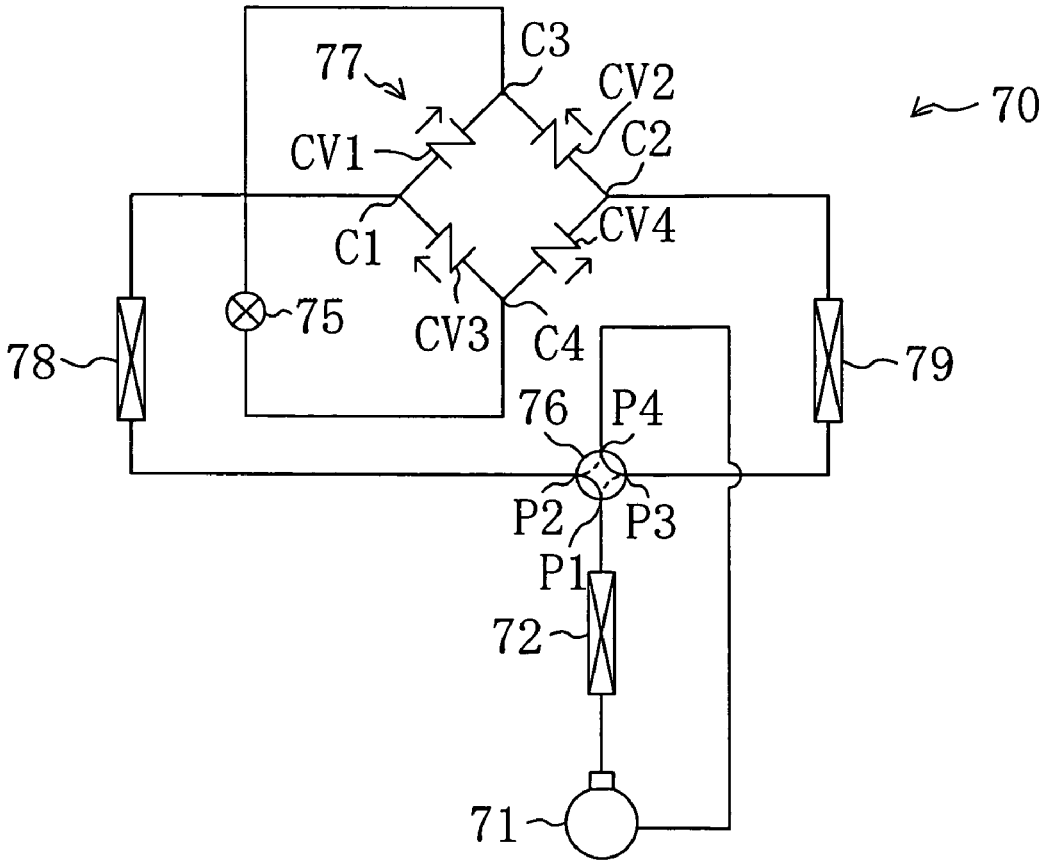
FIG. 27 is a circuit diagram which shows a variation of the refrigerant circuit.
Figure 28:
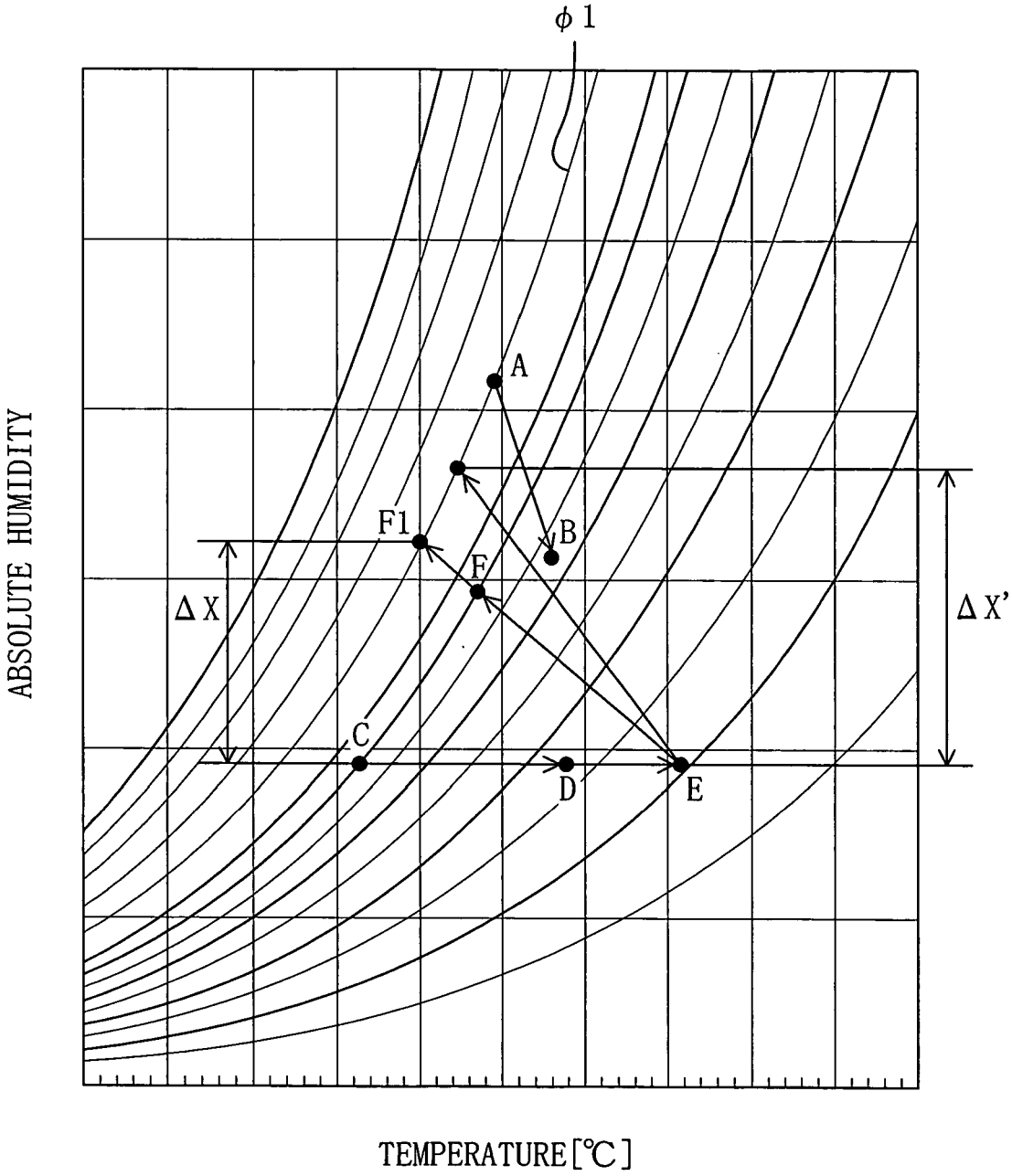
FIG. 28 is a psychrometric chart which represents the change of state of the air during the dehumidification operating mode in the summertime.
Figure 29:
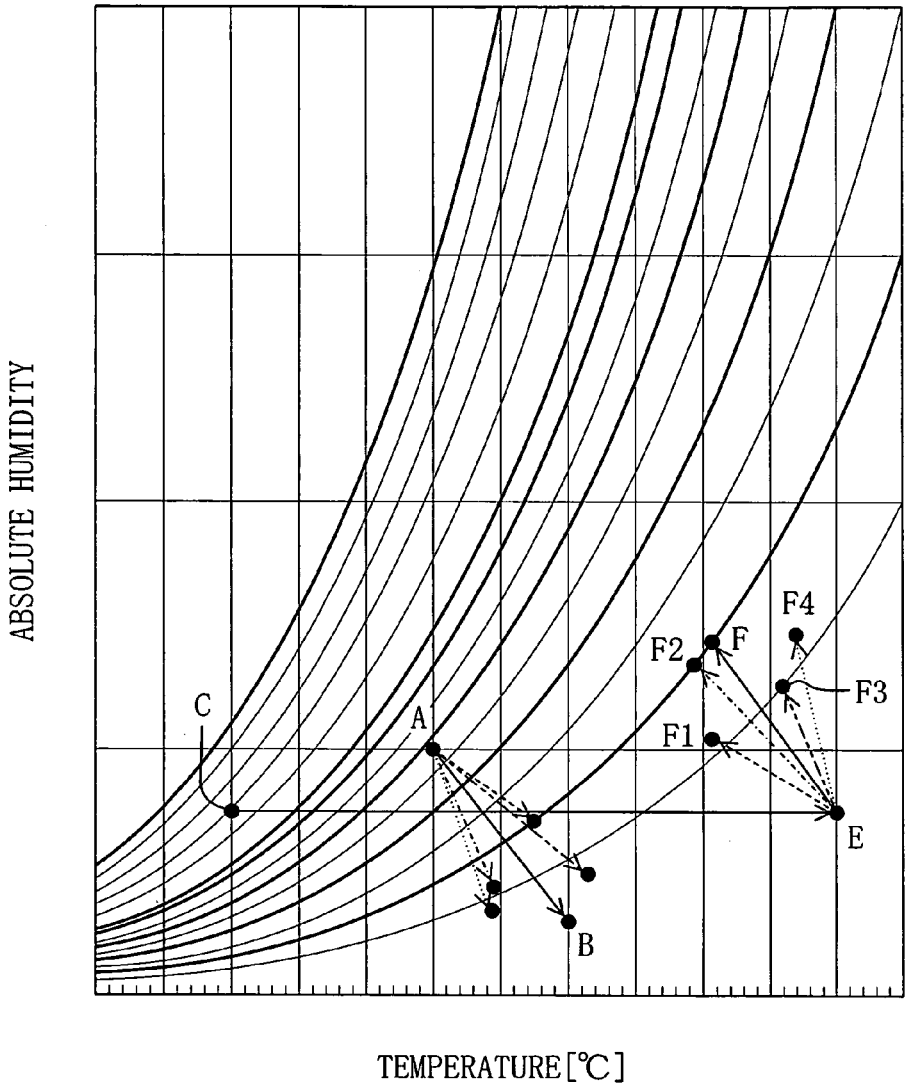
FIG. 29 is a psychrometric chart which represents the change of state of the air during the humidification operating mode in the wintertime.

The refrigerant circuit (70) may be configured as shown in FIG. 27 in the above-described embodiment.

Like the example of FIG. 23, the refrigerant circuit (70) of FIG. 27 is made up of a compressor (71), a regeneration heat exchanger (72), a first auxiliary heat exchanger (78), a second auxiliary heat exchanger (79), an expansion valve (75), a four-way switching valve (76), and a direction controlling circuit (bridge circuit) (77).

In the refrigerant circuit (70), the discharge side of the compressor (71) is connected, through the regeneration heat exchanger (72), to the first port (P1) of the four-way switching valve (76), and the second port (P2) of the four-way switching valve (76) is connected, through the first auxiliary heat exchanger (78), to the first connection end (C1) of the bridge circuit (77). The third connection end (C3) of the bridge circuit (77) is connected, through the expansion valve (75), to the fourth connection end (C4) of the bridge circuit (77). The second connection end (C2) of the bridge circuit (77) is connected, through the second auxiliary heat exchanger (79), to the third port (P3) of the four-way switching valve (76), and the fourth port (P4) of the four-way switching valve (76) is connected to the suction side of the compressor (71).

In the refrigerant circuit (70), when the four-way switching valve (76) changes state to the first state, refrigerant discharged from the compressor (71) passes through the regeneration heat exchanger (72), the first auxiliary heat exchanger (78), the first check valve (CV1), the expansion valve (75), the fourth check valve (CV4), and the second auxiliary heat exchanger (79), and is drawn into the compressor (71). Such a circulation is repeatedly carried out. At this time, the regeneration heat exchanger (72) and the first auxiliary heat exchanger (78) serve as a condenser while on the other hand the second auxiliary heat exchanger (79) serves as an evaporator.

On the other hand, when the four-way switching valve (76) changes state to the second state, refrigerant discharged from the compressor (71) passes through the regeneration heat exchanger (72), the second auxiliary heat exchanger (79), the second check valve (CV2), the expansion valve (75), the third check valve (CV3), and the first auxiliary heat exchanger (78), and is drawn into the compressor (71). Such a circulation is repeatedly carried out. At this time, the regeneration heat exchanger (72) and the second auxiliary heat exchanger (79) serve as a condenser while on the other hand the first auxiliary heat exchanger (78) serves as an evaporator.

Even such a configuration makes it possible to perform the same operation that the foregoing each example does because it is possible to perform a refrigeration cycle by such arrangement that the regeneration heat exchanger (72) serves as a condenser and any one of the first auxiliary heat exchanger (78) and the second auxiliary heat exchanger (79) serves as a condenser (auxiliary heater) while the other serves as an evaporator (cooler).

OTHER EMBODIMENTS

With respect to the foregoing embodiments, the present invention may be configured as follows.

For example, each of the foregoing embodiments employs, as a heat source for adsorptive-element regeneration, a hot-water heat exchanger or a refrigerant circuit's condenser (regeneration heat exchanger). Alternatively, electric heaters may be employed. To sum up, it suffices if suitable equipment capable of providing heating is selected and used. In addition, as a heat source for adsorptive-element cooling, a cold-water heat exchanger may be used instead of a refrigerant circuit's evaporator. To sum up, it suffices if suitable equipment capable of providing cooling is selected and used.

In each of the foregoing embodiments, the description has been made in terms of a batch humidity control device provided with two adsorptive elements. Alternatively, the present invention is applicable to a humidity control device of the type which employs a rotor adsorptive element, wherein the process of adsorption is performed in a part of the rotor adsorptive element while the rest of the rotor adsorptive element is regenerated. Further, the present invention is applicable to a humidity control device which is provided with only a single adsorptive element and which does not perform a batch running operation.

Additionally in the second and third embodiments, it is arranged such that, when performing a batch running operation, a cooling/adsorption operating mode in which a cooling fluid flows through the auxiliary passageway (86) of the adsorptive element (81, 82) which adsorbs moisture in a first air stream is carried out simultaneously with a heating/regeneration operating mode in which a heating fluid flows through the auxiliary passageway (86) of the adsorptive element (81, 82) which releases moisture to a second air stream. Alternatively, one of the cooling/adsorption operating mode and the heating/regeneration operating mode may selectively be performed by air-passage switching. Also in this case, it is possible to accomplish improvement in either adsorptive capability or regenerative capability, thereby enhancing the device performance.

Furthermore, in each of the foregoing embodiments, the description has been made in terms of the configuration of a humidity control device (the configuration of a so-called air ventilation fan device) in which the humidity of outside air is conditioned as a first air stream (or a second air stream) and is then supplied into the room while room air is discharged to outside the room as a second air stream (or a first air stream). The humidity control device of the present invention is, however, applicable to so-called air supply fan devices, air discharge fan devices, or air circulation fan devices. An air supply fan device uses outside air as a first air stream and as a second air stream in each of the foregoing embodiments. In this case, the humidity of outside air is controlled as a first air stream (or as a second air stream) and is then supplied into the room while outside air is used as a second air stream (or as a first air stream) and is then discharged again to outside the room. In addition, an air discharge fan device uses room air as a first air stream and as a second air stream in each of the foregoing embodiments. In this case, the humidity of room air is conditioned as a first air stream (or as a second air stream) and is then supplied again into the room while room air is used as a second air stream (or as first air stream) and is then discharged outside the room. Furthermore, an air circulation fan device reversely uses outside air and room air in each of the foregoing embodiments. In this case, the humidity of room air is conditioned as a first air stream (or as a second air stream) and is then supplied again into the room while outside air is used as a second air stream (or as a first air stream) and is then discharged again to outside the room.

INDUSTRIAL APPLICABILITY

As has been described above, the present invention is found useful when applied to humidity control devices which repeatedly perform moisture adsorption and regeneration in adsorptive elements.

What is claimed is:

1. A humidity control device comprising:

an adsorptive unit having a humidity control passageway whose surface is provided with an adsorbent and which is capable of adsorbing moisture from a first air stream and of releasing moisture to a second air stream; and an auxiliary passageway through which air flows to cool the humidity control passageway when adsorbing moisture and heat the humidity control passageway when releasing moisture, the humidity control device supplying to an indoor space an air stream after the adsorptive unit controls humidity of the air stream, wherein, the auxiliary passageway is configured such that all of the second air stream prior to its passage through the humidity control passageway flows into the auxiliary passageway as a heating fluid when the adsorptive unit is regenerated by releasing moisture from the humidity control passageway.

2. A humidity control device comprising:

an adsorptive unit having a humidity control passageway whose surface is provided with an adsorbent and which is capable of adsorbing moisture from a first air stream and of releasing moisture to a second air stream; and an auxiliary passageway through which air flows to cool the humidity control passageway when adsorbing moisture and heat the humidity control passageway when releasing moisture, the humidity control device supplying to an indoor space an air stream after the adsorptive unit controls humidity of the air stream, wherein, the auxiliary passageway is configured such that a part of the second air stream prior to its passage through the humidity control passageway flows into the auxiliary passageway as a heating fluid when the adsorptive unit is regenerated by releasing moisture from the humidity control passageway, joins the rest of the second air stream which does not flow into the auxiliary passageway, and passes through the humidity control passageway.

3. The humidity control device of claim 1, wherein said humidity control device includes a regeneration heater which heats the second air stream prior to its entrance into the humidity control passageway and the auxiliary passageway.

4. The humidity control device of claim 3, wherein said humidity control device includes a refrigerant circuit through which a refrigerant is circulated to perform a refrigeration cycle, and wherein the regeneration heater is a heating-heat exchanger of the refrigerant circuit.

5. The humidity control device of claim 1, wherein said humidity control device includes a regeneration heater which heats the second air stream prior to its entrance into the humidity control passageway and the auxiliary passageway, and an auxiliary heater which heats the second air stream after its passage through the auxiliary passageway before the second air stream flows into the humidity control passageway.

6. The humidity control device of claim 5, wherein said humidity control device includes a refrigerant circuit through which a refrigerant is circulated to perform a refrigeration cycle, and wherein the regeneration heater and the auxiliary heater are heating-heat exchangers of the refrigerant circuit.

7. The humidity control device of claim 1, wherein said adsorptive unit includes a first adsorptive element and a second adsorptive element, and said humidity control device is configured so as to perform a batch running operation which alternately switches between (a) a first operation in which moisture in the first air stream is adsorbed in the first adsorptive element while moisture is released to the second air stream in the second adsorptive element and (b) a second operation in which moisture in the first air stream is adsorbed in the second adsorptive element while moisture is released to the second air stream in the first adsorptive element, and wherein said humidity control device is configured so as to be capable of performing (i) a cooling/adsorption operating mode in which a cooling fluid flows through the auxiliary passageway of the first adsorptive element or the second adsorptive element whichever adsorbs moisture in the first air stream and (ii) a heating/regeneration operating mode in which a heating fluid flows through the auxiliary passageway of the first adsorptive element or the second adsorptive element whichever releases moisture to the second air stream.

8. The humidity control device of claim 7, wherein said humidity control device is configured so as to simultaneously perform (i) a cooling/adsorption operating mode in which a cooling fluid flows through the auxiliary passageway of the first adsorptive element or the second adsorptive element whichever adsorbs moisture in the first air stream and (ii) a heating/regeneration operating mode in which a heating fluid flows through the auxiliary passageway of the first adsorptive element or the second adsorptive element whichever releases moisture to the second air stream.

9. The humidity control device of claim 7, wherein said humidity control device is configured so as to be capable of selectively switching between (i) a cooling/adsorption operating mode in which a cooling fluid flows through the auxiliary passageway of the first adsorptive element or the second adsorptive element whichever adsorbs moisture in the first air stream and (ii) a heating/regeneration operating mode in which a heating fluid flows through the auxiliary passageway of the first adsorptive element or the second adsorptive element whichever releases moisture to the second air stream.

10. The humidity control device of claim 7, wherein sad humidity control device includes a regeneration heater which heats the second air stream prior to its entrance into the humidity control passageway and the auxiliary passageway of one of the first adsorptive element and second adsorptive element, and a cooler which cools the first air stream after passing through the humidity control passageway of the other of the first adsorptive element and second adsorptive element.

11. The humidity control device of claim 10, wherein said humidity control device includes a refrigerant circuit through which a refrigerant is circulated to perform a refrigeration cycle, and wherein the regeneration heater is formed by a heating-heat exchanger of the refrigerant circuit and the cooler is formed by a cooling-heat exchanger of the refrigerant circuit.

12. The humidity control device of claim 7, wherein said humidity control device includes: a regeneration heater which heats the second air stream prior to its entrance into the humidity control passageway and the auxiliary passageway of one of the first adsorptive element and second adsorptive element; an auxiliary heater which heats a second air stream after its passage through the auxiliary passageway before the second air stream flows into the humidity control passageway; and a cooler which cools the first air stream after passing through the humidity control passageway of the other of the first adsorptive element and second adsorptive element.

13. The humidity control device of claim 12, wherein said humidity control device includes a refrigerant circuit through which a refrigerant is circulated to perform a refrigeration cycle, and wherein the regeneration heater and the auxiliary heater are formed by heating-heat exchangers of the refrigerant circuit and the cooler is formed by a cooling-heat exchanger of the refrigerant circuit.

14. The humidity control device of claim 11, wherein the direction of refrigerant circulation in the refrigerant circuit is reversible, and wherein the direction of refrigerant circulation in the refrigerant circuit is changed in response to switching between adsorptive and regenerative sides in the batch running operation.

15. The humidity control device of claim 13, wherein the direction of refrigerant circulation in the refrigerant circuit is reversible, and wherein the direction of refrigerant circulation in the refrigerant circuit is changed in response to switching between adsorptive and regenerative sides in the batch running operation.

16. The humidity control device of claim 2, wherein said humidity control device includes a regeneration heater which heats the part of the second air stream prior to its entrance into the humidity control passageway and the auxiliary passageway.

17. The humidity control device of claim 2, wherein said humidity control device includes a regeneration heater which heats the part of the second air stream prior to its entrance into the humidity control passageway and the auxiliary passageway, and an auxiliary heater which heats the part of the second air stream after its passage through the auxiliary passageway before the second air stream flows into the humidity control passageway.

18. The humidity control device of claim 2, wherein said adsorptive unit includes a first adsorptive element and a second adsorptive element, and said humidity control device is configured so as to perform a batch running operation which alternately switches between (a) a first operation in which moisture in the first air stream is adsorbed in the first adsorptive element while moisture is released to the second air stream in the second adsorptive element and (b) a second operation in which moisture in the first air stream is adsorbed in the second adsorptive element while moisture is released to the second air stream in the first adsorptive element, and wherein said humidity control device is configured so as to be capable of performing (i) a cooling/adsorption operating mode in which a cooling fluid flows through the auxiliary passageway of the first adsorptive element or the second adsorptive element whichever adsorbs moisture in the first air stream and (ii) a heating/regeneration operating mode in which a heating fluid flows through the auxiliary passageway of the first adsorptive element or the second adsorptive element whichever releases moisture to the second air stream.

* * * * *

UNITED STATES PATENT AND TRADEMARK OFFICE

CERTIFICATE OF CORRECTION

PATENT NO. : 7,568,355 B2
APPLICATION NO. : 10/568313
DATED : August 4, 2009
INVENTOR(S) : Tomohiro Yabu It is certified that error appears in the above-identified patent and that said Letters Patent is hereby corrected as shown below:

Title Page, item (54) Title: and Col. 1, Line 1

"HUMIDITY CONTROL APPARATUS"

should read

--HUMIDITY CONTROL DEVICE--.

Signed and Sealed this

Twenty-ninth Day of June, 2010

David J. Kappos

David J. Kappos
*Director of the United States Patent and Trademark Office*